US008117879B2

(12) United States Patent
Anderson et al.

(10) Patent No.: US 8,117,879 B2
(45) Date of Patent: Feb. 21, 2012

(54) CURVED BUILDING PANEL, BUILDING STRUCTURE, PANEL CURVING SYSTEM AND METHODS FOR MAKING CURVED BUILDING PANELS

(75) Inventors: Todd E. Anderson, Duncansville, PA (US); Frederick Morello, Johnstown, PA (US)

(73) Assignee: M.I.C. Industries, Inc., Reston, VA (US)

( * ) Notice: Subject to any disclaimer, the term of this patent is extended or adjusted under 35 U.S.C. 154(b) by 408 days.

(21) Appl. No.: 12/314,555

(22) Filed: Dec. 12, 2008

(65) Prior Publication Data

US 2010/0146789 A1 Jun. 17, 2010

(51) Int. Cl.
*B21D 5/14* (2006.01)
*B21D 5/08* (2006.01)
*B21D 13/00* (2006.01)

(52) U.S. Cl. ..... 72/171; 72/181; 72/379.6

(58) Field of Classification Search ..... 72/160, 72/166, 169, 177, 181, 195–197, 379.6
See application file for complete search history.

(56) References Cited

U.S. PATENT DOCUMENTS

| | | | |
|---|---|---|---|
| 2,436,543 | A | 2/1948 | Blaski |
| 3,150,707 | A | 4/1961 | Howell |
| 3,009,509 | A | 11/1961 | Martin |
| 3,173,225 | A | 3/1965 | Goodwill et al. |
| 3,276,171 | A | 10/1966 | Brown |
| 3,300,923 | A | 1/1967 | Behlen |
| 3,842,647 | A | 10/1974 | Knudson |
| 3,902,288 | A | 9/1975 | Knudson |
| 4,154,077 | A | 5/1979 | Cotter |
| 4,301,628 | A | 11/1981 | Lowe |
| 4,358,916 | A | 11/1982 | Lacasse |
| 4,364,253 | A | 12/1982 | Knudson |
| 4,472,473 | A | 9/1984 | Davis et al. |
| 4,505,084 | A | 3/1985 | Knudson |
| 4,505,143 | A | 3/1985 | Knudson |
| 4,689,261 | A | 8/1987 | Ahnström |
| 4,759,159 | A | 7/1988 | Blazley |
| 4,962,622 | A | 10/1990 | Albrecht et al. |
| 5,233,799 | A | 8/1993 | Abukawa |

(Continued)

FOREIGN PATENT DOCUMENTS

| | | | |
|---|---|---|---|
| CN | 2152845 | Y | 1/1994 |

(Continued)

OTHER PUBLICATIONS

International Search Report dated Jan. 28, 2010 from corresponding International Application No. PCT/US2009/066339.

(Continued)

*Primary Examiner* — Teresa Ekiert
(74) *Attorney, Agent, or Firm* — Jones Day

(57) ABSTRACT

A building panel formed from sheet material extends in a longitudinal direction along its length and includes a curved center portion in cross section, a pair of side portions extending from the curved center portion, and a pair of connecting portions extending from the side portions. The curved center portion includes a plurality segments extending in the longitudinal direction. The panel is curved in the longitudinal direction without having transverse corrugations. A particular segment may have a depth greater than that of another segment to accommodate the longitudinal curve. A system for longitudinally curving the panel includes first and second curving assemblies, each of which includes multiple rollers arranged to contact the panel as it passes along, a positioning mechanism for changing a relative rotational orientation between the first and second curving assemblies, a drive system for moving the panel longitudinally, and a control system for controlling the positioning mechanism.

43 Claims, 33 Drawing Sheets

(Right Side)

U.S. PATENT DOCUMENTS

| | | | |
|---|---|---|---|
| 5,249,445 | A | 10/1993 | Morello |
| 5,359,871 | A | 11/1994 | Morello |
| 5,375,943 | A | 12/1994 | McCavour et al. |
| 5,584,198 | A | 12/1996 | Morello |
| 5,651,226 | A | 7/1997 | Archibald |
| 5,655,338 | A | 8/1997 | Lucas |
| 6,260,323 | B1 | 7/2001 | Hockey |
| 6,282,936 | B1 | 9/2001 | Blazley |
| 6,419,302 | B2 | 7/2002 | Mikuni |
| 6,543,197 | B2 | 4/2003 | Wetzel, III et al. |
| 6,722,087 | B1 | 4/2004 | Morello |
| 7,310,984 | B2 | 12/2007 | White |
| 2003/0000156 | A1 | 1/2003 | Morello |
| 2006/0080905 | A1 | 4/2006 | Morello |

FOREIGN PATENT DOCUMENTS

| | | | |
|---|---|---|---|
| DE | 1684709 | | 6/1971 |
| GB | 770062 | | 3/1957 |
| HU | 181342 | B | 3/1985 |
| HU | 189778 | B | 7/1988 |
| HU | 190331 | B | 7/1988 |
| HU | 203688 | B | 9/1991 |
| JP | S 63-280148 | | 11/1988 |
| JP | H 06-280352 | | 10/1994 |
| NZ | 338021 | | 3/1998 |
| NZ | 531441 | | 6/2004 |
| WO | WO 98/45064 | | 10/1998 |
| WO | WO 03/018927 | | 3/2003 |

OTHER PUBLICATIONS

Written Opinion of the International Searching Authority dated Nov. 24, 2006 from corresponding International Application No. PCT/US2009/0066339.

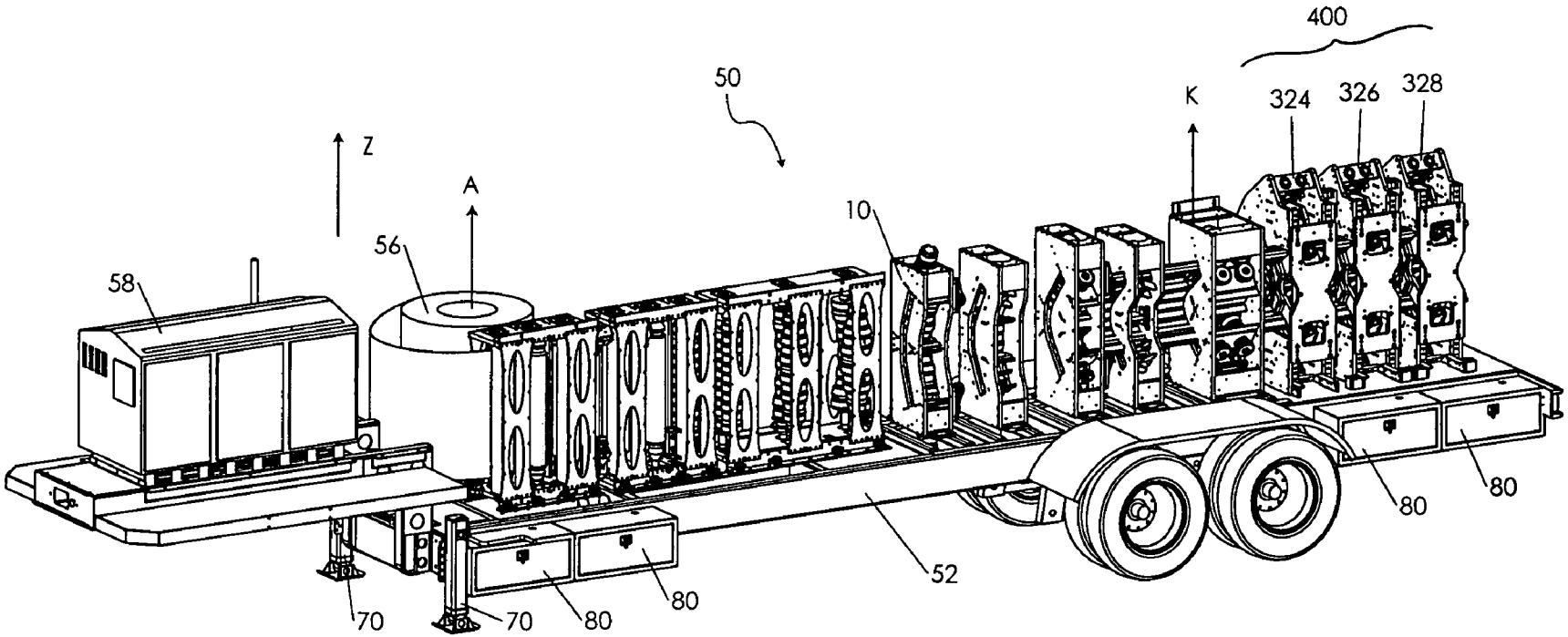
FIG. 8A (Left Side)

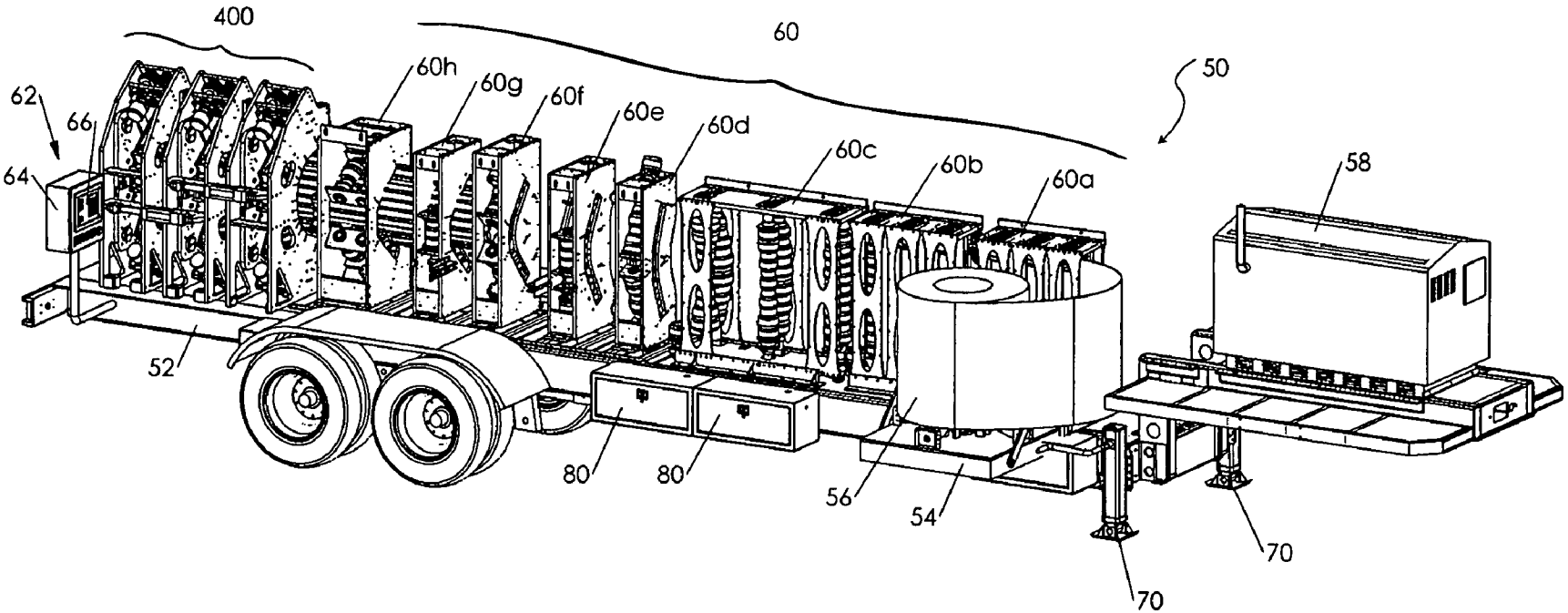
FIG. 8B (Right Side)

FIG. 10 (Side View)

(Top View)

(Top View)

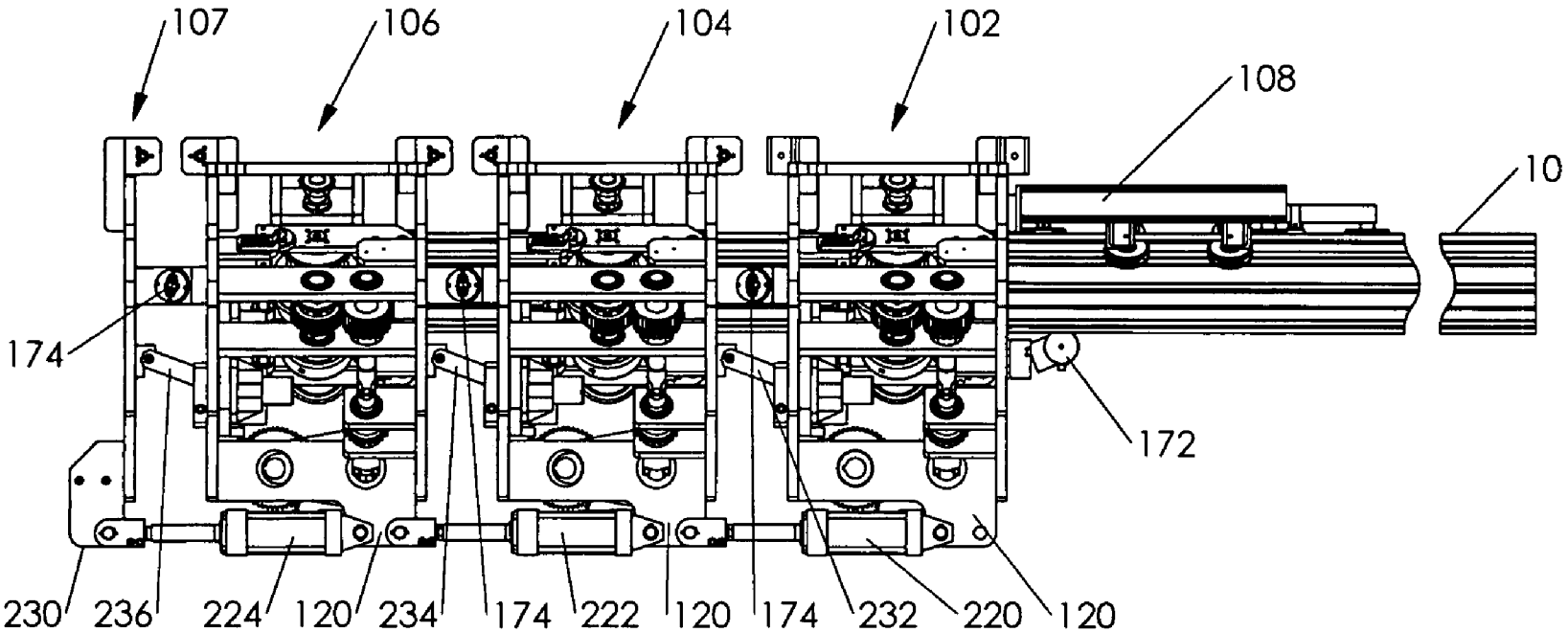
FIG. 16 (Top View)

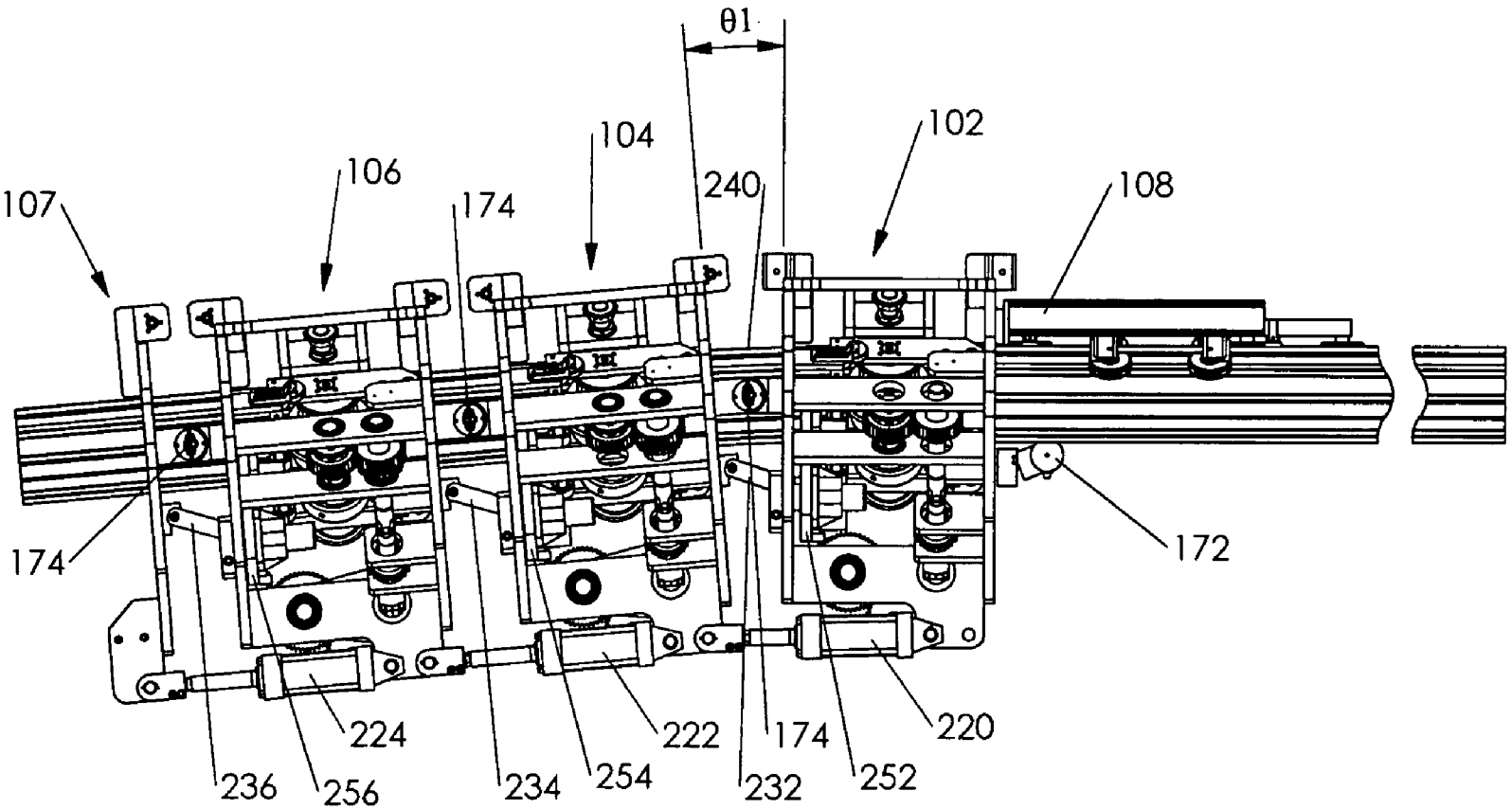
FIG. 17 (Top View)

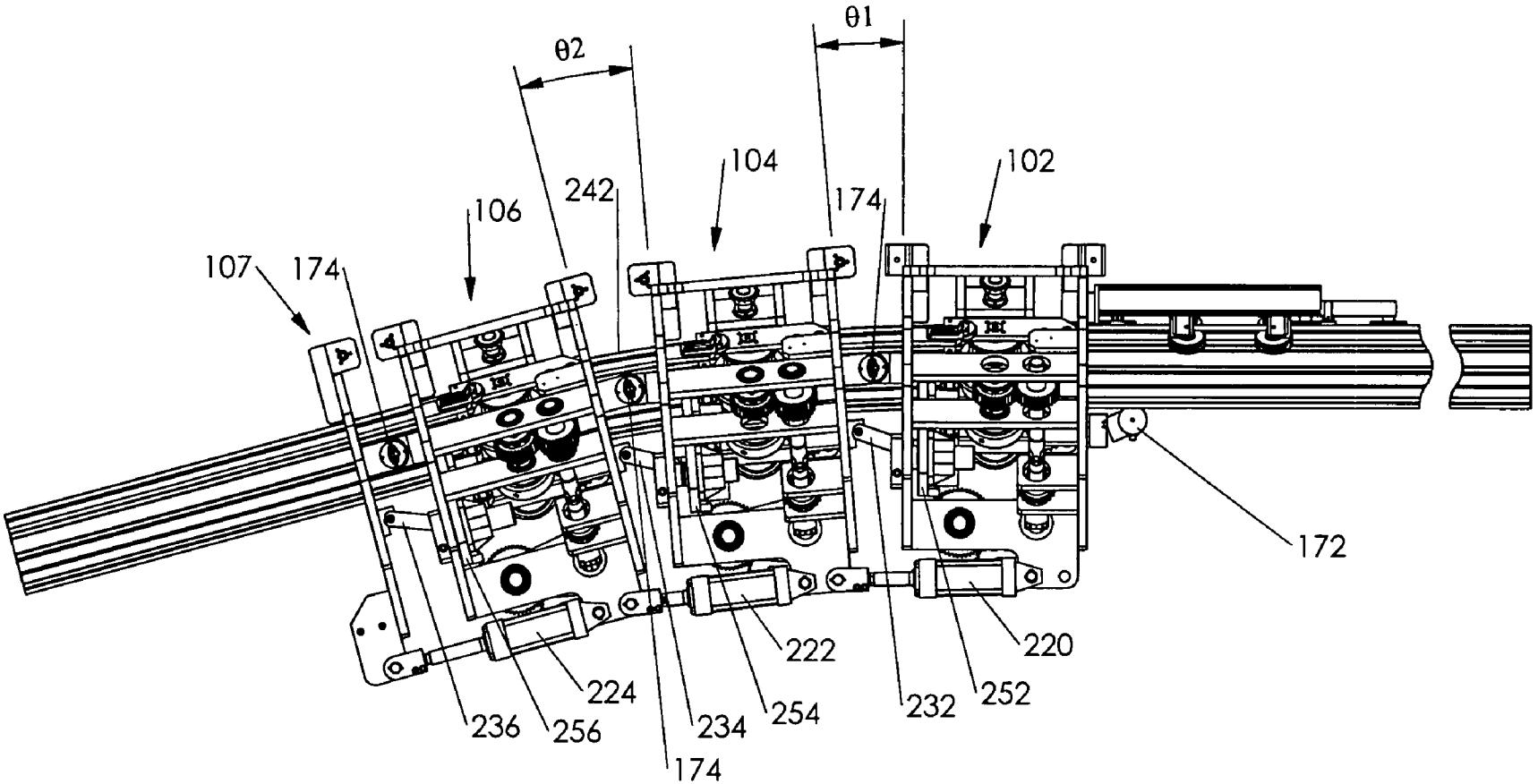
FIG. - 18 (Top View)

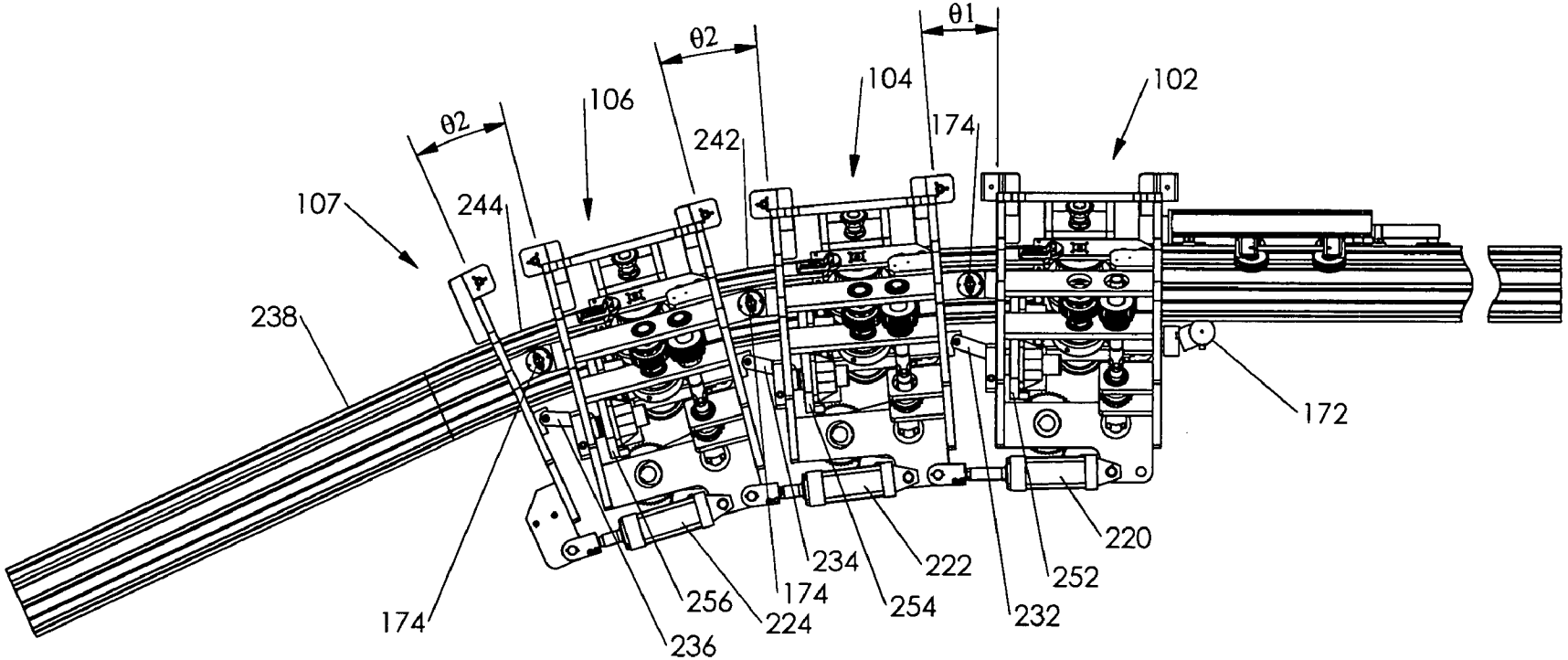
FIG. 19 (Top View)

FIG. 22 (Side View)

FIG. 27 (Top View)

FIG. 28 (Top View)

FIG. 29 (Top View)

CURVED BUILDING PANEL, BUILDING STRUCTURE, PANEL CURVING SYSTEM AND METHODS FOR MAKING CURVED BUILDING PANELS

BACKGROUND

1. Field of the Disclosure

The present disclosure relates to curved building panels made from sheet materials, building structures made using such curved building panels, and a panel curving system for fabricating curved building panels.

2. Background Information

Conventional methods are known in the art for forming non-planar building panels made from sheet material, e.g., galvanized steel sheet metal. Such building panels can be attached side-by-side to form self-supporting building structures by virtue of the strength of the building panels themselves. That is, such building panels can exhibit a moment of inertia suitable to provide enough strength under applied loads (e.g., snow, wind, etc.) so that supporting beams or columns within the building structure are unnecessary.

Such building panels can be conventionally curved in the longitudinal direction (along the length of the panel) by imparting transverse corrugations into the building panel, i.e., wherein the corrugations are oriented substantially in a direction that is transverse to the longitudinal direction. These transverse corrugations cause the length of the corrugated portion of the building panel to shrink in the longitudinal direction along the panel relative to non-corrugated portions of the building panel, thus causing the building panel to form into an arched shape along its length. Such arched building panels can then be attached side-by-side to create a building structure.

The present inventors have observed that forming transverse corrugations in a building panel can significantly weaken a building panel. Additionally, the corrugations can lead to unwanted loss of protective coatings such as paint in corrugated regions of the building panel and can aesthetically detract from a smooth appearance. The present inventors have also observed that attempting to form a longitudinal curve in building panel without imparting transverse corrugations will typically lead to, or require, buckling in some areas of the building panel and that such buckled areas can also significantly reduce the strength of the building panel.

SUMMARY

According to an exemplary aspect, a building panel formed from sheet material is described. The building panel extends in a longitudinal direction along its length and has a shape in cross section in a plane perpendicular to the longitudinal direction, the building panel comprises a curved center portion in cross section, a pair of side portions extending from the curved center portion in cross section, and a pair of connecting portions extending from the side portions in cross section. The curved center portion includes a plurality segments comprising multiple outwardly extending segments and multiple inwardly extending segments in cross section, the plurality of segments extending in the longitudinal direction. The building panel being curved in the longitudinal direction along its length without having transverse corrugations therein, and a particular segment of the plurality of segments has a depth greater than that of another segment to accommodate the longitudinal curve in the building panel.

According to another exemplary aspect, a building structure comprising a plurality of such building panels connected together is described, wherein the one of the connecting portions of one building panel is connected to one of the connecting portions of an adjacent building panel to form the building structure.

According to another exemplary aspect, a machine for curving such a building panel is described. The building panel is made from sheet material, extends in a longitudinal direction along its length and has a shape in cross section in a plane perpendicular to the longitudinal direction. The building panel includes a curved center portion in cross section, a pair of side portions extending from the curved center portion in cross section, and a pair of connecting portions extending from the side portions in cross section, the curved center portion including a plurality segments comprising multiple outwardly extending segments and multiple inwardly extending segments in cross section, the plurality of segments extending in the longitudinal direction. The system comprises a first curving assembly and a second curving assembly, the second curving assembly positioned adjacent to the first curving assembly. The first curving assembly includes a first frame and multiple first rollers supported by the first frame, the multiple first rollers arranged at first predetermined locations to contact the building panel as the building panel passes along the multiple first rollers in the longitudinal direction. The second curving assembly includes a second frame and multiple second rollers supported by the second frame, the multiple second rollers arranged at second predetermined locations to contact the building panel as the building panel passes along the multiple second rollers in the longitudinal direction. The system includes a positioning mechanism that permits changing a relative rotational orientation between the first curving assembly and the second curving assembly, a drive system for moving the building panel longitudinally along the multiple first rollers and the multiple second rollers, and a control system for controlling the positioning mechanism so as to control the relative rotational orientation between the first curving assembly and the second curving assembly as the building panel moves longitudinally along the multiple first rollers and the multiple second rollers to thereby form a longitudinal curve in the building panel. The system being configured to form the longitudinal curve in the building panel without imparting transverse corrugations into the building panel. The multiple first rollers and multiple second rollers being arranged so as to cause an increase in a depth of a particular segment of the plurality of segments of the building panel to accommodate the formation of the longitudinal curve in the building panel.

According to another aspect, a method of curving a building panel using a panel curving system is described. The building panel is made from sheet material and extends in a longitudinal direction along its length and having a shape in cross section in a plane perpendicular to the longitudinal direction. The building panel includes a curved center portion in cross section, a pair of side portions extending from the curved center portion in cross section, and a pair of connecting portions extending from the side portions in cross section, the curved center portion including a plurality segments comprising multiple outwardly extending segments and multiple inwardly extending segments in cross section, the plurality of segments extending in the longitudinal direction, the panel curving system comprising a first curving assembly and a second curving assembly. The method comprising receiving the building panel at the first curving assembly and engaging the building panel with multiple first rollers of the first curving assembly, translating the building panel toward the second curving assembly and engaging a first portion of the building panel with multiple second rollers of the second curving assembly while a second portion of the building panel is engaged with the first curving assembly, and controlling a positioning mechanism with a control system so as to cause the first curving assembly and the second curving assembly to be in a rotated orientation relative to each other while the building panel moves longitudinally along the first curving assembly and the second curving assembly to thereby form a longitudinal curve in the building panel without imparting transverse corrugations into the building panel, wherein the multiple first rollers and multiple second rollers are arranged so as to cause an increase in a depth of a particular segment of the plurality of segments of the building panel to accommodate the formation of the longitudinal curve in the building panel.

According to another exemplary aspect, a system for curving a building panel made of sheet material is described. The system comprises a support structure, a coil holder supported by the support structure for holding a coil of sheet material, a panel forming apparatus supported by the support structure and positioned proximate the coil holder, the panel forming apparatus configured to form a longitudinally straight building from the sheet material so as to have a desired cross sectional shape, and a panel curving apparatus supported by the support structure and positioned proximate the panel forming apparatus to receive the straight building panel from the panel forming apparatus, the panel curving apparatus configured to impart a longitudinal curve to the building panel along the length of the building panel, wherein the coil holder is oriented vertically such that a rotation axis of the coil holder is parallel to a vertical direction, wherein the panel forming apparatus is oriented vertically so as to receive sheet material oriented in a vertical plane directly from the coil of sheet material, and wherein the panel curving apparatus is oriented vertically so as to receive the straight building panel directly from the panel forming apparatus.

BRIEF DESCRIPTION OF THE DRAWINGS

These and other features, aspects, and advantages of the present disclosure will become better understood with regard to the following description, appended claims, and accompanying drawings.

FIG. 8A illustrates a left side view of an exemplary panel curving system according to an exemplary aspect.

FIG. 8B illustrates a right side view of the exemplary panel curving system illustrated in FIG. 8A.

FIG. 16 illustrates a top view of the exemplary panel curving machine of FIG. 9 with a longitudinally straight panel inserted therein according to an exemplary aspect.

FIG. 17 illustrates another top view of the exemplary panel curving machine of FIG. 9 with the building panel inserted and with relative rotation between first and second panel curving assemblies to promote longitudinal curving of the building panel.

FIG. 18 illustrates another top view of the exemplary panel curving machine of FIG. 9 with the building panel inserted and relative rotation between second and third panel curving assemblies.

FIG. 19 is another top view of the exemplary panel curving machine of FIG. 9 with the building panel inserted and relative rotation between third and fourth curving assemblies.

DETAILED DESCRIPTION OF EXEMPLARY EMBODIMENTS

Figure 1:
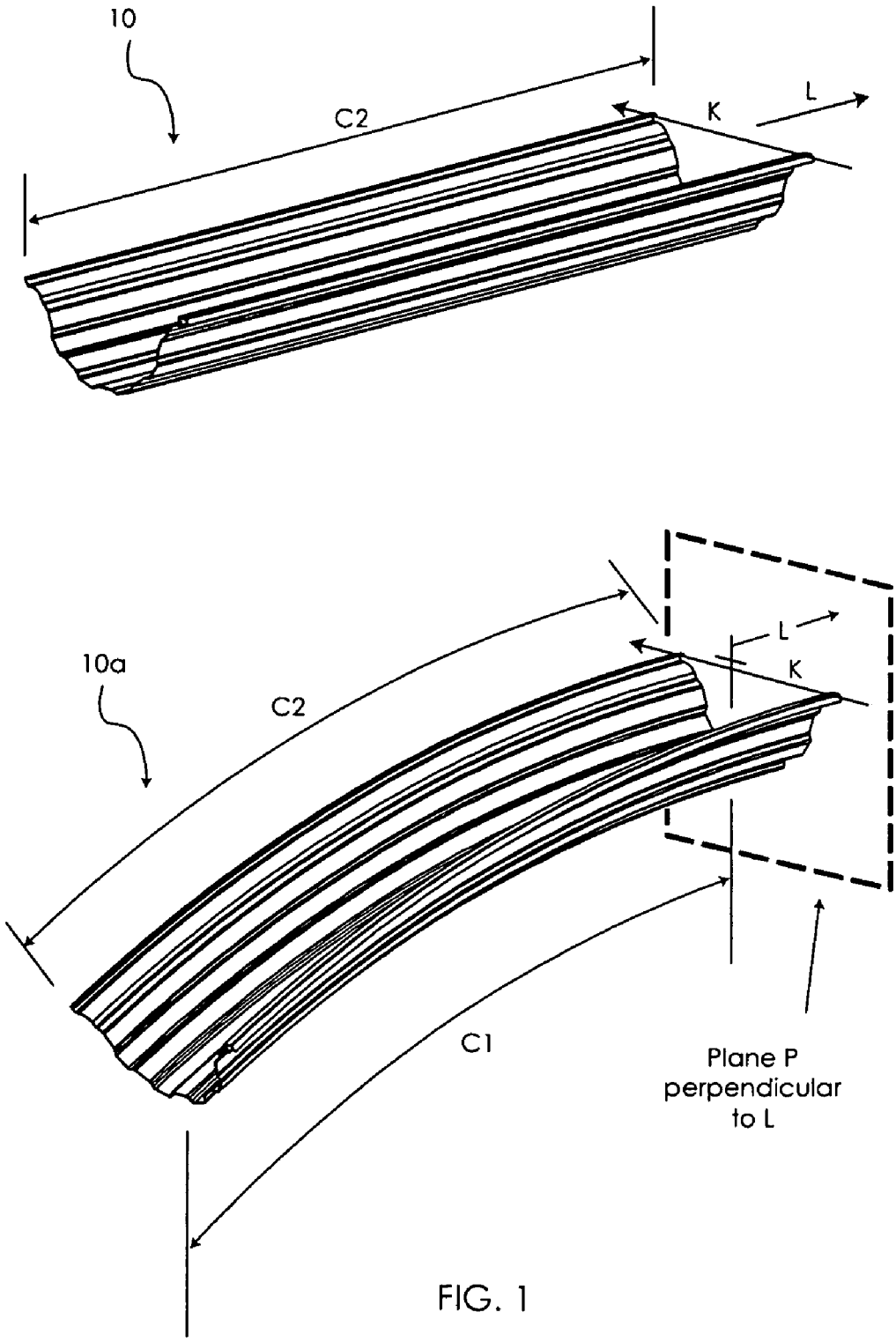
FIG. 1 illustrates an exemplary building panel with a curved center portion having a plurality of segments before and after receiving a longitudinal curve along its length according to an exemplary aspect.

An exemplary building panel as described herein having a longitudinal curve along its length can be fabricated by curving a building panel that is initially straight, i.e., which does not have a longitudinal curve along its length. FIG. 1 illustrates an exemplary straight building panel 10 that that can be curved along a longitudinal direction L to form an exemplary curved building panel 10*a* according to one aspect of the disclosure. As described herein, the longitudinally curved building panel 10*a* can be formed by a process that includes both applying a torque to the building panel and forcibly deforming longitudinally extending segments to change the cross sectional shape of the building panel. The process may be referred to as an "active" approach herein for convenience insofar as it includes forcibly deforming longitudinally extending segments with appropriate rollers. The building panel 10 is formed from sheet material, such as, for example, structural steel sheet metal ranging from about 0.035 inches to about 0.080 inches in thickness. The building panel 10 can be formed from other sheet materials as well, such as other types of steel, galvalume, zincalume, aluminum, or other building material that is suitable for construction. The thickness of the building panel 10 may generally range from about 0.035 inches to about 0.080 inches (±10%), depending upon the type of sheet material used. Of course, the building panel 10 may be formed using other thicknesses and using other sheet building materials and as long as the sheet materials possess suitable engineering properties of strength, toughness, workability, etc.

The building panels 10 and 10*a* extend in a longitudinal direction along their lengths. For straight building panel 10, the longitudinal direction L is parallel to the length of the building panel. The building panel 10*a* is curved along its length, and the longitudinal direction in that case is tangential to the lengthwise curve of the building panel 10*a* at any particular location on the building panel 10*a*. The building panel 10*a* is curved the in the longitudinal direction without having transverse corrugations therein.

The straight building panel 10 and the curved building panel 10*a* have a curved shape in cross section in a plane perpendicular to the longitudinal direction L. An exemplary plane P and longitudinal direction L at one end of the building panel 10*a* are illustrated in FIG. 1. In the illustration of FIG. 1, the straight building panel 10 has a linear length C2. The longitudinally curved building panel 10*a* derived from panel 10, however, has shorter linear length C1 a lower portion thereof compared to a linear length C2 at an upper portion thereof because the bottom portion at C1 is effectively shortened due to the longitudinal curving. In other words, the linear length of the building panel 10 is not shortened in the longitudinal direction at the regions of the connecting portions 32 and 34. The terminology upper and lower are used simply for convenience in connection with the orientations illustrated in FIG. 1 and are not intended to be limiting in any way.

Figure 2:
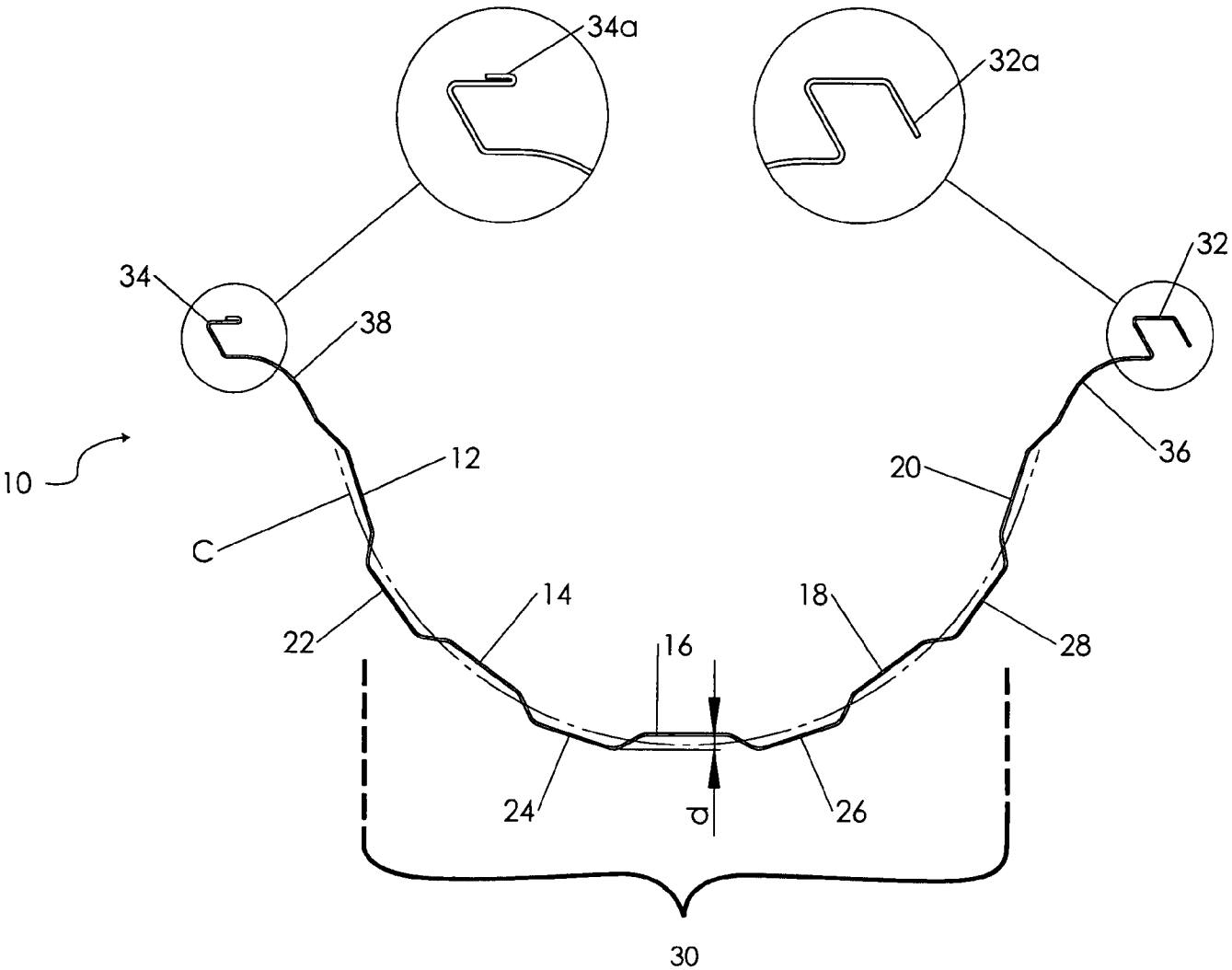
FIG. 2 illustrates an exemplary cross sectional shape of a building panel that is straight along its length prior to being curved longitudinally according to an exemplary aspect.

FIG. 2 shows an exemplary cross sectional shape of the straight building panel 10 prior to longitudinal curving. As illustrated in FIG. 2, the building panel 10 includes a curved center portion 30, a pair of side portions 36 and 38 extending from the curved center portion 30 in cross section, and a pair of connecting portions 32 and 34 extending from the side portions 36 and 38, respectively, in cross section. The overall outline of the curved center portion 30 is illustrated by the curved dotted line C. Connecting portion 32 may include a hook portion 32*a* as illustrated in FIG. 2, but in general any suitable configuration may be used for the connecting portion 32. Similarly, connecting portion 34 may include a hem portion 34*a*, the hook portion 32*a* and the hem portion 34*a* being complementary in shape for joining the building panel to adjacent building panels. However, any suitable complementary shape may be used for the connecting portion 34 that permits connecting portion 34 to be joined to connecting portion 32.

As shown in FIG. 2, the building panel 10 also includes a plurality of segments 12, 14, 16, 18, 20, 22, 24, 26 and 28. These segments extend in the longitudinal direction L along the length of the building panel 10. These segments may also be referred to as longitudinal deformations, longitudinal ribs, stiffening ribs, and the like, and serve to strengthen the building panel 10 against buckling and bending under loads. In this example, segments 22, 24, 26 and 28 extend outwardly in cross section, and segments 12, 14, 16, 18 and 20 extend inwardly in cross section. For reference purposes, "inward" as used herein means closer to a geometric center of the cross section of a building panel, and "outward" means farther from the geometric center of the cross section of a building panel. As shown in FIG. 2, adjacent segments extend in opposing directions (e.g., segment 12 extends inwardly whereas adjacent segment 22 extends outwardly). In the example of FIG. 2, the depth of a given segment relative to the adjacent segments is a depth d. The depths of the segments of the straight building panel may all be the same, as illustrated in the example of FIG. 2, or the depths of the segments may differ from one another.

The exemplary straight building panel 10 illustrated in FIG. 2 includes five inwardly extending segments (12, 14, 16, 18, 20) and four outwardly segments (22, 24, 26, 28), but other numbers of outwardly extending segments and inwardly extending segments may be used. For example, the number of outwardly extending segments could be greater or less than the number of inwardly extending segments. Various sizes and number combinations of segments may be used depending upon the cross sectional shape desired in the building panel.

Figure 3:
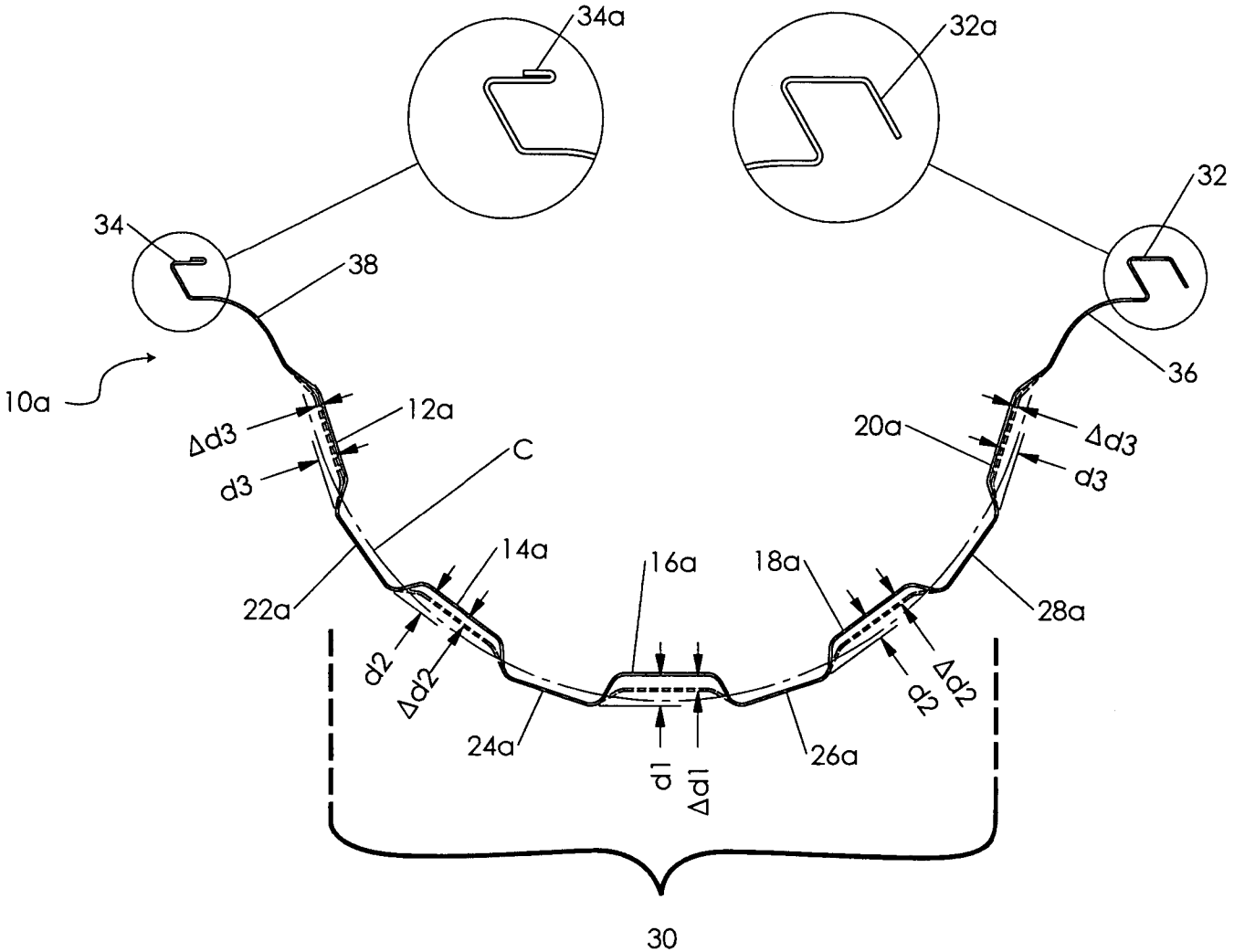
FIG. 3 illustrates an exemplary cross sectional shape of an exemplary building panel having a longitudinal curve along its length according to an exemplary aspect.

FIG. 3 shows the cross sectional shape of the building panel 10*a* in cross section, e.g., at plane P shown in FIG. 1, following a longitudinal curving process (described elsewhere herein). The cross sectional shape of the straight building panel 10, i.e. before the longitudinal curving process, is shown in FIG. 3 as a dashed profile for illustrative purposes. As illustrated in FIG. 3, the building panel 10*a* includes a curved center portion 30, a pair of side portions 36 and 38 extending from the curved center portion 30 in cross section, and a pair of connecting portions 32 and 34 extending from the side portions 36 and 38, respectively, in cross section, similar to that of straight building panel 10. The overall outline of the curved center portion 30 is illustrated by the curved dotted line C. The curved center portion may have a semicircular shape or other arcuate shape. As a result of the curving process, however, the cross-sectional profile of the segments undergoes changes. The longitudinally curved building panel 10*a* includes inwardly extending segments 12*a*, 14*a*, 16*a*, 18*a*, and 20*a*, and outwardly extending segments 22*a*, 24*a*, 26*a* and 28*a*. As illustrated in FIG. 3, due to longitudinal curving, a particular segment of the longitudinally curved building panel 10*a* will have undergone a change in depth greater than that of another segment. In the example of FIG. 3, for example, the depth of segment 16*a* changes inwardly in cross section by an amount Δd1, and the depth of neighboring segment 14*a* inwardly by an amount Δd2, wherein Δd1 is greater than Δd2. Similarly, the depth of segment 12*a* changes inwardly by an amount Δd3, where Δd2 is smaller than Δd3. Segment 16*a* is positioned at a middle of the curved center portion 30 and has the greatest change in depth of any of the segments illustrated in the example of FIG. 3.

In this example, since the straight building panel 10 possessed segments of uniform depth d as shown in FIG. 2, various segments of curved building panel 10*a* will have different overall depths after longitudinal curving. Based on the changes in depths of the various segments described above, segment 16*a* will have a greater depth from its outermost edges relative to the depths of other segments. In particular, as shown in the example of FIG. 3, the depth of segment 16*a* extends a distance d1 inwardly in cross section from its outermost edges, and neighboring segment 14*a* extends a distance d2 inwardly from its outermost edges, wherein distance d1 is greater than distance d2. Similarly, segment 12*a* extends a distance d3 inwardly from its outermost edges, and the distance d2 is greater than distance d3. Segment 16*a*, which is positioned at a middle of the curved center portion 30, has the greatest depth d1 of the segments illustrated in the example of FIG. 3. In view of the explanation above, it will be appreciated that to achieve a longitudinally curved building panel segments all having approximately the same depth according to the present disclosure, a straight building panel having non-uniform segment depths to start with would be needed (e.g., a straight building panel with shallower segments near the middle thereof and deeper segments near the edges thereof would be needed). The identification of appropriate starting segment depths of such a straight building panel is within the purview of one of ordinary skill in the art, e.g., by limited trial-and-error testing, in view of the information provided herein.

As discussed in more detail elsewhere herein, as the straight building panel 10 illustrated in cross section in FIG. 2 is curved longitudinally into building panel 10*a* illustrated in cross section in FIG. 3, the depths of various segments change to accommodate the formation of the longitudinal curve. The greater change in depth Δd1 relative to the change in depth Δd2 accommodates the formation of the longitudinal curve in the building panel 10*a* by permitting the accumulation of sheet material into segment 16*a* in connection with a lengthwise shortening of the building panel 10*a* at that location during longitudinal curving compared to other locations on the building panel 10*a* that exhibit less lengthwise shortening. Similarly, the greater change in depth Δd2 relative to the change in depth Δd3 also accommodates the formation of the longitudinal curve in the building panel 10*a* by permitting the accumulation of sheet material into segment 14*a* in connection with a lengthwise shortening of the building panel 10*a* at that location during longitudinal curving compared to other locations on the building panel 10*a* that exhibit less lengthwise shortening. The lengthwise shortening of the building panel 10*a* near segment 16*a* is illustrated by the relatively shorter length C1 of the building panel 10*a* at that (lower) location as compared to the longer length C2 of the building panel at the (upper) regions of the connecting portions 32 and 34, as shown in FIG. 1. As noted above, the difference between linear lengths C1 and C2 occurs because the longitudinally curved building panel 10*a* is derived from a straight building panel 10 having a similar cross sectional shape and a uniform length. In the longitudinal curving process described herein, the depths of various segments change to accommodate the longitudinal curve in the building panel 10*a* without the need to impart transverse corrugations into the building panel 10*a*. Greater degrees of longitudinal curving, corresponding to smaller radii of curvature, are accompanied by greater changes in the depths of segments. Segments located at areas of relatively greater linear shorting of the panel due to the longitudinal curving exhibit relatively greater changes in depth.

The present inventors have produced longitudinally curved building panels such as illustrated in FIGS. 1 and 3 using steel sheet metal of approximately 0.060 inches in thickness (±10%) to have a radius of curvature as small as 25 feet or as large as infinity (i.e., a longitudinally straight panel). It is believed that longitudinally curved building panels can be produced as described herein with radii of curvature as small as 20 feet and perhaps somewhat smaller from steel sheet metal having a thickness in the range of about 0.035 to about 0.080 inches.

Longitudinally curved building panels of the type illustrated in FIGS. 1 and 2 that do not possess transverse corrugations may have various advantages over longitudinally curved building panels that include transverse corrugations. First, a building panel according to the present disclosure can be significantly stronger than a building panel with transverse corrugations since corrugations can weaken such building panels. In fact, experimental tests carried out by the present inventors have shown that a building panel such as illustrated in FIGS. 1 and 2 made 0.060 inch thick steel sheet and having a radius of curvature of 25 ft had an increase in strength in excess of 200% compared to a conventional building panel with transverse corrugations having the same radius and made from the same steel thickness. The increase in strength permits buildings with significantly larger unsupported span widths to be manufactured. For example, based on the observed strength enhancements, using steel sheet metal of approximately 0.060 inches in thickness, it is believed that a building structure comprising a self-supporting span having a width ranging from 110 feet to 155 feet can be manufactured, whereas conventional building structures manufactured from longitudinally curved building panels having transverse corrugations using steel sheet metal of the same thickness would be limited to a self-supporting maximum span having a width of 100 feet. Of course, other thicknesses of steel sheet metal could be used, possibly resulting in even larger self-supporting spans, and the example above is presented merely for comparison purposes. In addition, the absence of transverse corrugations in building panels according to the present disclosure avoids the cracking of coatings such as paint, which typically occurs in building panels with transverse corrugations. Building panels according to the present disclosure also have a much more streamlined and aesthetically pleasing appearance compared to building panels with transverse corrugations.

Figure 4:
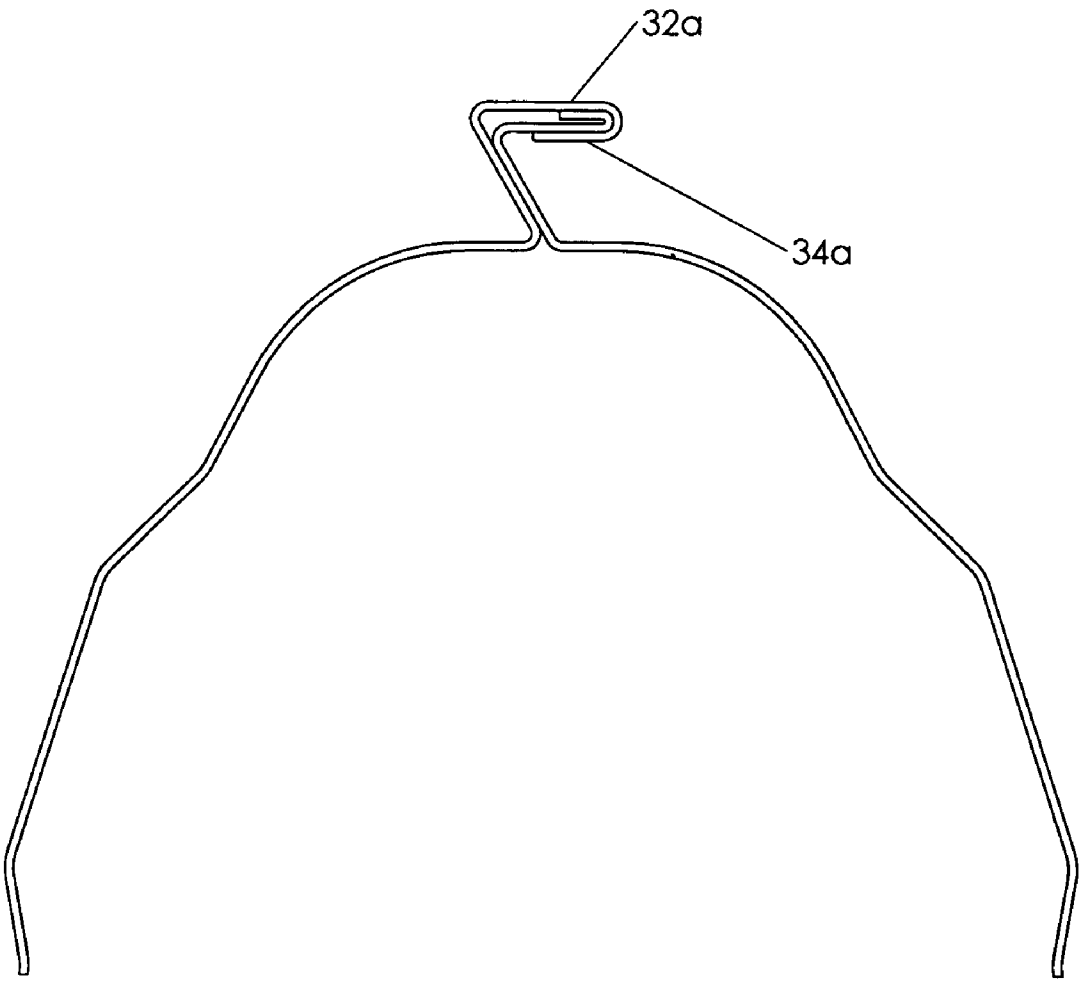
FIG. 4 illustrates an exemplary connection between two exemplary building panels for forming a building structure according to an exemplary aspect.

Building panels such as illustrated in FIGS. 1 and 2 and as described herein may be used to construct exemplary building structure of various shapes by connecting a connection portion 32 of one building panel 10 to a connecting portion 34 of an adjacent building panel 10. FIG. 4 shows an exemplary junction of two building panels 10 joined at the hook portion 32*a* and the hem portion 34*a*. As is known to those of skill in the art, such junctions can be securely formed by continuous seaming using seaming devices known in the art. In the example of FIG. 4, the hook 32*a* is crimped over the hem 34*a* to provide a secure seam. Other configurations may be used to join the panels such as different types of seams, joints, fasteners, or snap-together joints, any of which may be used with the building panels according the present disclosure.

Figure 5:
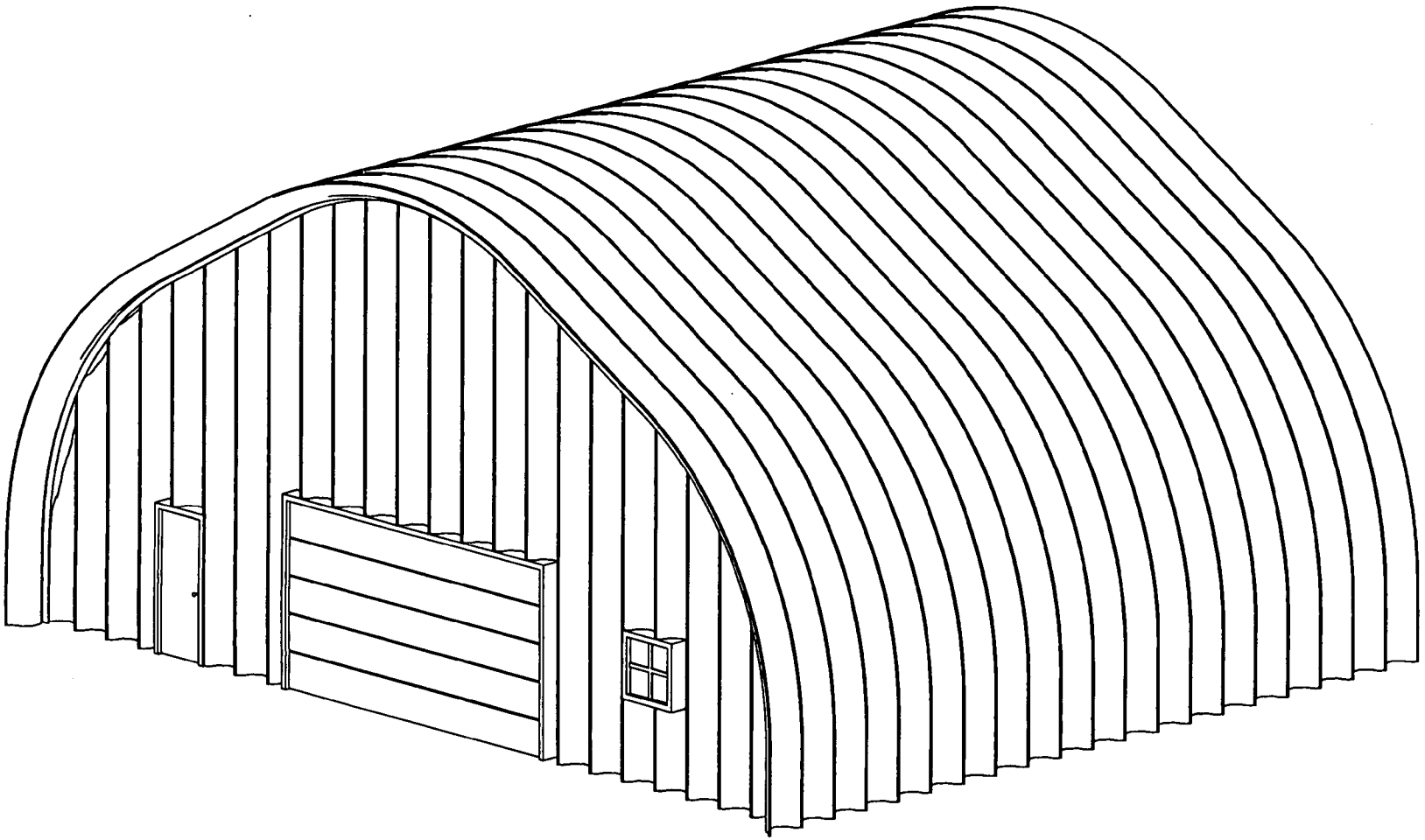
FIG. 5 illustrates an exemplary gable style building that can be formed using building panels described herein according to an exemplary aspect.
Figure 6:
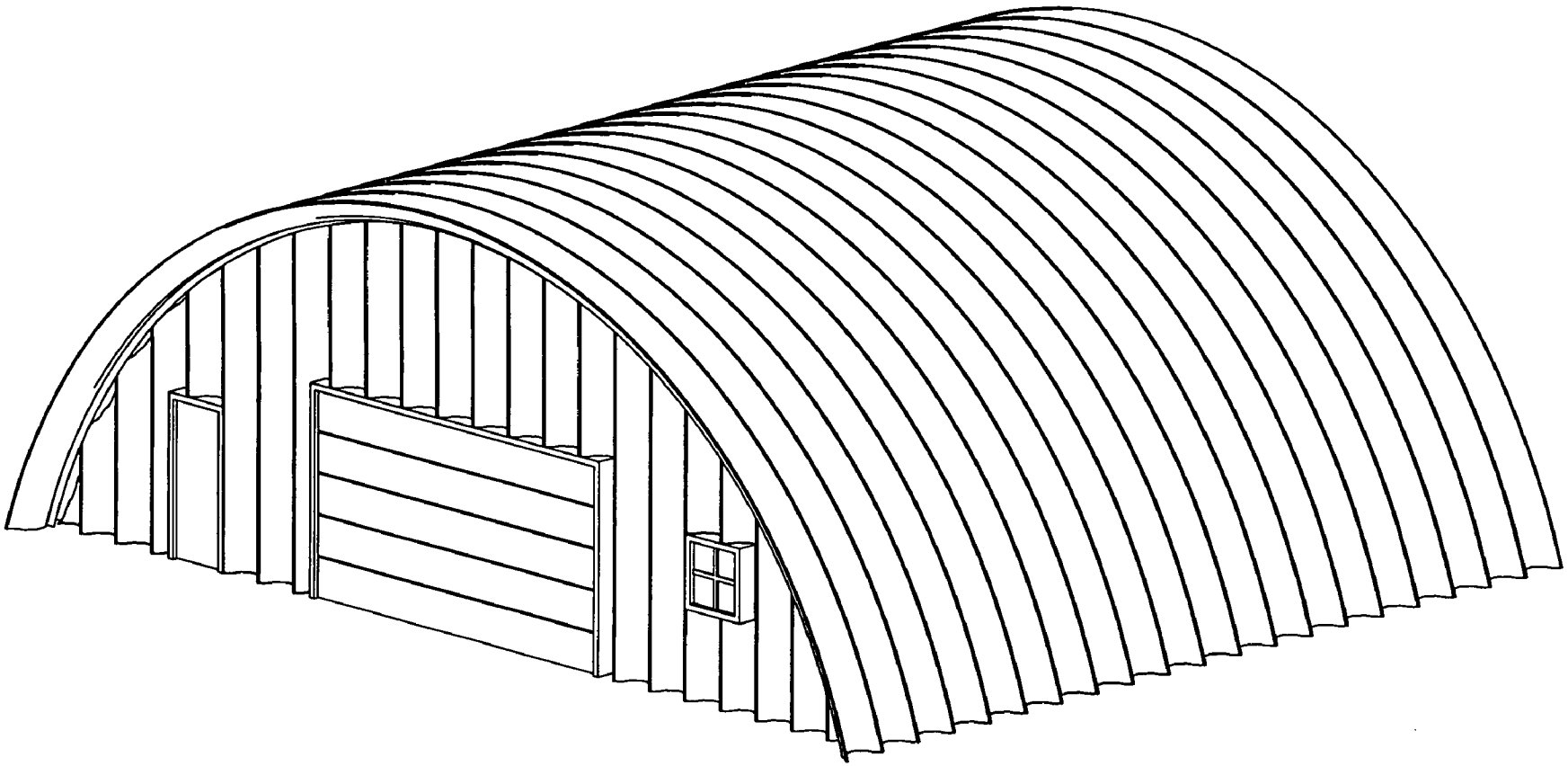
FIG. 6 illustrates an exemplary circular (or arch) style building that can be formed using building panels described herein according to an exemplary aspect.
Figure 7:
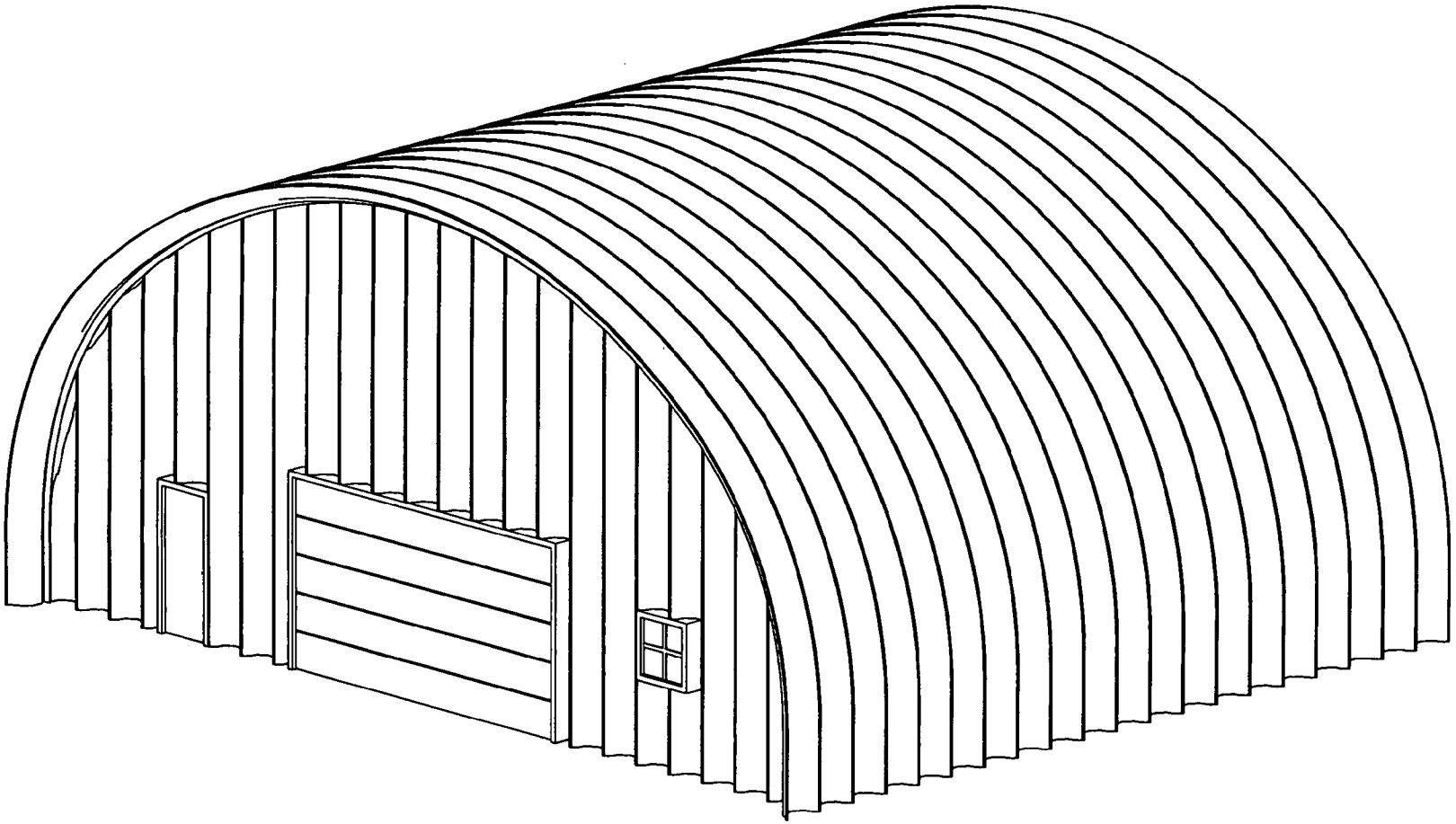
FIG. 7 illustrates an exemplary double-radius (or two-radius) style building that can be formed using building panels described herein according to an exemplary aspect.

FIGS. 5-7 illustrate exemplary shapes of buildings that can be manufactured using building panels as described herein, examples of which are illustrated in FIGS. 1 and 2. These exemplary building shapes include gable style buildings, an example of which is shown in FIG. 5, circular style buildings, an example of which is shown in FIG. 6, and double-radius (or two-radius) style buildings, an example of which is shown in the example of FIG. 7. In the exemplary buildings illustrated in FIGS. 5-7, longitudinally curved building panels are used to form the roof sections, and straight panels are used to construct the flat end wall sections. Other shapes can also be fabricated, such as "lean to" buildings which are taller at one side than another side, and other variations using combinations of building panels having longitudinally curved portions of various radii and building panels having straight portions.

An exemplary panel curving system for manufacturing building panels of the types described herein will now be described, wherein the panel curving system curves a building panel to have a longitudinal curve without imparting transverse corrugations thereto.

An exemplary panel forming and curving system 50 is illustrated in FIGS. 8A and 8B (left side view and right side view, respectively). The system 50 includes a support structure 52, shown in this example as a mobile trailer platform that can be towed behind a truck so that the system 50 can be easily transported to a job site. Supported by the support structure 52 is a coil holder 54 (decoiler) for supporting a coil 56 of sheet material (e.g., steel sheet metal). The coil holder 54 permits the coil 56 to rotate about an axis A parallel to the vertical direction Z such that the sheet material can be fed into the panel forming apparatus 60. The coil holder 54 may include any suitable mechanism (e.g., an idler that pushes against a radial surface of the coil 56) to prevent uncontrolled unraveling of the coil 56. It will be appreciated that the coil holder 54 can be placed in any desired location suitable for feeding sheet material from the coil 56, and its position is not limited to the position illustrated in FIG. 8A and FIG. 8B. A power supply 58, e.g., a diesel engine, is also provided to power the various functions of the system 50. A control system 62 is also provided, such as a microprocessor based controller 64 (e.g., computer such as a personal computer) and a man-machine interface 66, such as a touch-sensitive display screen, for controller the operation of the system 50.

Figure 9:
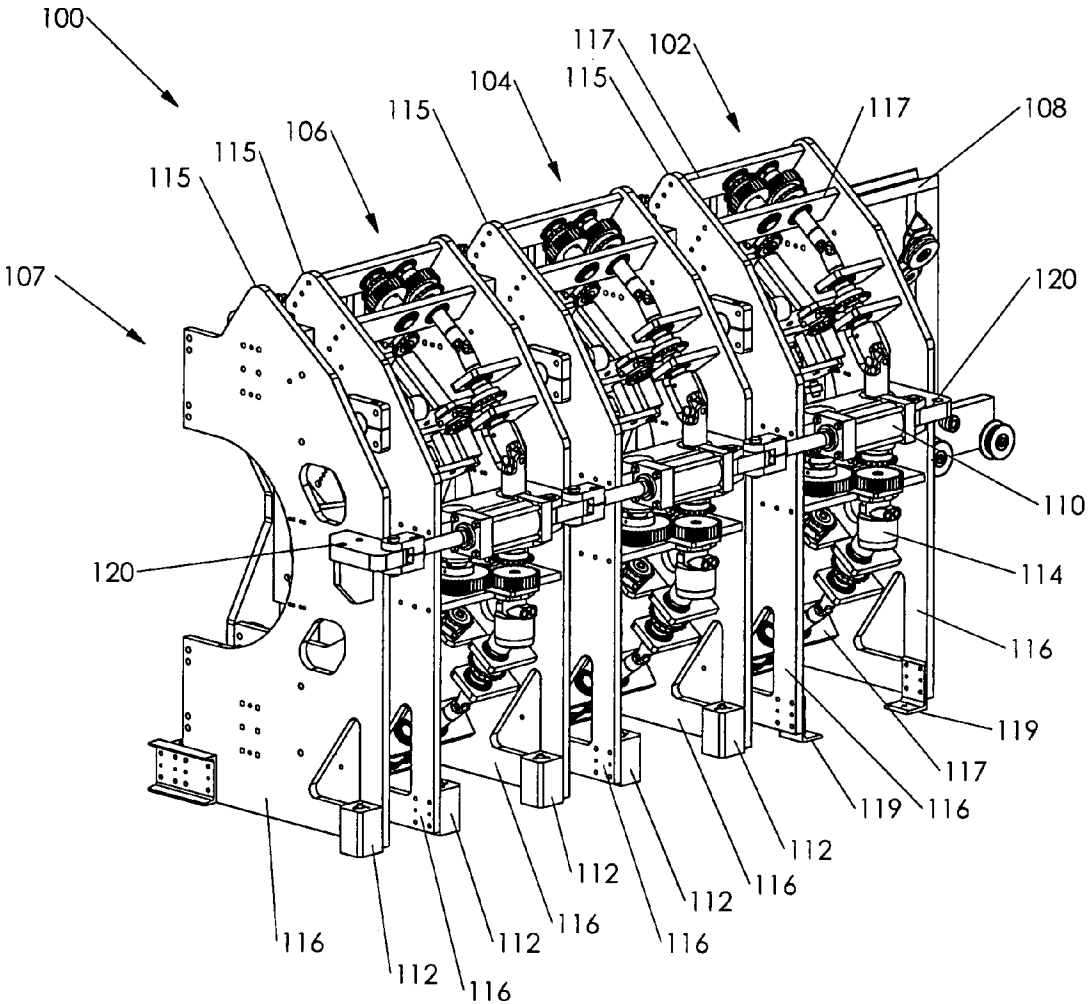
FIG. 9 illustrates an exemplary panel curving apparatus according to an exemplary aspect.

Also supported by the support structure 52 is a panel forming apparatus 60 that includes multiple panel forming assemblies 60*a*-60*h* that are configured to generate a building panel that is straight along its length and that has a desired cross sectional shape. The system 50 also includes a panel curving apparatus 400 that includes multiple curving assemblies 324, 326 and 328 for imparting a longitudinal curve to the building panel. In certain embodiments, panel curving apparatus 100 as shown in FIG. 9 with multiple curving assemblies 102, 104, 106 and fourth assembly 107 could also be used. The system 50 also includes multiple leveling jacks 70 and multiple equipment storage compartments 80.

Figure 8C:
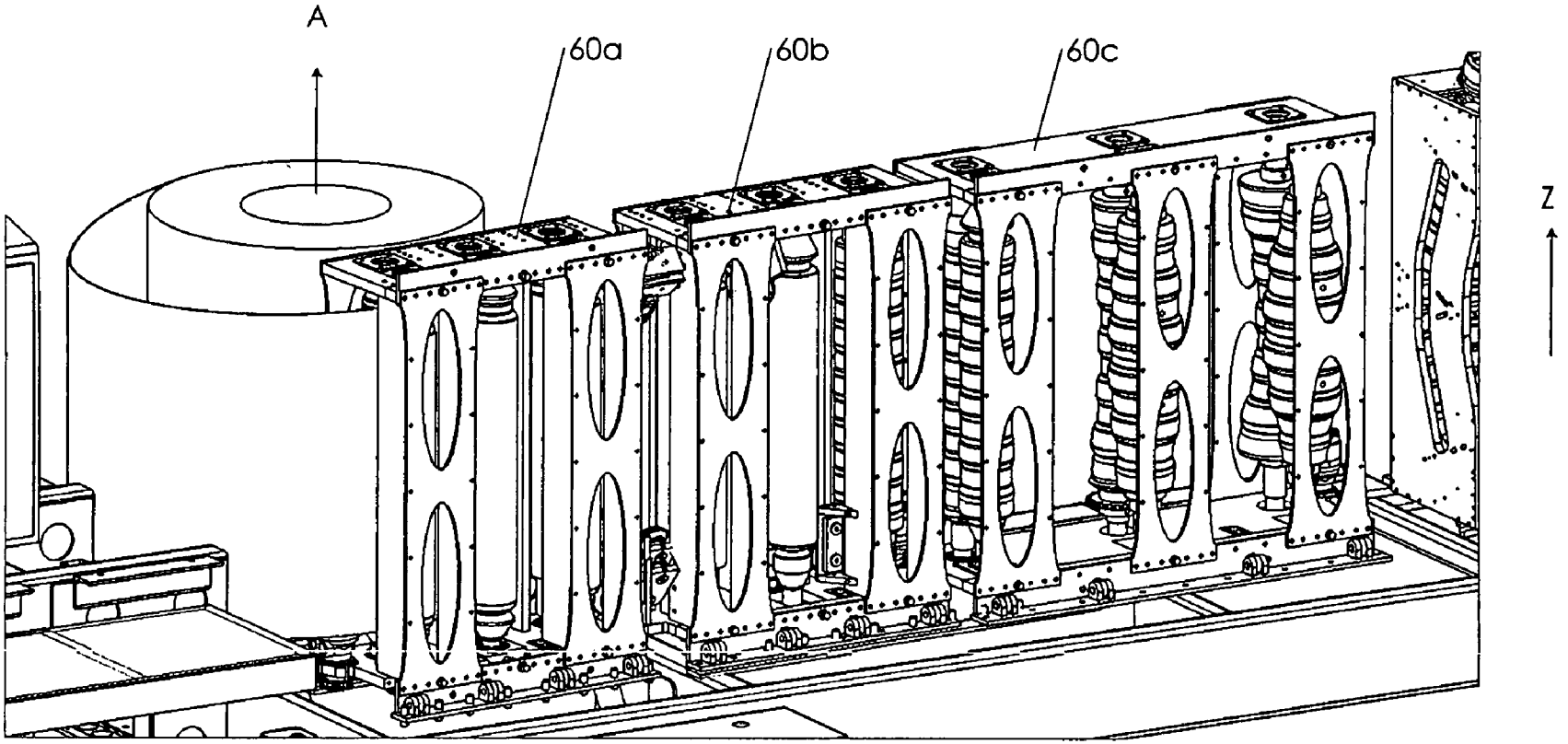
FIG. 8C illustrates a magnified view of a panel forming portion of the exemplary panel curving system of FIG. 8A.
Figure 8D:
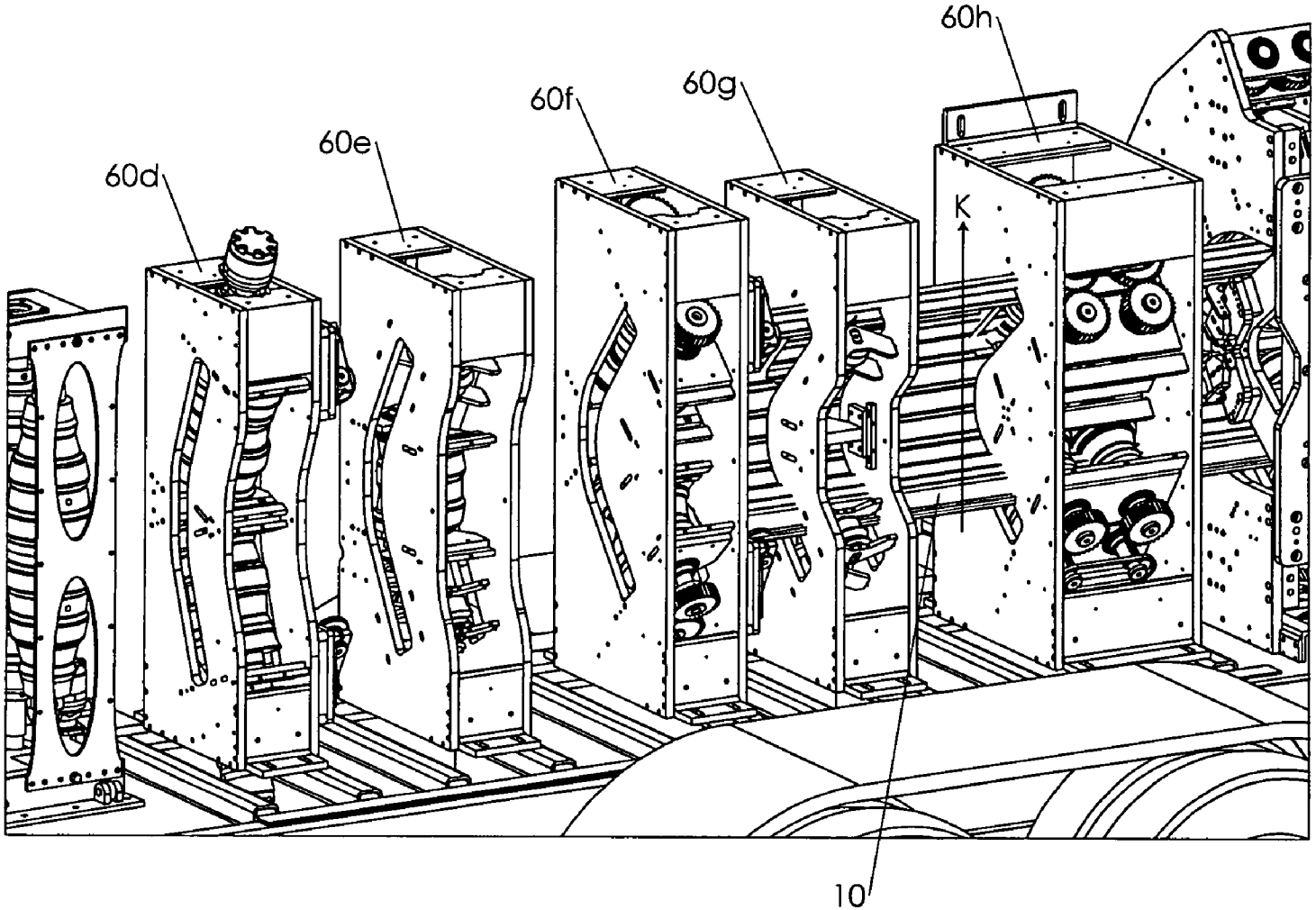
FIG. 8D illustrates a magnified view of another panel forming portion of the exemplary panel curving system of FIG. 8A.

FIGS. 8C and 8D illustrate portions of the panel forming apparatus 60 at greater magnification. Each panel forming assembly 60*a*-60*h* includes a plurality of rollers supported by a respective frame, wherein the rollers of each successive panel forming assembly 60*a*-60*h* are configured to incrementally impart additional shape to the longitudinally straight building panel that is being formed. In particular, for example, the panel forming apparatus 60 comprises rollers configured to generate a straight building panel having a cross sectional shape such as that of building panel 10 illustrated in cross section in FIG. 3. The panel forming assemblies 60*a*-60*h* of panel forming apparatus 60 can be driven by hydraulic motors, for example, powered by power supply 58, and can be controlled with a programmable logic controller using approaches and designs known to those of skill in the art. Approaches for configuring and driving the rollers of a panel forming assembly 60*a*-60*h* to achieve a desired cross sectional shape for a building panel are within the purview of those of ordinary skill in the art.

The panel curving apparatus 400 includes a plurality of curving assemblies 324, 326 and 328. The panel curving assemblies 324, 326 and 328, under the control of a control system (e.g., a manual control system or a microprocessor-based programmable logic controller), are configured to receive the straight building panel 10, such as illustrated, for example, in FIG. 3. The panel curving apparatus 400 then imparts a longitudinal curve to that building panel and outputs a longitudinally curved building panel 10*a*, such as illustrated, for example, in FIGS. 1 and 2.

In the example of FIGS. 8A and 8B, the panel curving apparatus 400 and the panel forming apparatus 60 are configured to be aligned such that a straight building panel 10 being formed by the panel forming apparatus 60 can be fed directly into the panel curving apparatus 400 to impart the longitudinal curve to form building panel 10*a*. A shearing apparatus (not shown) can be placed at the exit of panel curving apparatus 400 to shear the building panel 10*a* at a desired length. Configurations and control of shearing apparatuses are known to those of skill in the art. The panel forming, panel curving, and shearing functions may all be controlled with control system 62.

In the exemplary configuration shown in FIGS. 8A and 8B, the direction K of panels 10 and 10*a* shown in FIG. 1 is aligned with the vertical direction Z illustrated in FIG. 8A. This is also shown in FIGS. 8C and 8D, which illustrate portions of the panel forming apparatus 60 at greater magnification. Thus, in this exemplary configuration, the coil holder 54, the panel forming assemblies 60*a*-60*h*, and the curving assemblies 324, 326 and 328 are all oriented vertically, so that from the time the straight building panel 10 is initially formed by the panel forming apparatus 60 through the time the longitudinally curved building panel 10*a* exits the panel curving apparatus 400, the direction K of the building panels 10 and 10*a* will be aligned with the vertical direction Z. Such a configuration results in a "one step" process insofar as a straight building panel 10 does not have to be removed from a panel forming apparatus located at one location and then transported to a panel curving apparatus at another location for longitudinal curving.

While in the example illustrated in FIGS. 8A and 8B the coil holder 54, the panel forming apparatus 60, and the panel curving apparatus 400 are all illustrated as being oriented vertically, use of a common vertical orientation for these apparatuses is not required. For example, the panel forming apparatus 60 and a suitable coil holder could be oriented horizontally, i.e., at an angle of 90 degrees relative to the orientations shown in FIGS. 8A and 8B. The horizontal coil holder could be located proximate the horizontally oriented panel forming apparatus 60, e.g., co-located on a common support structure (e.g., mobile trailer platform) so that sheet material from the coil is fed into the panel forming apparatus.

Then, in a "two step" process, a longitudinally straight building panel 10 could be generated and removed from the panel forming apparatus 60 in a first step, and then, in a second step, the straight building panel 10 could be transported to and fed into a vertically oriented panel curving apparatus located on a different support structure.

If the panel forming apparatus 60 and the panel curving apparatus 400 are provided on separate support structures, e.g., separate tow-behind trailers or other platforms, a shearing apparatus could be placed at the exit of the panel forming apparatus 60, i.e., adjacent to panel forming assembly 60*h*, to shear the straight building panel 10 exiting therefrom at desired lengths. Individual straight building panels 10 could then be moved (e.g., by hand or with the assistance of a machine such as a crane) and fed to the panel curving apparatus 400 located on a separate platform and powered by a separate power supply, for example.

The inventors have recognized that the convenience of arranging the panel curving apparatus 400, the panel forming apparatus 60 and the coil holder 54 to all be in a vertical orientation such as illustrated in FIGS. 8A and 8B, especially co-located on a common support structure, is not limited to the particular exemplary apparatuses 400, 60 and 54 illustrated in these figures. The inventors have recognized that the synergy of such a "vertical" arrangement can be applied to conventionally known panel forming apparatuses and panel curving apparatuses to produce new and particularly convenient panel curving systems. For example, such a system could utilize a panel crimping machine such as disclosed in US Patent Application Publication No. 2003/0000156 ("Building Panel and Panel Crimping Machine") in place of panel curving apparatus 400 and utilizing a suitable panel forming apparatus in place of panel forming apparatus 60. The selection of suitable panel forming apparatuses, panel curing apparatuses and coil holders for such a combined vertically oriented system is within the purview of one of ordinary skill in the art depending upon the cross-sectional shapes and longitudinal curves of the building panels desired.

Exemplary embodiments of the panel curving apparatus will now be described. The first exemplary embodiment may be thought of as relating to an active deformation approach insofar as certain rollers of the panel curving apparatus are themselves positioned so as to forcefully deform and increase the depths of certain segments of the building panel to facilitate longitudinal curving of the building panel. The second exemplary embodiment may be thought of as relating to a passive deformation approach insofar as certain rollers are positioned with gaps therebetween to accommodate the accumulation of sheet material of the building panel as the longitudinal curve is formed in the building panel.

FIG. 9 illustrates an exemplary panel curving apparatus 100 according to an exemplary embodiment. As shown in FIG. 9, the panel curving apparatus 100 includes a first curving assembly 102 at an entrance side of the machine 100, a second curving assembly 104 positioned adjacent to the first curving assembly 102, and a third curving assembly 106 positioned adjacent to the second curving assembly 104. A fourth assembly 107 for actuating displacement of various rollers and for further guiding the building panel 10*a* is located at an exit side of the machine 100 and positioned adjacent to the third curving assembly 106. Additional curving assemblies could be added to provide even greater control of the curving process with the potential benefit of achieving smaller radii of curvature. An entry guide 108 is positioned at an entrance side of the panel curving apparatus 100 and adjacent to the first curving assembly 102 and guides a straight building panel made of sheet of building material into the panel curving apparatus 100. As noted above, the straight building panel that is being guided into the panel curving apparatus 100 has a shape in cross section in a plane perpendicular to the longitudinal direction that includes a curved center portion 30, a pair of side portions 36 and 38 extending from the curved center portion, and a pair of connecting portions 32 and 34 extending from the side portions, and the panel curving apparatus is configured to accept the building panel having such a cross sectional shape.

As shown in FIG. 9, the curving assemblies 102, 104, 106 and 107 each include a frame 115. The frames 115 of curving assemblies 102, 104 and 106 include a pair of plates 116 and various cross members 117 that join the plates 116 of any given curving assembly 102, 104 and 106 together. The frame 115 of the fourth assembly 107 includes a single plate 116 that supports its various components in this example. The plates 116 and cross members 117 may be made from 0.75 inch thick steel, or other strong material, for example. The plates 116 provide a structure for various components of the assemblies 102, 104, 106 and 107 to be mounted and provide for a rigid frame. For the first curving assembly 102, the frame 115 may be considered a "first" frame, where "first" is used merely as a label for convenience for correspondence to the "first" assembly 102. The exemplary configuration of frame 115 shown in FIG. 9 has been found to be advantageous, but a suitable frame for the panel curving apparatus 100 is not limited to any particular configuration.

Figure 10:
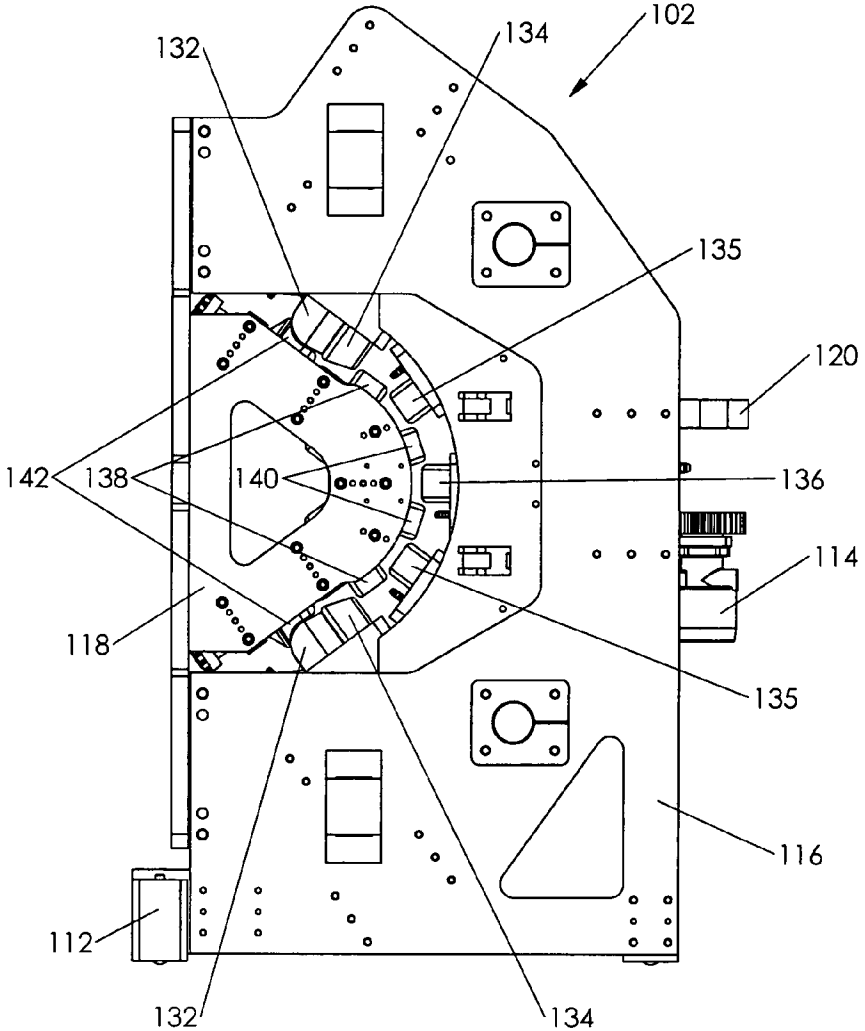
FIG. 10 illustrates an exemplary curving assembly of the panel curving apparatus shown in FIG. 9 according to an exemplary aspect.

As shown in FIG. 10, the first curving assembly 102 also includes multiple rollers 132, 134, 135, 136, 138, 140 and 142 (e.g., multiple "first" rollers using "first" as a label for convenience) supported by the frame 115. Those of skill in the art will appreciate that many variations of hardware and support members may be used to support the multiple rollers 132, 134, 135, 136, 138, 140 and 142, and any suitable combination of support members, shafts, bearings, etc., may be used. FIG. 10 also illustrates an example where rollers 138, 140 and 142 are supported by a support member 118 in the form of a D-ring, which may be made, for example, from 0.75 inch thick steel or other strong material. The multiple rollers 132, 134, 135, 136, 138, 140 and 142 are arranged at predetermined locations (e.g., "first" predetermined locations, using "first" as a convenient label) to contact the building panel as the building panel passes along the multiple rollers 132, 134, 135, 136, 138, 140 and 142 in the longitudinal direction. The second curving assembly 104 and the third curving assembly similarly include frames 115 and multiple rollers supported by the frames, wherein the multiple rollers of the curving assemblies 104 and 106 are arranged at predetermined locations to contact the building panel as the building panel passes along the multiple second rollers in the longitudinal direction. Exemplary relative positions of the multiple rollers 132, 134, 135, 136, 138, 140 and 142 are shown in more detail in FIG. 11, which will be described in greater detail below.

Figure 12:
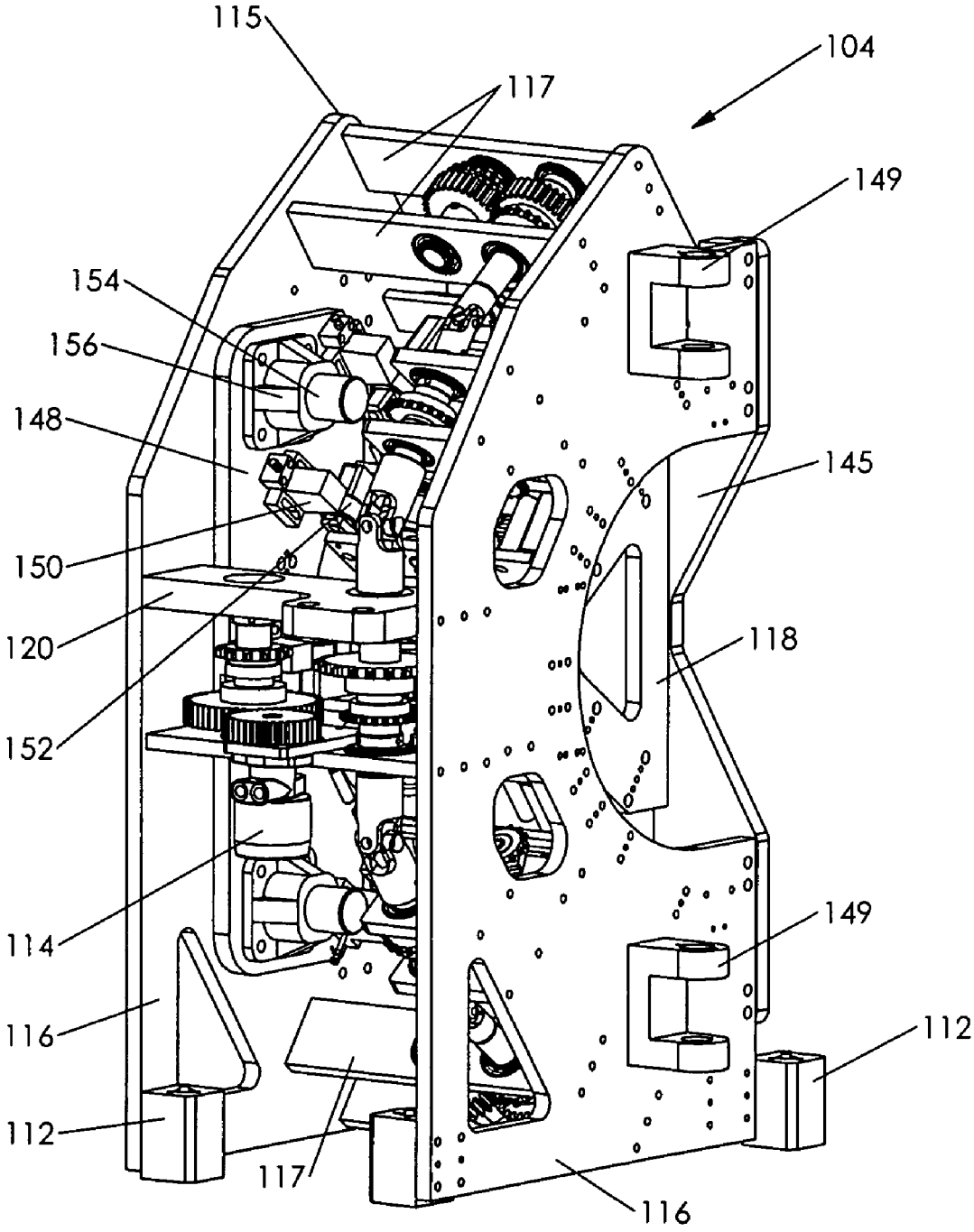
FIG. 12 illustrates a three dimensional isometric view of the exemplary curving assembly of FIG. 10 from a right rear perspective.
Figure 13:
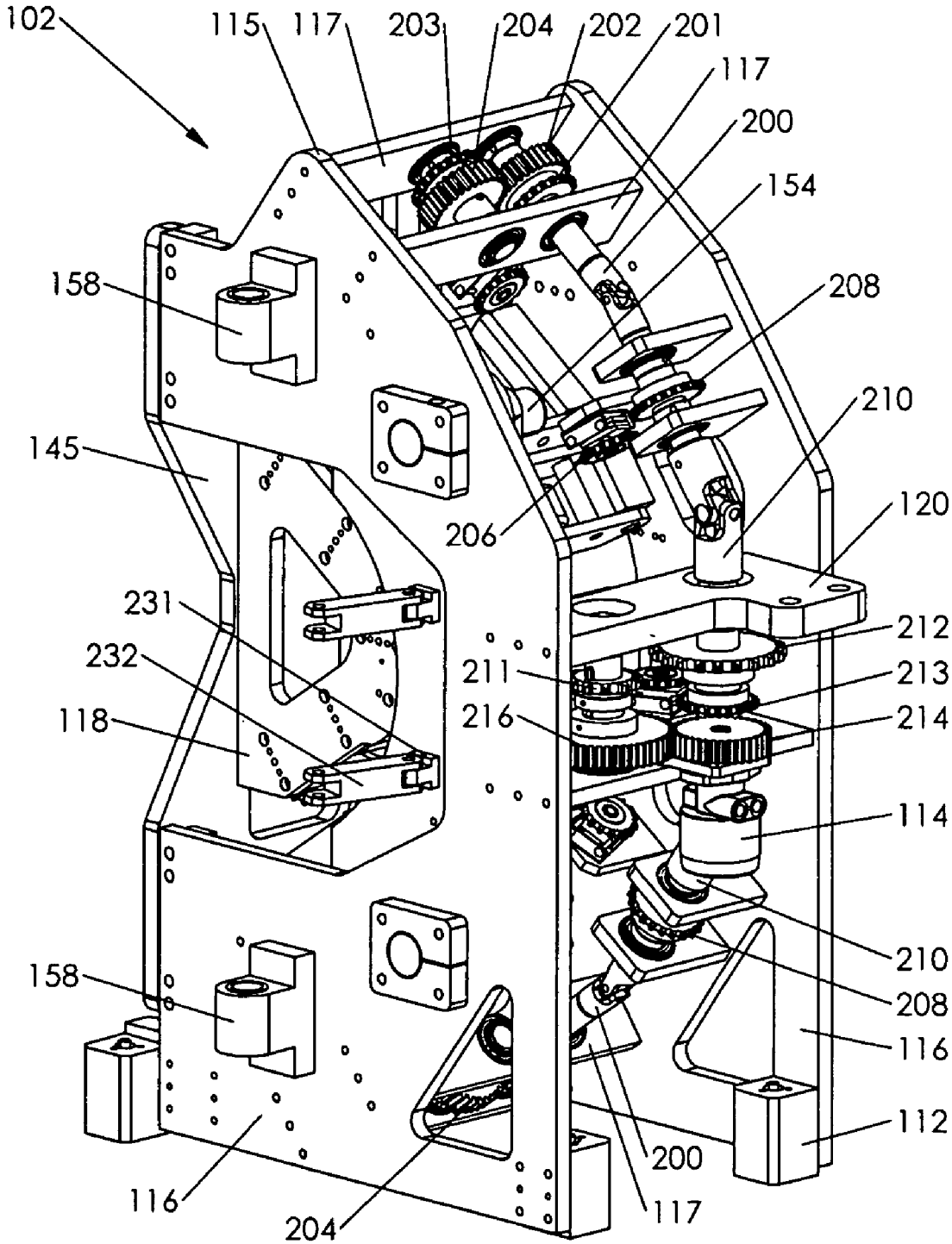
FIG. 13 illustrates a three dimensional isometric view of an adjacent exemplary curving assembly like that shown in FIG. 10 from a left rear perspective.

The panel curving apparatus 100 also includes a positioning mechanism that permits changing a relative rotational orientation between the first curving assembly 102 and the second curving assembly 104. The positioning mechanism may comprise a number of components. An example is illustrated with reference to FIGS. 9, 12 and 13, where FIG. 12 shows a three dimensional view of the curving assembly 102 from a right rear perspective, and where FIG. 13 shows a three dimensional view of adjacent curving assembly 104 from a left rear perspective. As shown in this example illustrated in FIGS. 9, 12 and 13, the positioning mechanism may include rotatable connections between adjacent curving assemblies 102, 104, 106 and 107 to permit them to pivot relative to one another. Such rotatable connections can be provided by male and female pivot blocks, such as male pivot blocks 158 shown in FIG. 13 and attached to plate 116 of curving assembly 102, and female pivot block 149 shown in FIG. 12 and attached to opposing plate 116. Pivot pins can be placed through male and female pivot blocks 158 and 149 to connect the male and female pivot blocks 158 and 149 thereby allowing the curving assemblies 102 and 104 to pivot. Such male and female pivot assemblies similarly can be used to rotatably connect second curving assembly 104 to third curving assembly 106 and to rotatably connect third curving assembly 106 to fourth curving assembly 107.

The positioning mechanism, such as illustrated in this example, may also include an actuator 110 (e.g., a hydraulic cylinder actuator) that connects adjacent curving assemblies via connecting blocks 120 that are attached to plates 116, as shown in FIG. 9. Three such actuators 110 are shown in FIG. 9. It will be appreciated that actuator 110 is not limited to a hydraulic cylinder actuator, and any suitable actuator such as a rotary actuator (e.g., screw drive) or other actuator could be used for actuator 110 in this example. The actuators 110 and the male and female pivot blocks 158 and 149 are configured to permit movement of the curving assemblies 102, 104, 106 and 107 at desired angles relative to each other, thus permitting control of the relative rotational orientation between adjacent curving assemblies.

The positioning mechanism, such as in this example, may also include ball transfer mechanisms 112 attached at the bases of the frames 115 of curving assemblies 104, 106, and 107, as illustrated in FIG. 9. The ball transfer mechanisms 112 permit smooth and easy movement of the curving assemblies 104, 106 and 107 notwithstanding the substantial weight of these assemblies. In this example, curving assembly 102 would be rigidly attached to a supporting platform via angle brackets 119, as shown in FIG. 9.

It will be appreciated that the positioning mechanism is not limited to the example described above and illustrated in FIG. 9, which utilizes male and female pivot blocks and actuators connecting adjacent curving assemblies to provide the ability to change and control relative rotational orientation between adjacent curving assemblies. Any other suitable type of precise positioning mechanism could be used to change and control the relative rotation orientation between adjacent curving assemblies. For example, each curving assembly could be mounted on its own computer controlled, translation/rotation platforms with suitable sensors to continually monitor the positions and orientations of the curving assemblies 102, 104, 106 and 107 and to provide control thereof. Any suitable feedback control system using the sensed positions and orientations as feedback could be used to control the movement of the curving assemblies 102, 104, 106 and 107, including suitable servomechanisms, to achieve the desired relative rotational orientations at the desired times.

The panel curving apparatus 100 also includes a drive system for moving the building panel longitudinally along the multiple rollers 132, 134, 135, 136, 138, 140 and 142 of curving assemblies 102, 104 and 106. In this example, as shown in FIG. 9, motors 114, e.g., hydraulic motors as illustrated or electrical motors, can be located at each of the curving assemblies 102, 104 and 106 to drive a gear train that causes some or all of the rollers 132, 134, 135, 136, 138, 140 and 142 to turn. For example, FIG. 13 shows motor 114 coupled to a first gear 214 that provides rotary motion to gear 216 and through a shaft to sprocket 211. A chain from sprocket 211 to sprocket 212 provides rotary motion to the upper and lower universal joints 210 via a shaft connected to sprocket 213. Rotary motion is coupled from the universal joint 210 to an upper drive sprocket 208 and to universal joint 200. Universal joint 200 provides rotary motion to gears 202 and 204. Gear 204, which engages gear 202, provides the counter motion to drive various counter-rotating ones of the various rollers within the mechanism. For example, referring to FIGS. 9 and 11, upper and lower sprockets 203 drive upper and lower rollers 138 and 142. Upper and lower sprockets 208 drive upper and lower rollers 135, and upper and lower sprockets 201 drive upper and lower rollers 132 and 134. Sprocket 213 drives middle roller 136. A chain tensioner 206 is provided for each chain connecting sprockets 201, 208 and 213 to their respective roller drive sprockets in order to maintain chain tension during the displacement of the rollers during curving.

The panel curving apparatus 100 is controlled by a control system 62 (see FIG. 8B), which may include a microprocessor based controller 64 (e.g., computer such as a personal computer) and a man-machine interface, such as a touch-sensitive display screen 66, for controlling actuators 110 (or more generally, for controlling a positioning mechanism) so as to control the relative rotational orientation between the first curving assembly 102 and the second curving assembly 104, and the relative rotational orientation between the second curving assembly 104 and the third curving assembly 106, as the building panel moves longitudinally along the multiple rollers 132, 134, 135, 136, 138, 140 and 142 of the curving assemblies 102, 104 and 106 to thereby form a longitudinal curve in the building panel. A less sophisticated control system, such as user-manipulated manual controls could be used, but a microprocessor-based controller that receives sensor feedback is believed to be advantageous. In this regard, suitable sensors, such as linear and/or rotary encoders may be suitably positioned at one or more of the assemblies 102, 104 and 106 to monitor the length of building panel 10 processed. Rotation sensors may be suitably placed (e.g., at male and female pivot blocks 158 and 149) to monitor the relative rotational orientation between adjacent curving assemblies. Alternatively, linear sensors, e.g., placed at or near actuators 110, may be used to monitor linear changes in distance between specified points between adjacent curving assemblies wherein the change in linear displacement can be correlated to an amount of rotation between adjacent curving assemblies. Information from these various sensors can be fed back into the control system 62 to continually monitor and adjust the functioning of the panel curving apparatus 100 and the overall system 50. Additional details regarding the control system will be described elsewhere herein.

Figure 11:
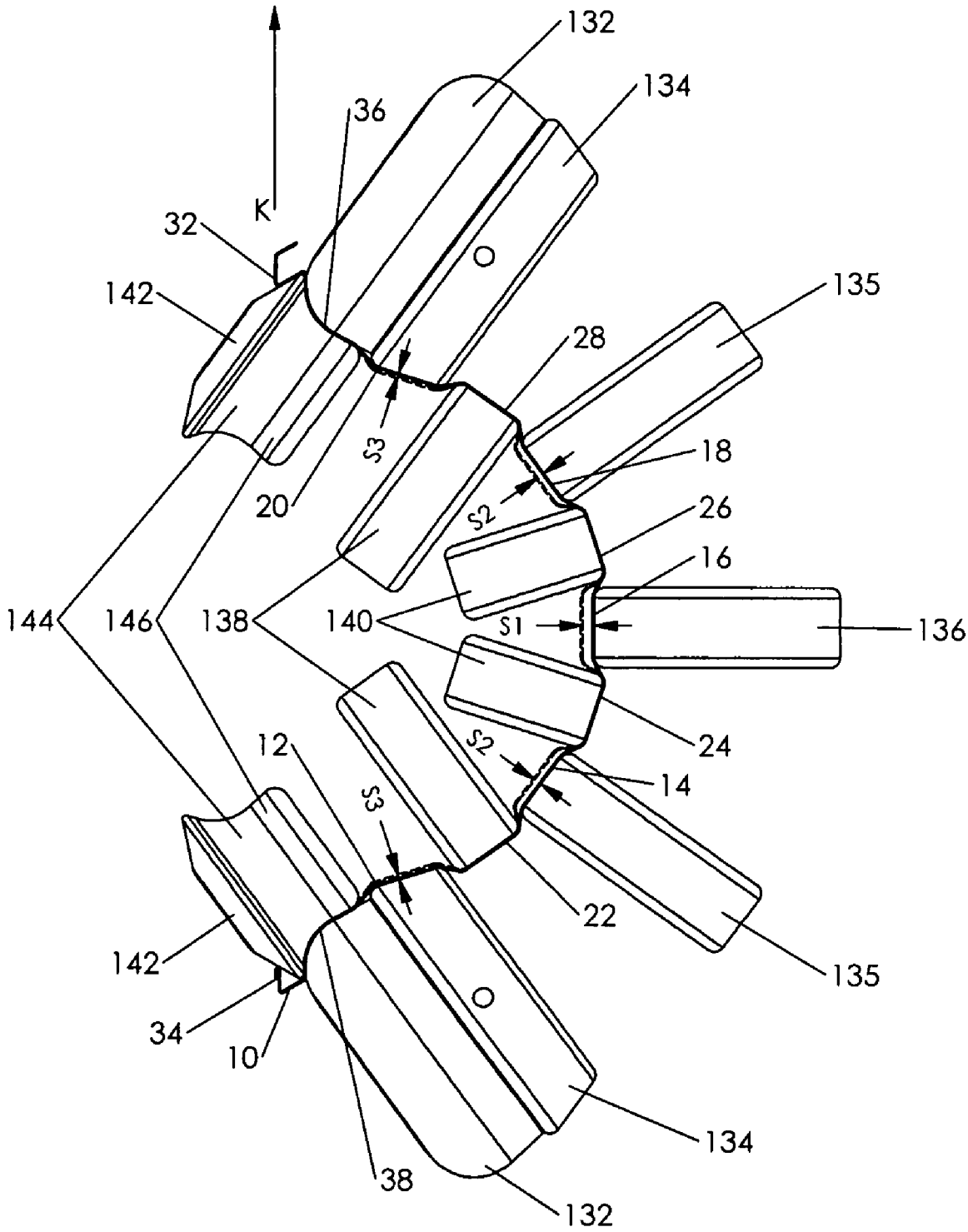
FIG. 11 illustrates an exemplary configuration of multiple rollers of the exemplary curving assembly of FIG. 10 according to an exemplary aspect.

The panel curving apparatus 100 shown in FIGS. 9-13 is configured to form the longitudinal curve in the building panel 10 without imparting transverse corrugations into the building panel 10. This is evident from the absence of any crimping blades in the curving assemblies 102, 104 and 106 or elsewhere in panel curving apparatus 100. In this regard, the multiple rollers 132, 134, 135, 136, 138, 140 and 142 of the curving assemblies 102, 104 and 106 are arranged so as to cause an increase in a depth of a particular segment of the plurality of segments of the building panel to accommodate the formation of the longitudinal curve in the building panel 10*a*. An example is illustrated in FIG. 11, which shows the multiple rollers 132, 134, 135, 136, 138, 140 and 142 of panel curving assemblies 102, 104 and 106, as well as a straight building panel 10 in cross section engaged with those rollers. Building panel 10 shown in FIG. 11 includes a curved center portion (not labeled), side portions 36 and 38, connecting portions 32 and 34, and segments 12, 14, 16, 18, 20, 22, 24, 26 and 28.

The curved building panels and panel curving assemblies may have any dimensions suitable for a desired application.

In exemplary embodiments, the panels may be, for example 24" wide and 10½" deep. Exemplary panel curving assemblies for longitudinally curving panels having these dimensions may be approximately 60" in height, 30" in depth, and 24" in length. The distance between pivot assemblies of these exemplary panel curving assemblies may be approximately 32". The approximate weight of such panel curving assemblies would be approximately 3200 lbs. each.

Figure 25:
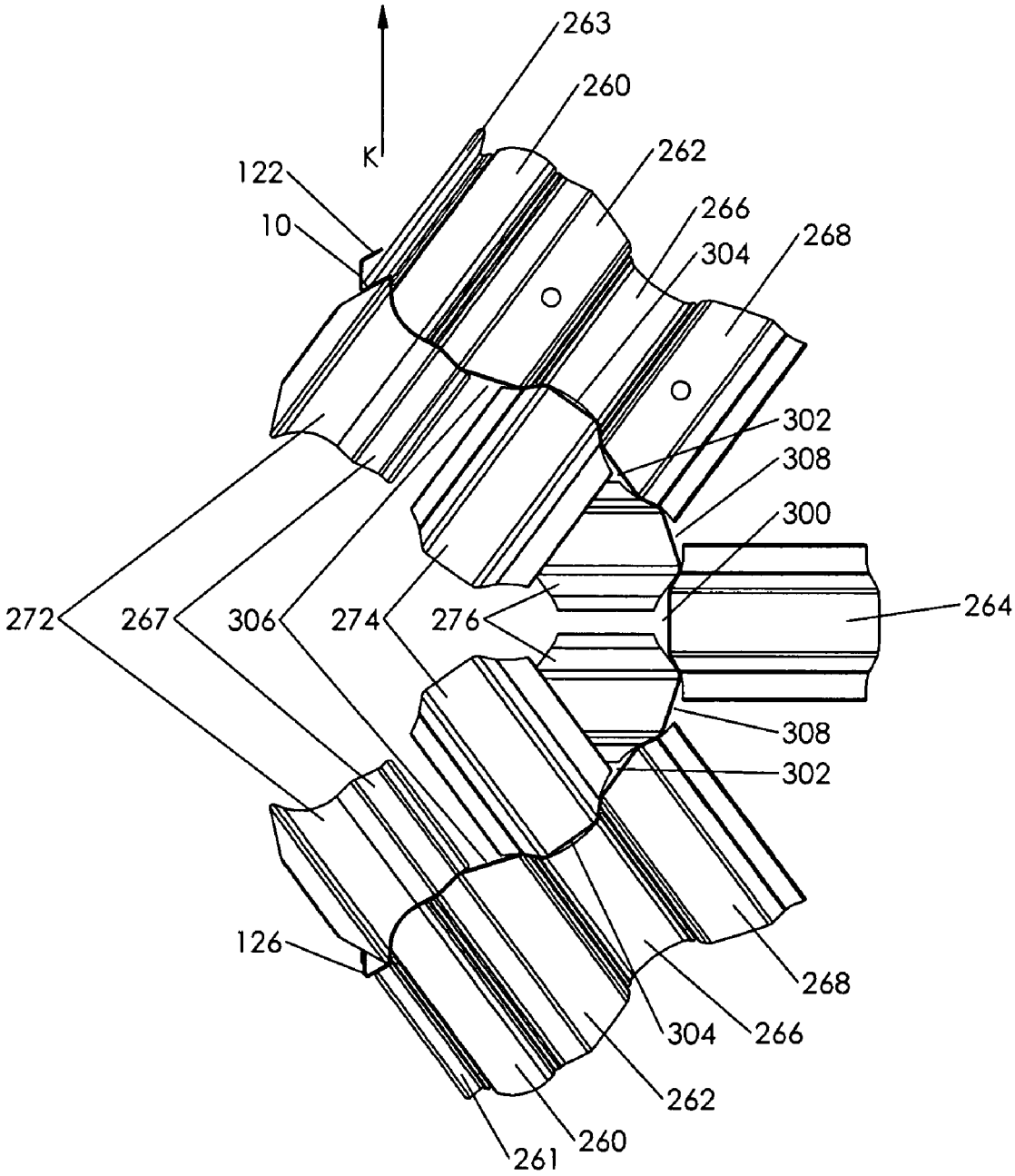
FIG. 25 illustrates an exemplary configuration of multiple rollers of the exemplary panel curving assembly of FIG. 23.
Figure 26:
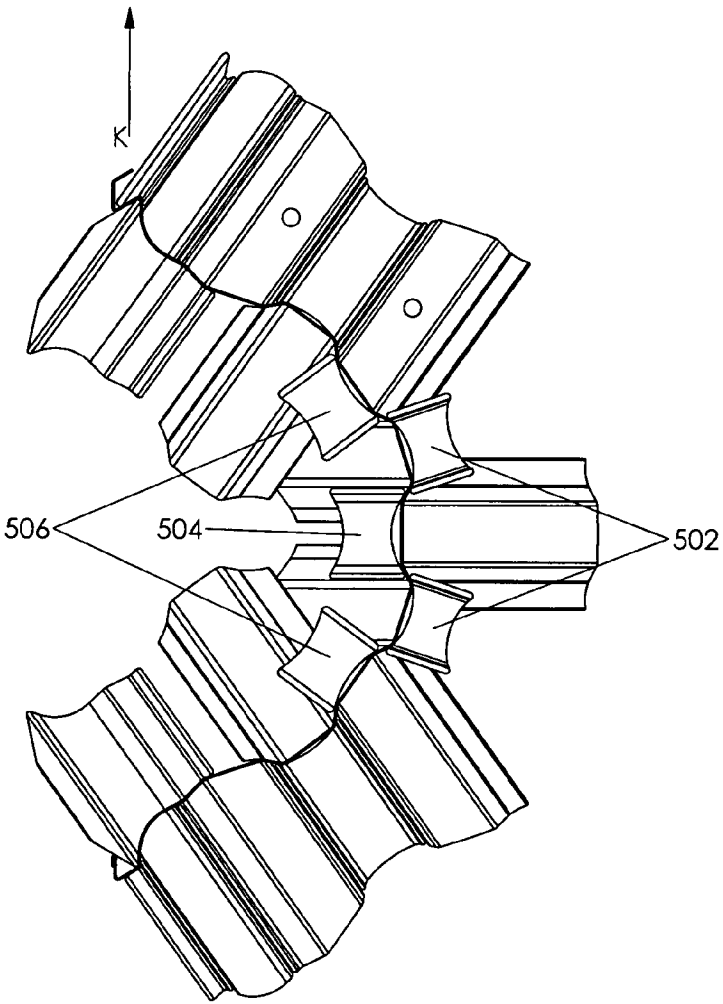
FIG. 26 illustrates multiple rollers of the exemplary panel curving assembly of FIG. 23 with the addition of supplemental rollers.

In the exemplary roller configuration of FIG. 11, the multiple rollers of the curving assemblies 102, 104 and 106 comprise inner rollers 138, 140 and 142 supported by the frame 115, and in particular by the support member 118 via suitable hardware, and outer rollers 132, 134, 135 and 136 supported by the frame 115 via suitable hardware. As illustrated, the outer rollers outer rollers 132, 134, 135 and 136 are positioned to contact an outer side of the building panel 10 in cross section, and the inner rollers 138, 140 and 142 are positioned to contact an inner side of the building panel 10 in cross section. Other exemplary configurations that include a set of inner rollers and a set of outer rollers are shown in FIGS. 25 and 26 described elsewhere herein.

In the exemplary roller configuration of FIG. 11, a particular roller is positioned to contact a particular segment of the building panel so as to increase a depth of the particular segment as the building panel moves along the multiple second rollers. As shown in the example of FIG. 11, a particular roller 136 is configured to contact particular segment 16 of the building panel 10 so as to increase a depth of the particular segment 16 to accommodate the formation of the longitudinal curve in the building panel. This is evident by comparing the solid and dotted lines corresponding to segment 16 shown in FIG. 11 (where the solid line represents the cross section of the straight, undeformed building panel 10, and the dotted line represents a change in depth of segment 16 due to deformation by roller 136). Similarly, upper and lower rollers 135 are configured to contact building panel 10 so as to increase a depth of particular deformations 14 and 18 to accommodate the formation of the longitudinal curve in the building panel.

In the exemplary roller configuration of FIG. 11, a particular roller, e.g., middle roller 136, is positioned adjacent to two opposing rollers 140 such that a contacting surface portion (a surface portion of the roller that contacts the building panel) of the particular middle roller 136 is disposed between contacting surface portions of the two opposing rollers 140 under a deformation imparting condition. An outer-most point of the contacting surface portion of the particular roller 136 is displaceable toward rotation axes of the two opposing rollers 140 by a distance S1. This distance S1 corresponds to a change in depth of the corresponding segment 16 at a given stage of the curving process. Similarly, outer-most contact surfaces of upper and lower rollers 135 are displaceable toward the rotation axes of upper rollers 138 and 140 and lower rollers 138 and 140 by a distance S2. This distance S2 corresponds to a change in the depths of the corresponding segments 14 and 18, respectively. The distance S1 is controlled to be greater than the distance S2 insofar as roller 136 is configured to impart greater deformation into building panel 10 than the deformations imported by upper and lower rollers 135. Upper rollers 132 and 134 rotate about a common axis and are jointly displaceable. Upon displacement, upper roller 134 increases the depth of segment 20 by an amount S3, while upper roller 132 is compressed (e.g., by virtue of a urethane contacting surface to enhance traction against the building panel 10. Lower rollers 132 and 134 are displaceable in the same manner, undergoing compression to provide traction and causing undergoing displacement S3, respectively.

The distance S1 for middle segment 16 is controlled to be greater than distance S2 of adjacent segments 14 and 18 because the building panel 10 is being longitudinally curved to a greater extent at the cross sectional middle portion of the building panel 10*a* near segment 16 and is effectively having its linear length shortened to a greater extent in regions where the building panel 10*a* has greater longitudinal curvature, the greatest amount of longitudinal curvature occurring at the middle of the building panel 10*a* near longitudinal segment 16. The linear length of the building panel 10 is not shortened in the longitudinal direction at the regions of the connecting portions 32 and 34. However, more linear shortening of the building panel occurs for portions closer to segment 16*a* at the middle of the building panel 10*a*. This is shown in FIG. 1, for example, where the length C2 of the longitudinally curved building panel 10*a* is essentially the same as the length of the corresponding straight building panel 10, but the length C1 of longitudinally curved building panel 10*a* is less than C2 because the region near the middle of the building panel is curved the most. The greater linear compression of the building panel 10*a* associated with this greater longitudinal curving near the middle of the building panel requires a corresponding greater displacement of sheet material in the middle region to accommodate the formation of the longitudinal curve. Thus, as the building panel 10*a* is curved, the "excess" sheet material that is being displaced due to the longitudinal linear contraction must be absorbed someplace, and the displaced sheet material accumulates and is absorbed in the inwardly extending segments.

For example, referring to FIG. 11, segment 16 is deformed the most since it is positioned in the region of greatest linear contraction. Segments 14 and 18 are deformed somewhat less because they are positioned at regions of relatively less linear contraction. Sheet material that is displaced due to linear contraction of the building panel 10 associated with longitudinal curving is taken up in the longitudinally extending segments, which as noted previously may also be considered stiffening ribs. This process occurs in a highly controlled fashion where the building panel 10*a* is supported by multiple rollers of multiple curving assemblies 102, 104, and 106 such that the longitudinal curve is formed without buckling and without the need for transverse corrugations. The end result is a smooth building panel curved in a longitudinal direction with segments having undergone greater changes in depth in regions of greater lengthwise contraction of the building panel.

Referring again further to FIG. 11, upper and lower rollers 132 may include a urethane contacting surface to provide the traction needed to grab and drive the building panel 10 through the curving assemblies 102, 104, and 106. Similarly upper and lower rollers 142 may include a section 144 that may have a urethane contacting surface for traction and a section 146 with a steel contacting surface. Upper and lower rollers 132 and upper and lower rollers 142 may be viewed as drive rollers in this regard. The remaining rollers 134, 135, 136, 138 and 140 may be formed of steel and may be chrome plated to withstand the weather conditions experienced during outside use.

The operation of the multiple rollers 132, 134, 135, 136, 138, 140 and 142 of panel curving assemblies 102, 104 and 106 will now be described in connection with the example of FIGS. 9-13. As shown in FIG. 11, inner rollers 138 and inner rollers 140 provide an opposing force for outer rollers 132, 134, 135 and 136. Rollers 138, 140 and 142 are supported by support member 118 (e.g., D-ring), which is supported by plate 145, as illustrated in FIG. 13. Outer rollers 132, 134, 135 and 136 are actively displaced using a cam mechanism (described below) toward the inner rollers 138, 140 and 142 when building panel 10 is in place in the curving assembly (e.g., 102) to increase the depth of a given segment (e.g., segment 16). As shown in FIG. 11, middle roller 136 is displaced more than the adjacent upper and lower rollers 135 so that segment 16 at the middle of the building panel 10*a* will have the greatest increase in depth, and in some examples may be the deepest segment. Middle roller 136 and opposing rollers 140 also prevent the panel from shifting laterally during the longitudinal curving process.

Referring to FIGS. 11-13, the positioning of rollers 132, 144, 135 and 136 is provided through a series of cams and pushing mechanisms. Cams 150 and cam follower 152, shown in FIG. 12 for curving assembly 104, push rollers 135 toward the building panel 10 to provide the deformation that facilitates longitudinal curving in combination with adjusting the relative rotational orientation of adjacent curving assemblies (102, 104, 106). The cams 150 are mounted to a plate 148 in FIG. 12 that slides transversely on a shaft 154 and shaft bearing 156. Plate 148 connects to an adjacent curving assembly via links 232 and mounting brackets 231 as shown in FIG. 13. The cam 150 forces the cam follower 152 to push the rollers into position by virtue of motion of the plate 148 that is provided by links 232 attached to adjacent curving assembly 102 shown in FIG. 13. As curving assemblies 102 and 104 are rotated relative to one another (e.g., using actuators 110 shown in FIG. 9), the links 232 attached to curving assembly 102 (FIG. 13) will push the plate 148, which then provides motion to the cams 150 and cam followers 152, which pushes the rollers 132, 134, 135, and 136 into position. As the rotation angle between adjacent curving assemblies is increased under operation of actuators 110, the degree of longitudinal curvature imparted to the building panel 10*a* also increases, and cams 150 and cam followers 152 provide correspondingly more force and displacement to the rollers 132, 134, 135 and 136 to increase the amount of deformation to the segments 12, 14, 16 18 and 20. The cams 150 are precisely machined to provide a correct deformation for the corresponding radius of curvature of the building panel 10*a*.

Figures 14, 15:
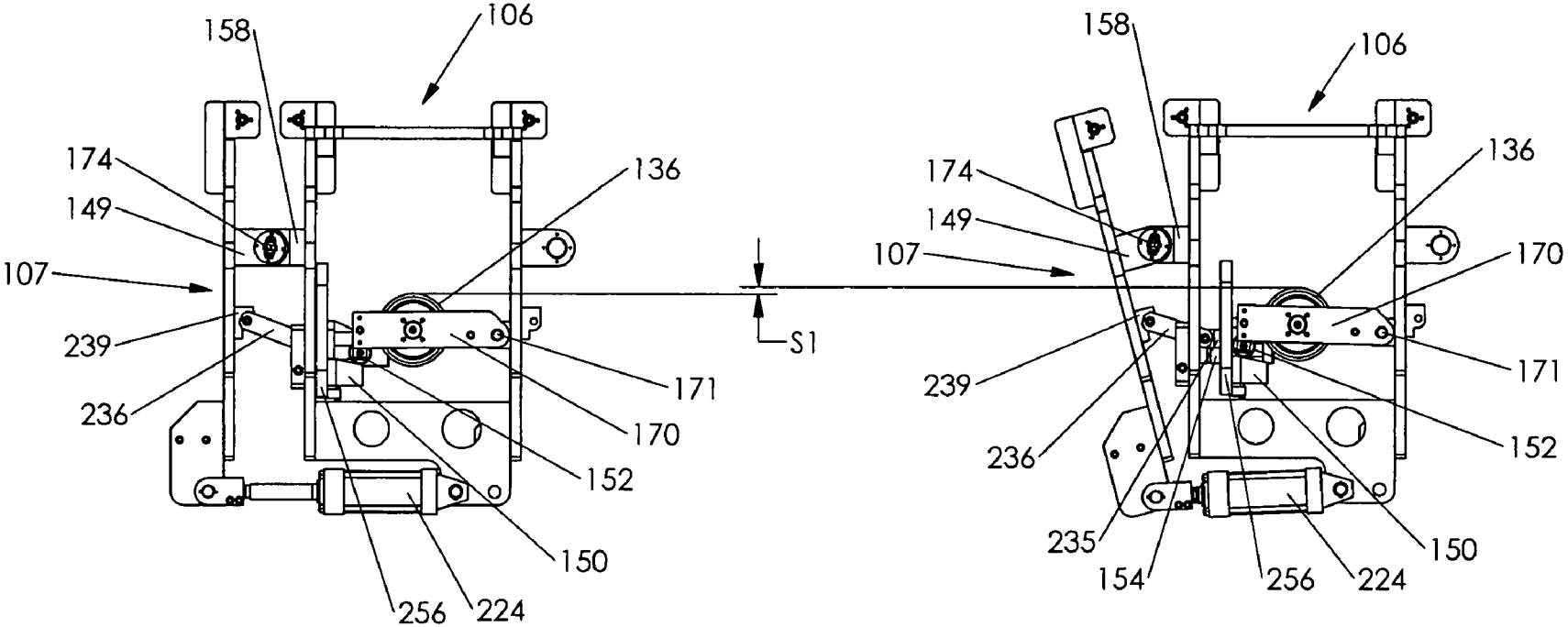
FIG. 14 illustrates a portion of an exemplary curving assembly in the absence of rotation between adjacent curving assemblies.
FIG. 15 illustrates a portion of an exemplary curving assembly with rotation between adjacent curving assemblies.

The cam mechanism for actuating the rollers 136 is further illustrated in FIGS. 14 and 15 in connection with curving assembly 106 and fourth assembly 107. In these illustrations, cam 150 is mounted to plate 256 which is supported by shaft 154. As actuator 224 retracts and begins to rotate the fourth assembly 107 relative to curving assembly 106, links 236, attached to the fourth assembly 107 via mounting brackets 239, apply force to plate 256 and plate 256 translates toward roller 136. This translation of the cam plate 256 forces the cam follower 152 to follow the machined profile of the cam surface. The cam profile is determined by the relationship between Δd1, the relative angle between stations and the desired radius (e.g., see Table 1 below). Cam follower 152 contains a roller bearing which rotates about a shaft fixed to roll support arm assembly 170. The end opposite the cam follower 152 of roll support arm assembly 170 is constrained to rotate about mount 171. As the plate 256 translates toward the roller 136 the cam follower 152 follows the cam profile and forces the roll support arm assembly 170 to rotate about mount 171 thereby causing roller 136 to move toward the panel by a distance S1 and deforming the panel by an amount Δd1.

Suitable depths and widths of the segments depend upon the type and thickness of the sheet material used and the amount of longitudinal curving (e.g., radius of curvature) desired for the building panel. The determination of such parameters is within the purview of one of ordinary skill in the art by limited and straightforward preparation of test panels using various selections of the above-noted parameters. As a non-limiting example, for a 24-inch wide finished panel having an overall depth of 10.5 inches, made from 0.060 inch thick steel sheet metal, the present inventors have found the deformation depths illustrated in Table 1 below to be suitable depending upon the radius of curvature:

TABLE 1

| Radius (ft) | Δd1 (in) | Δd2 (in) | Δd3 (in) |
|---|---|---|---|
| 315 | 0.015 | 0.013 | 0.007 |
| 157 | 0.031 | 0.025 | 0.013 |
| 78 | 0.060 | 0.050 | 0.026 |
| 52 | 0.087 | 0.072 | 0.039 |
| 39 | 0.113 | 0.095 | 0.052 |
| 31 | 0.138 | 0.116 | 0.064 |
| 26 | 0.163 | 0.137 | 0.076 |
| 22 | 0.187 | 0.157 | 0.088 |
| 19 | 0.210 | 0.177 | 0.100 |
| 17 | 0.233 | 0.197 | 0.112 |
| 15 | 0.257 | 0.217 | 0.125 |
| 14 | 0.279 | 0.236 | 0.136 |
| 13 | 0.302 | 0.255 | 0.148 |
| 12 | 0.324 | 0.274 | 0.162 |
| 11 | 0.347 | 0.293 | 0.170 |
| 10 | 0.370 | 0.312 | 0.182 |

Of course, the actual deformation depths can vary due to sheet material thickness, yield strength, hardness and radius of curvature, and the present disclosure is not intended to be limited to any particular range of depths or configurations of segments formed in the building panel 10*a*.

The use of cams 150 and cam followers 152 as described above has been found to be advantageous from the standpoint of simplicity and cost effectiveness, but other approaches could also be used to provide and control the positioning of rollers 132, 134, 135 and 136. For example, microprocessor controlled actuators and/or servomechanisms could be used to move the rollers 132, 134, 135 and 136 into their correct positions. In addition, the use of separate mechanisms for each individual roller 132, 134, 135 and 136 could be used so as to precisely move each roller 132, 134, 135 and 136 into a position to provide the optimum deformation to a segment for obtaining the curvature needed.

An overall operation of the multiple curving assemblies 102, 104, 106 and 107 to longitudinally curve a building panel will now be described with reference to FIGS. 16-19. FIGS. 16-19 show a top view of an exemplary sequence for imparting a longitudinal curve to a building panel 10. FIG. 16 shows the panel curving apparatus 100 before any curving of the building panel occurs. A straight building panel 10 is inserted into the entry guide 108 of the panel curving apparatus 100. A sensor 172 is provided for measuring linear translation of the building panel, and sensors 174 are provided between adjacent curving assemblies for measuring the rotation of one curving assembly relative to an adjacent curving assembly (or for measuring a translation that can be correlated to rotation). Any suitable electrical and/or optical sensors for measuring rotation and/or translation can be used in this regard, examples of which are described below. Motors 114 and associated drive mechanisms, and drive rollers 132 and 142 move the building panel 10 into place through all three curving assemblies 102, 104 and 106 without initially imparting any longitudinal curve to the building panel 10. At this stage, there is no relative rotation between adjacent curving assemblies 102, 104 and 106, and the cams 150 and cam followers 152 therefore do not impart a deforming force to rollers 132, 134, 135 and 136. Once the building panel 10 inserted into curving assemblies 102, 104 and 106, the control system 62 can automatically begin translating the building panel 10 in the longitudinal direction and begin the curving process.

As shown in FIG. 17, while the building panel 10 is being translated longitudinally, the control system 62 causes actuator 220 to rotate curving assembly 104 relative to curving assembly 102 by an angle θ1. Curving assembly 102 is fixed in place. Curving assemblies 106 and 107 rotate along with curving assembly 104. A sensor 174, e.g., any suitable optical or electronic position sensor for measuring rotation (e.g., at a rotation point between adjacent curving assemblies) and/or translation (e.g., at actuator 220 to measure its displacement) may be used to precisely control the position of each curving assembly 102, 104, 106 and 107 by virtue of electrical signals output from such sensors that are fed back into control system 62. For example, a conventional rotation sensor may be used for sensor 174, such as the P502 sensor made by Positek (www.positek.com). An exemplary commercially available translation sensor is the DGS25 optical incremental encoder made by SICK-STEGMANN (www.sick.com).

As shown in FIG. 17, region 240 of the building panel is now beginning to curve under the influence of the torque applied to the building panel by the multiple rollers 132, 134, 136, 138, 140 and 142 of curving assemblies 102 and 104 and by the additional deformation caused by rollers 132, 134, 135 and 136 of curving assembly 102. The longitudinal curve is imparted as the building panel moves through the panel curving apparatus 100 without the need for transverse corrugations and without causing buckling. As curving assembly 104 initially rotates relative to curving assembly 102, the links 232 move plate 252, and plate 252 drives cams 150 and cam followers 152 as previously discussed to force rollers 132, 134, 135 and 136 to engage the panel and impart a deforming displacement to the existing segments of the building panel.

Next, as shown in FIG. 18, while the building panel is translating longitudinally and when the initially curved portion 240 arrives at curving assembly 106, the control system 62 causes actuator 222 to rotate curving assembly 106 relative to curving assembly 104 by an angle θ2 that is greater than θ1. As curving assembly 106 initially rotates relative to curving assembly 104, link 234 pushes against plate 254. Cam plate 254 drives cams 150 and cam followers 152 as previously discussed to cause rollers 132, 134, 135 and 136 of curving assembly 104 to engage the building panel and impart additional deforming displacement and force to the existing longitudinal ribs of the building panel. Region 242 of the building panel is curved by an additional amount under the influence of the torque applied to the building panel by the multiple rollers 132, 134, 136, 138, 140 and 142 of curving assemblies 104 and 106 and by the additional deformation caused by rollers 132, 134, 135 and 136 of curving assembly 104. The approximate angular range for θ1 and θ2 may be from 0° to 30°, for example. According to a non-limiting example, for a 24-inch wide panel made from 0.060 thick steel sheet metal, θ1 may range between 0° and 15°, and θ2 may range between 0° and 30°.

Next, as shown in FIG. 19, while the building panel is translating longitudinally and when the additionally curved portion 242 arrives at curving assembly 107, the control system 62 causes actuator 224 to rotate fourth assembly 107 relative to curving assembly 106 by the angle θ2. As curving assembly 107 initially rotates relative to curving assembly 106, link 236 pushes against plate 256. Plate 256 drives cams 150 and cam followers 152 as previously discussed to cause rollers 132, 134, 135 and 136 of curving assembly 106 to engage the building panel. Since curving assembly was rotated by the same angle as was curving assembly 106, no additional deforming force is applied by rollers 132, 134, 135 and 136 to the building panel of curving assembly 106. The multiple rollers 132, 134, 135, 136, 138 and 140 of curving assembly simply continue to hold and guide the building panel as it moves. Region 244 of the building panel exhibits the same curvature as that exhibited at region 242 of FIG. 186. Curving assembly 107 serves to guide and output the longitudinally curved building panel.

The longitudinal curving process as described above will continue in this manner to produce curved building panels 10*a* as desired. A suitable shearing device (not shown) of types known to those of skill in the art can be positioned near the fourth assembly 107 to shear the building panel 10*a* at desired lengths for a given building project, and the shearing device can be controlled by the control system 62 as well. A sensor 172 (e.g., a suitable optical or electronic sensor) can be used at one or more locations to make linear distance measurements of how far the building panel is translated (e.g., at the input to the panel curving system 100 or at some other location), and these measurements can be fed to the control system 62 so that the control system 62 can control the shearing process to achieve longitudinally curved building panels 10*a* of desired length and to achieve building panels having multiple radii, should that be desired.

As shown in FIG. 19, an end portion 238 of the building panel emanating from curving assembly 107 is straight because there is a minimal length of the building panel that must be initially inserted into the panel curving apparatus 100 to initiate the curving process (see FIG. 16). Such straight portions, which continuously connect with curved portions, are sometimes desirable to provide a straight wall section for a gable style building or a double-radius (two-radius) style building, such as shown in FIGS. 5 and 7. Entirely curved building panels 10*a* can be used to fabricate the curved portions of arch style buildings such as shown in FIG. 6. Straight sections 238 can be discarded or utilized in the building project as may be desired.

Another exemplary embodiment of a panel curving apparatus according to the present disclosure will now be described. Whereas the exemplary panel curving apparatus 100 described above can be viewed as relating to an "active" deformation approach insofar as the panel curving apparatus includes rollers that forcibly deform various segments of the building panel, the exemplary embodiment described now may be thought of as relating to a "passive" deformation approach insofar as certain rollers are positioned with gaps therebetween to accommodate the accumulation of sheet material of the building panel as the longitudinal curve is formed in the building panel, instead of forcibly deforming longitudinally extending segments with rollers. However, it should be appreciated that in light of the teachings herein the "active" approach and the "passive" approach need not be considered mutually exclusive, and variations on these curving approaches may incorporate aspects of both approaches.

Figure 20:
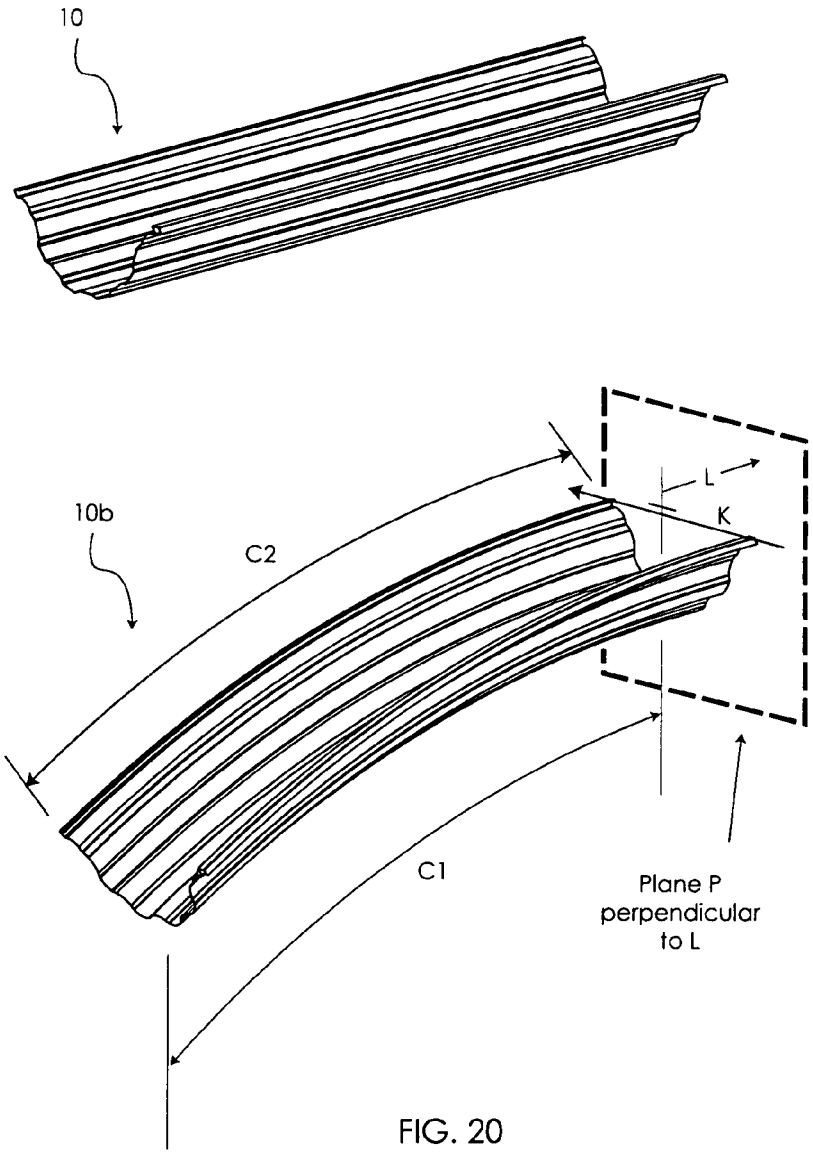
FIG. 20 illustrates another exemplary building panel with a curved center portion having a plurality of segments before and after receiving a longitudinal curve along its length according to an exemplary aspect.
Figure 21:
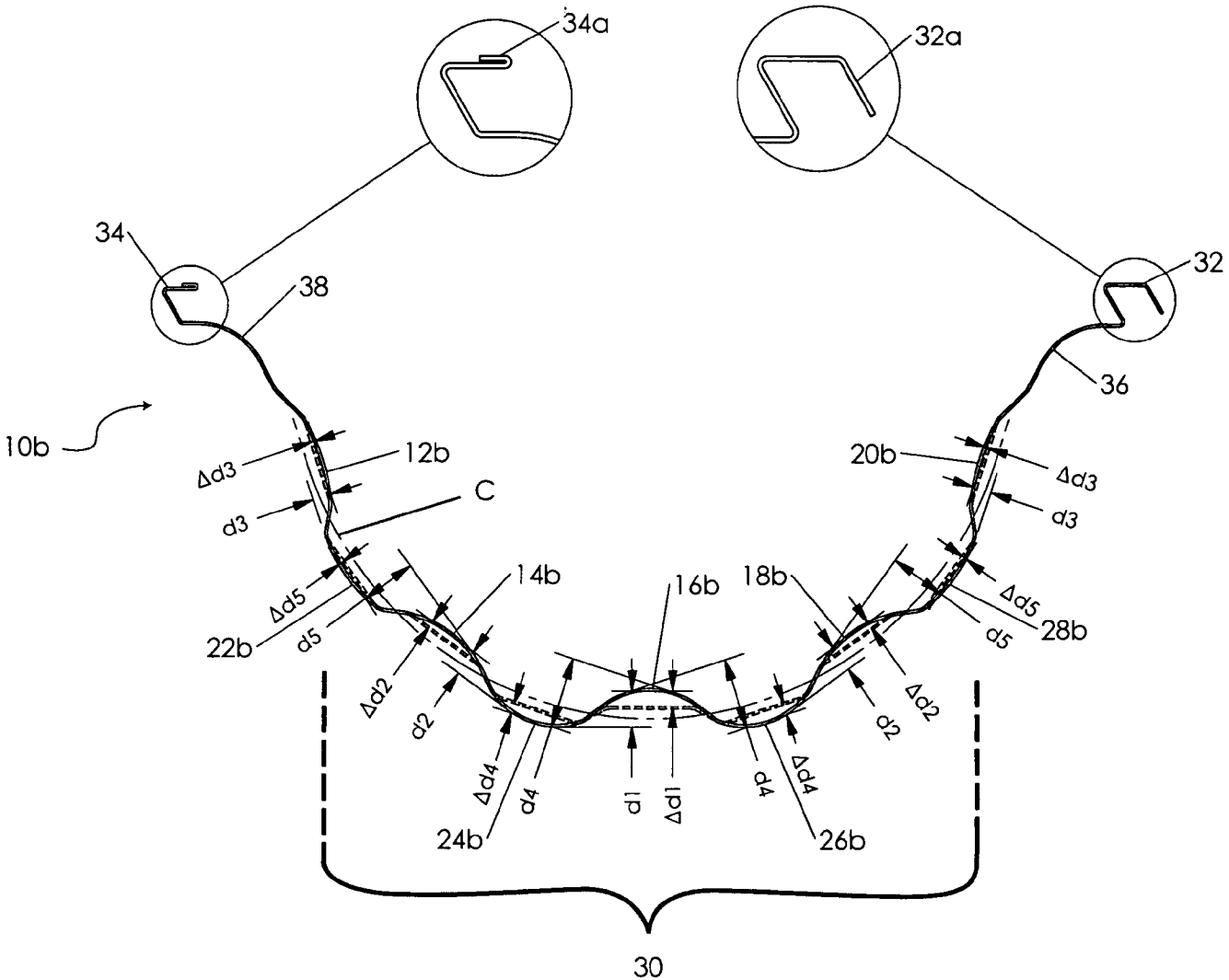
FIG. 21 illustrates an exemplary cross sectional shape of an exemplary building panel having a longitudinal curve along its length according to an exemplary aspect.

A discussion of a straight building panel and a corresponding longitudinally curved building panel is presented in FIGS. 20 and 21 prior to describing the panel curving apparatus that utilizes a passive curving approach. FIG. 20 illustrates an exemplary straight building panel 10 that that can be curved along a longitudinal direction L to form an exemplary curved building panel 10*b*. Building panel 10 shown in FIG. 20 is like building panel 10 shown in FIG. 1. As will be described herein, building panel 10*b* shown in FIG. 20 differs in some respects relating to the cross sectional shapes of longitudinally extending segments as compared to building panel 10*a* shown in FIG. 1. In other respects, such as types and thicknesses of sheet material, widths and radii of curvature of finished building panels, the prior description with respect to building panels 10 and 10*a* of FIG. 1 is applicable to building panels 10 and 10*b* shown in FIG. 20. In particular, length C2 of an upper portion of building panel 10*b* is greater than length C1 of a lower portion of building panel 10*b* due to shortening of the building panel 10*b* at the lower portion for reasons described previously herein.

FIG. 21 shows the cross sectional shape of the building panel 10*b* in cross section, e.g., at plane P shown in FIG. 20, following a longitudinal curving process described below. The cross sectional shape of the straight building panel 10, i.e. before the longitudinal curving process, is shown in FIG. 21 as a dashed profile for illustrative purposes. As illustrated in FIG. 21, the building panel 10*b* includes a curved center portion 30, a pair of side portions 36 and 38 extending from the curved center portion 30 in cross section, and a pair of connecting portions 32 and 34 extending from the side portions 36 and 38, respectively, in cross section, similar to that of straight building panel 10. The overall outline of the curved center portion 30 is illustrated by the curved dotted line C. The curved center portion may have a semi-circular shape or other arcuate shape. As a result of the curving process, however, the cross-sectional profile of the segments undergoes changes. The longitudinally curved building panel 10*b* includes inwardly extending segments 12*b*, 14*b*, 16*b*, 18*b*, and 20*b*, and outwardly extending segments 22*b*, 24*b*, 26*b* and 28*b*. As illustrated in FIG. 21, due to longitudinal curving, a particular segment of the longitudinally curved building panel 10*b* will have undergone a change in depth greater than that of another segment. In the example of FIG. 21, for example, the depth of segment 16*b* changes inwardly in cross section by an amount Δd1, and the depth of neighboring segment 14*b* inwardly by an amount Δd2, wherein Δd1 is greater than Δd2. Similarly, the depth of segment 12*b* changes inwardly by an amount Δd3, where Δd2 is smaller than Δd3. Segment 16*b* is positioned at a middle of the curved center portion 30 and has the greatest change in depth of any of the segments illustrated in the example of FIG. 21.

In this example, since the straight building panel 10 possessed segments of uniform depth d (see FIG. 2), various segments of curved building panel 10*b* will have different overall depths after longitudinal curving. Based on the changes in depths of the various segments described above, segment 16*b* will have a greater depth from its outermost edges relative to the depths of other segments. In particular, as shown in the example of FIG. 21, the depth of segment 16*b* extends a distance d1 inwardly in cross section from its outermost edges, and neighboring segments 24*b* and 26*b* extend a distance d4 outwardly from their outermost edges, wherein distance d1 is greater than distance d4. Similarly, segments 14*b* and 18*b* extend a distance d2 inwardly from their outermost edges, and the distance d4 is greater than distance d2. Likewise, segments 22*b* and 28*b* extend a distance d5 outwardly from their outermost edges, and the distance d2 is greater than distance d5. And segments 12*b* and 20*b* extend a distance d3 inwardly from their outermost edges, and the distance d5 is greater than distance d3. Segment 16*b*, which is positioned at a middle of the curved center portion 30, has the greatest depth d1 of the segments illustrated in the example of FIG. 21. In view of the explanation above, it will be appreciated that to achieve a longitudinally curved building panel segments all having approximately the same depth according to the present disclosure, a straight building panel having non-uniform segment depths to start with would be needed (e.g., a straight building panel with shallower segments near the middle thereof and deeper segments near the edges thereof would be needed). The identification of appropriate starting segment depths of such a straight building panel is within the purview of one of ordinary skill in the art, e.g., by limited trial-and-error testing, in view of the information provided herein.

As discussed in more detail elsewhere herein, as the straight building panel 10 is curved longitudinally into building panel 10*b* illustrated in cross section in FIG. 21, the depths of various segments change to accommodate the formation of the longitudinal curve. The greater change in depth Δd1 relative to the change in depth Δd4 accommodates the formation of the longitudinal curve in the building panel 10*b* by permitting the accumulation of sheet material into segment 16*b* in connection with a lengthwise shortening of the building panel 10*b* at that location during longitudinal curving compared to other locations on the building panel 10*b* that exhibit less lengthwise shortening. Similarly, the greater change in depth Δd4 relative to the change in depth Δd2 also accommodates the formation of the longitudinal curve in the building panel 10*b* by permitting the accumulation of sheet material into segments 24*b* and 26*b* in connection with a lengthwise shortening of the building panel 10*b* at that location during longitudinal curving compared to other locations on the building panel 10*b* that exhibit less lengthwise shortening. Likewise, the greater change in depth Δd2 relative to the change in depth Δd5 also accommodates the formation of the longitudinal curve in the building panel 10*b* by permitting the accumulation of sheet material into segments 14*b* and 18*b* in connection with a lengthwise shortening of the building panel 10*b* at that location during longitudinal curving compared to other locations on the building panel 10*b* that exhibit less lengthwise shortening. And the greater change in depth Δd5 relative to the change in depth Δd3 also accommodates the formation of the longitudinal curve in the building panel 10*b* by permitting the accumulation of sheet material into segments 22*b* and 28*b* in connection with a lengthwise shortening of the building panel 10*b* at that location during longitudinal curving compared to other locations on the building panel 10*b* that exhibit less lengthwise shortening. The lengthwise shortening of the building panel 10*b* near segment 16*b* is illustrated by the relatively shorter length C1 of the building panel 10*a* at that (lower) location as compared to the longer length C2 of the building panel at the (upper) regions of the connecting portions 32 and 34, as shown in FIG. 20. As noted above, the difference between linear lengths C1 and C2 occurs because the longitudinally curved building panel 10*b* is derived from a straight building panel 10 having a similar cross sectional shape and a uniform length. In the longitudinal curving process described herein, the depths of various segments change to accommodate the longitudinal curve in the building panel 10*b* without the need to impart transverse corrugations into the building panel 10*b*. Greater degrees of longitudinal curving, corresponding to smaller radii of curvature, are accompanied by greater changes in the depths of segments. Segments located at areas of relatively greater linear shorting of the panel due to the longitudinal curving exhibit relatively greater changes in depth. An exemplary curving apparatus employing a passive approach for generating the panel illustrated in FIG. 21 will now be described.

Figure 22:
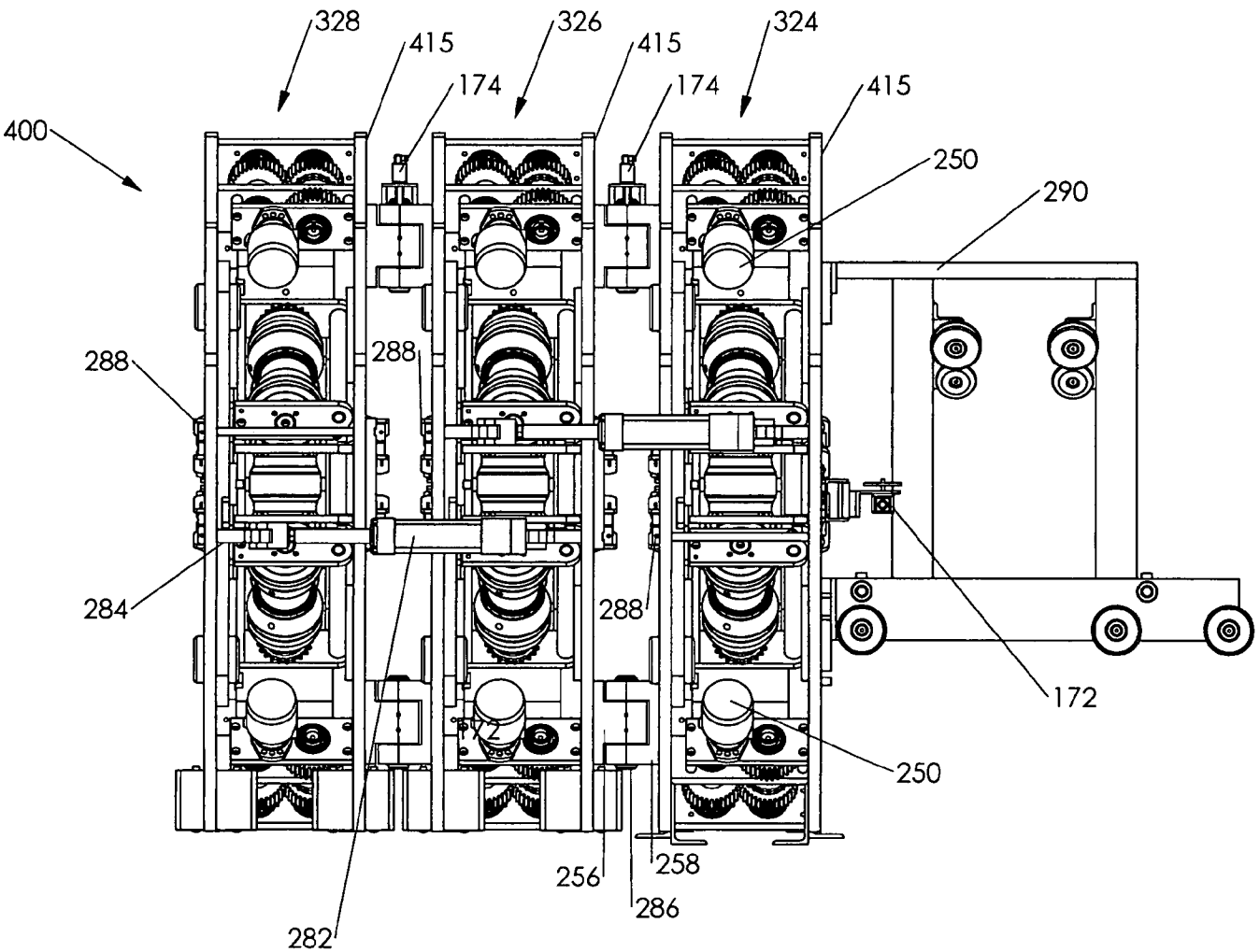
FIG. 22 illustrates a side view of another exemplary panel curving machine according to another aspect.

FIG. 22 illustrates a side view of an exemplary panel curving machine 400 according to another exemplary embodiment. Like the panel curving machine 100, the panel curving machine 400 comprises first, second and third panel curving assemblies 324, 326 and 328, each of which comprises a frame 415 and multiple rollers supported by the frame 415, wherein the multiple rollers are arranged at predetermined locations to contact the building panel as the building panel passes along the multiple rollers in a longitudinal direction.

Figure 23:
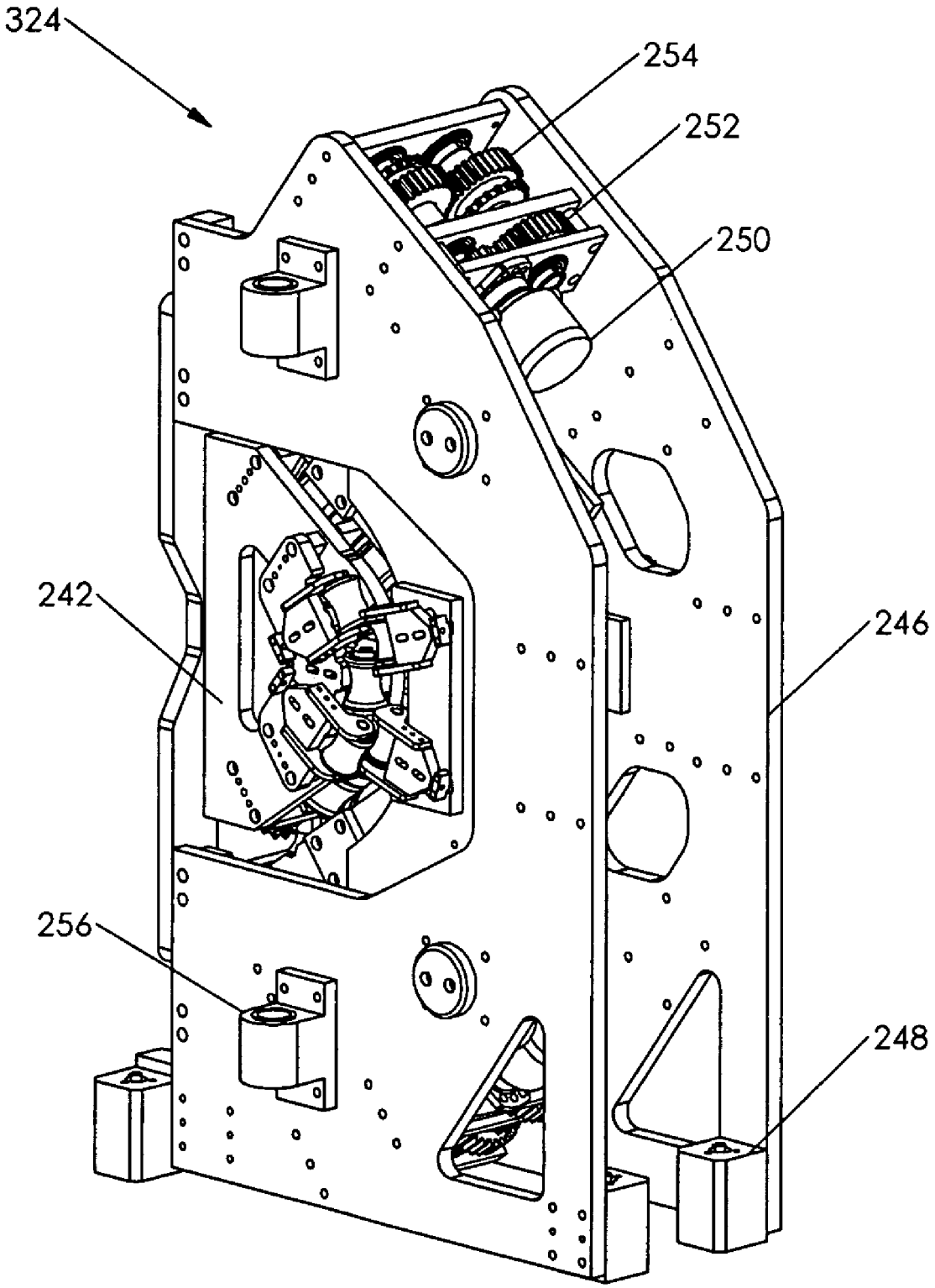
FIG. 23 illustrates a three dimensional isometric view an exemplary panel curving assembly of the panel curving machine of FIG. 22.
Figure 24:
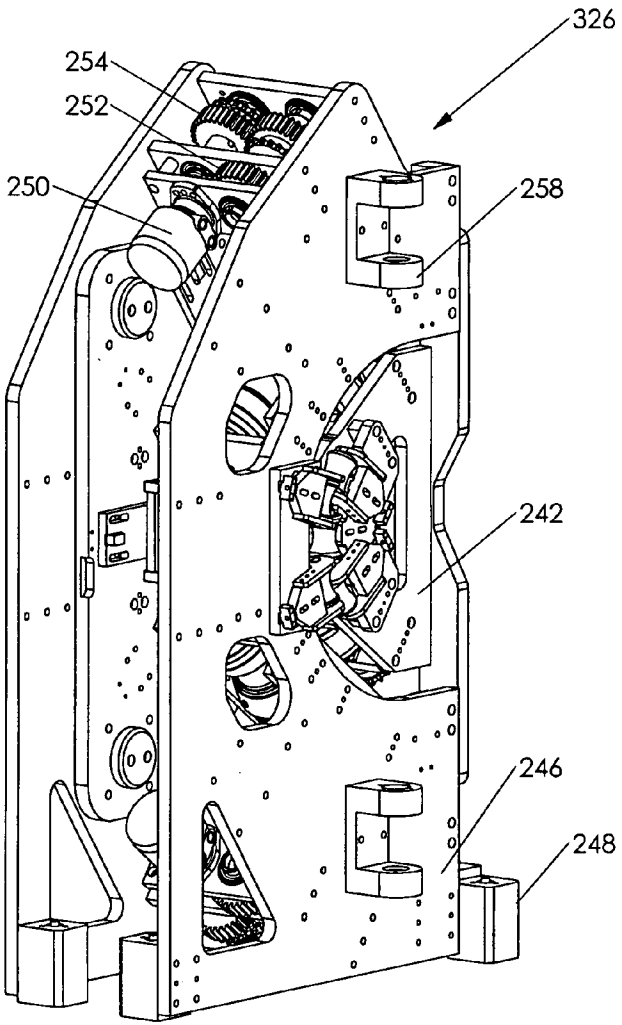
FIG. 24 illustrates another three dimensional isometric view of the exemplary panel curving assembly of FIG. 23.

FIG. 23 shows left side perspective view of curving assembly 324, and FIG. 24 shows a right side perspective view of curving assembly 326. FIGS. 25 and 26 show exemplary configurations of multiple rollers 260, 261, 262, 263, 264, 266, 267, 268, 272, 274, and 276 that contact a building panel 10. The multiple rollers include outer rollers 260, 261, 262, 263, 264, 266, and 268 that contact an outer side the building panel 10, and inner rollers 267, 272, 274 and 276 that contact and inner side of the building panel 10. FIG. 22 shows supplemental roller sections 288 comprising supplemental rollers 502, 504 and 506, shown in FIG. 26, which are positioned at the curving assemblies 324, 326 and 328 to further support the building panel 10.

The panel curving apparatus 400 is structurally similar to the panel curving apparatus 100 previously described in many respects except that panel curving apparatus 400 possesses a different configuration of rollers and does not use a cam/cam follower mechanism to force certain rollers into the building panel to thereby increase the depth of a particular segment. The use of three panel curving assemblies in the panel curving apparatus 400 has been found to be advantageous, but more than three panel curving assemblies could be used if desired. As shown in FIG. 22, an entry guide 290 is positioned adjacent to the first curving assembly 324.

The panel curving apparatus 400 also includes a positioning mechanism that permits changing a relative rotational orientation between the first curving assembly 324 and the second curving assembly 326. For example, the positioning mechanism can include a rotatable connection between adjacent curving assemblies, such as male and female pivot blocks 256 and 258 and pivot pin 286 illustrated in FIG. 22. The pivot pin 286 connects the male and female pivot blocks 256 and 258 and permits the relative rotational orientation of adjacent curving assemblies to be changed and controlled. The positioning mechanism may also include an actuator 282 (e.g., hydraulic actuator, rotary actuator or other actuating mechanism) to cause one curving assembly, e.g., 326 to rotate relative to an adjacent curving assembly, e.g., 324. The positioning mechanism may also include ball transfer mechanisms 248 that provide nearly frictionless movement to facilitate the positioning of the curving assemblies 326 and 328.

The panel curving apparatus 400 also includes a drive system for moving the building panel longitudinally along the multiple rollers of the curving assemblies 324, 326, and 328. For example, the drive system may include hydraulic motors 250 located at each curving assembly to drive a gear train that causes rollers to turn. A first reduction set 252 will provide the final speed and power to gear train 254. The gear train 254 will provide the rotary motion for rollers of the curving machine. Side plates 246 are used to mount all the drive and mechanical components. To obtain sufficient traction to translate the building panel 10 longitudinally, a urethane coating can be provided on rollers 260 and 267. This will provide enough force to drive the building panel through the panel curving apparatus 400. It will be appreciated that approaches other than urethane coatings can be used to enhance friction on these rollers, such as, for example other coatings, metal treatments, machined surfaces, etc. can be utilized to provide added friction.

The panel curving apparatus 400 can be controlled by control system 62 (described previously) for controlling the positioning mechanism so as to control the relative rotational orientation between the first curving assembly 324 and the second curving assembly 326 as the building panel 10 moves longitudinally along the multiple rollers 260, 261, 262, 263, 264, 266, 267, 268, 272, 274, and 276 to thereby form a longitudinal curve in the building panel. The panel curving apparatus 400 is configured to form the longitudinal curve in the building panel 10 without imparting transverse corrugations into the building panel. The multiple rollers 260, 261, 262, 263, 264, 266, 267, 268, 272, 274, and 276 of the first and second curving assemblies 324 and 326 are arranged so as to allow an increase in a depth of a particular segment of the plurality of segments of the building panel 10 to accommodate the formation of the longitudinal curve in the building panel 10*b* as a torque is applied to the building panel by adjacent curving assemblies.

The curved building panels and panel curving assemblies may have any dimensions suitable for a desired application, and such parameter will depend upon the particular size and shape of the longitudinally curved building panel that is desired. In exemplary embodiments, the panels may be, for example 24" wide and 10½" deep. Exemplary panel curving assemblies for longitudinally curving panels having these dimensions may be approximately 60" in height, 30" in depth, and 16" in length. The distance between pivot assemblies of these exemplary panel curving assemblies may be approximately 24". The approximate weight of such panel curving assemblies would be approximately 2000 lbs. each.

Unlike the panel curving apparatus 100, the panel curving apparatus 400 does not utilize a roller that itself forces an additional deformation into an existing segment of the building panel 10. Instead, the multiple rollers 260, 261, 262, 263, 264, 266, 267, 268, 272, 274, and 276 are configured so as to include various gaps at positions that align with existing segments of the building panel. Torque is applied to the building panel 10 via the multiple rollers as a relative rotational orientation is imposed between adjacent curving assemblies 324, 326, and 328 as the building panel moves longitudinally. This torque and relative rotation between curving assemblies combined with the guiding action of the multiple rollers 260, 261, 262, 263, 264, 266, 268, 272, 274, and 276 causes displacement of the sheet material as the building panel 10 curves (and linearly contracts in regions of greater longitudinal curvature, as discussed previously). This displaced sheet material tends to move into the gaps designed between various ones of the multiple rollers 260, 261, 262, 263, 264, 266, 267, 268, 272, 274, and 276. This will now be described in greater detail with reference to FIGS. 25 and 26.

FIG. 25 shows a cross sectional view of an exemplary configuration of multiple rollers 260, 261, 262, 263, 264, 266, 267, 268, 272, 274, and 276 present in curving assemblies 324, 326 and 328. According to one exemplary aspect, a particular roller 264 is positioned adjacent to upper opposing roller 276 and lower opposing roller 276. Roller 264 is configured so as to impact the sides of segment 16 so as to permit the central portion of segment 16 to deform toward the opposing rollers 276, thereby increasing its depth. Also, the particular roller 264 is positioned adjacent to opposing roller 276 such that a contacting surface portion of the particular roller 264 and a contacting surface portion of the opposing roller 276 contact opposing sides of the building panel 10 at a contact region, wherein a gap exists between opposing surfaces of the particular roller 264 and the opposing roller 276 adjacent to the contact region.

Also shown in cross section in FIG. 25 is a straight building panel 10 prior to imparting a longitudinal curve thereto. Building panel 10 is intended to be transformed into a longitudinally curved building panel 10*b* such as illustrated in FIGS. 25 and 26 by the panel curving machine 400. Consider, for example, that curving assembly 326 is rotated relative to curving assembly 324, which is stationary, as building panel moves longitudinally along the multiple rollers 260, 261, 262, 263, 264, 266, 267, 268, 272, 274, and 276 of curving assemblies 324 and 326. As the building panel 10 starts to curve longitudinally, the gap 300 between roller 264 and rollers 276 will be the area where segment 16 (FIG. 2) will be further deformed by absorbing displaced sheet material so as to form segment 16*b*. Roller 264 has a slight convex shape which helps direct the segment 16 into gap 300. Rollers 276 which are mounted to support member 242 (e.g., D-ring) will help support and provide the final shape of segment 16*b*. After segment 16 is further deformed to absorb displaced sheet material, it will resemble the segment 16*b* shown in FIG. 21. Adjacent segments 14 and 18 are similarly further deformed in connection with the longitudinal curving by absorbing displaced sheet material so as to form segments 14*b* and 18*b* in building panel 10*b*.

As noted previously, the change depth Δd1 of middle segment 16*b* is greater than the change in depth Δd4 of adjacent segments 24*b* and 26*b* of longitudinally curved building panel 10*b*. This is because the building panel 10*b* is being longitudinally curved to a greater extent at the middle portion of the building panel 10*b* near deformation 16*b* and is effectively having its linear length shortened to a greater extent in regions where the building panel 10*b* has greater longitudinal curvature, the greatest amount of longitudinal curvature occurring at the middle of the building panel 10*b* near segment 16*b*. As the building panel 10*b* is curved, the "excess" sheet material that is being displaced due to the longitudinal linear contraction must be absorbed someplace, and the displaced sheet material accumulates and is absorbed in the segments. Because segments 24*b* and 26*b* are located at points of lesser linear contraction of the building panel 10*b* compared to segment 16*b*, segments 24*b* and 26*b* are less deformed and less deep than segment 16*b* as a result of the curving process.

As shown in FIG. 25, the multiple rollers are configured to have gaps between various rollers that having sizes and shapes consistent with the expected amounts of panel deformation at different locations described above. In particular, segment 16 is permitted to deform into gap 300 between rollers 264 and 276 to ultimately form segment 16*b*. The shape of the segment accommodated by gap 300 is governed by the shapes of rollers 276. As noted above, roller 264 has a slight convex shape which helps direct displaced sheet material into gap 300. Gap 300 is the largest gap shown in FIG. 25. Upper and lower gaps 308 are somewhat smaller than gap 300 since less displacement of sheet material is expected there for reasons discussed above. Segments 24 and 26 shown in FIG. 2 are permitted to deform into gaps 308 to ultimately form segments 24*b* and 26*b* of FIG. 21. Rollers 276 have small convex portions which help direct displaced sheet material into gaps 308. The shape of the segment accommodated by gaps 308 is governed by the shapes of rollers 264 and 268.

Upper and lower gaps 302 are somewhat smaller than gaps 308 since less displacement of sheet material is expected there. Segments 14 and 18 are permitted to deform into gaps 302 to ultimately form segments 14*b* and 18*b*. Rollers 268 have a small convex portion which helps direct displaced sheet material into gaps 302. The shape of the segments accommodated by gap 302 is governed by the shapes of rollers 274 and 276. Upper and lower gaps 304 are somewhat smaller than gaps 302. Segments 22 and 28 are permitted to deform into upper and lower gaps 304 to ultimately form segments 22*b* and 28*b*. Rollers 274 have a small convex portion which helps direct displaced sheet material into gaps 304. The shape of the segments accommodated by gap 304 is governed by the shapes of rollers 266. Finally, upper and lower gaps 306 are somewhat smaller than gaps 304. Segments 12 and 20 are permitted to deform into upper and lower gaps 306 to form segments 12*b* and 20*b*. Rollers 262 have a small convex portion which helps direct displaced sheet material into gaps 306. The shape of the segments accommodated by gaps 306 is governed by the shapes of rollers 272 and 274.

In addition to the multiple rollers 260, 261, 262, 263, 264, 266, 267, 268, 272, 274, and 276 described above, supplemental rollers may be positioned between adjacent curving assemblies 324, 326 and 328. FIG. 26 shows supplemental rollers 502, 504, 506 positioned relative the multiple rollers 260, 261, 262, 263, 264, 266, 268, 272, 274, and 276. The rollers 502, 504 and 506 can be located between curving assemblies 324, 326 and 328, and can be supported by a support member 242, e.g., D-ring, which is supported by the frame 415, as shown in FIG. 23. The supplemental rollers 502, 504, 506 function to support the building panel 10*b* and to maintain the final form of segments 14*b*, 16*b*, 18*b*, 24*b* and 26*b*. Without these supplemental rollers 502, 504, 506, the building panel 10*b* may tend to buckle or excessively form in the unsupported areas between the main rollers 264, 268, 276. Such buckling is aesthetically and structurally undesirable.

Figure 27:
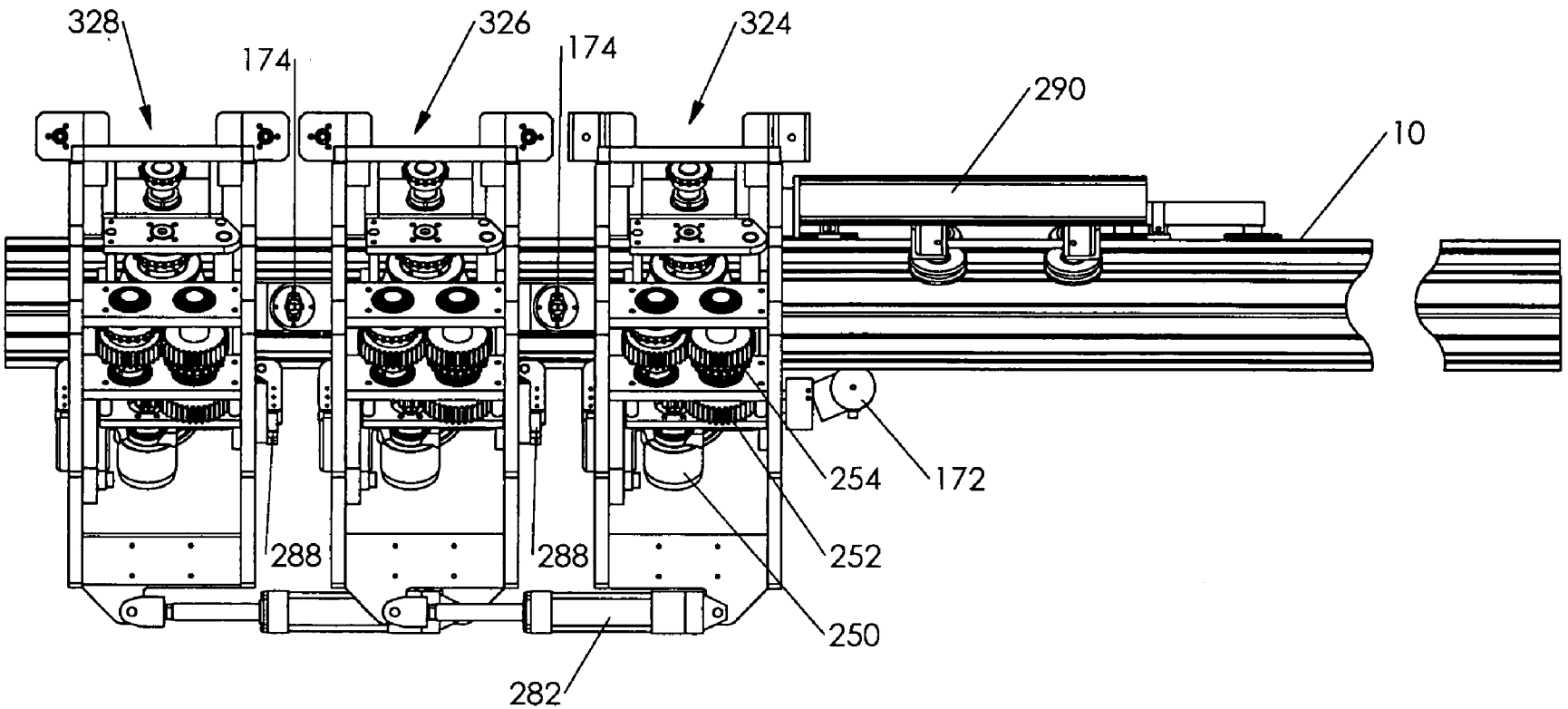
FIG. 27 illustrates a top view of the exemplary panel curving machine of FIG. 22 with a longitudinally straight panel inserted therein according to an exemplary aspect.
Figure 28:
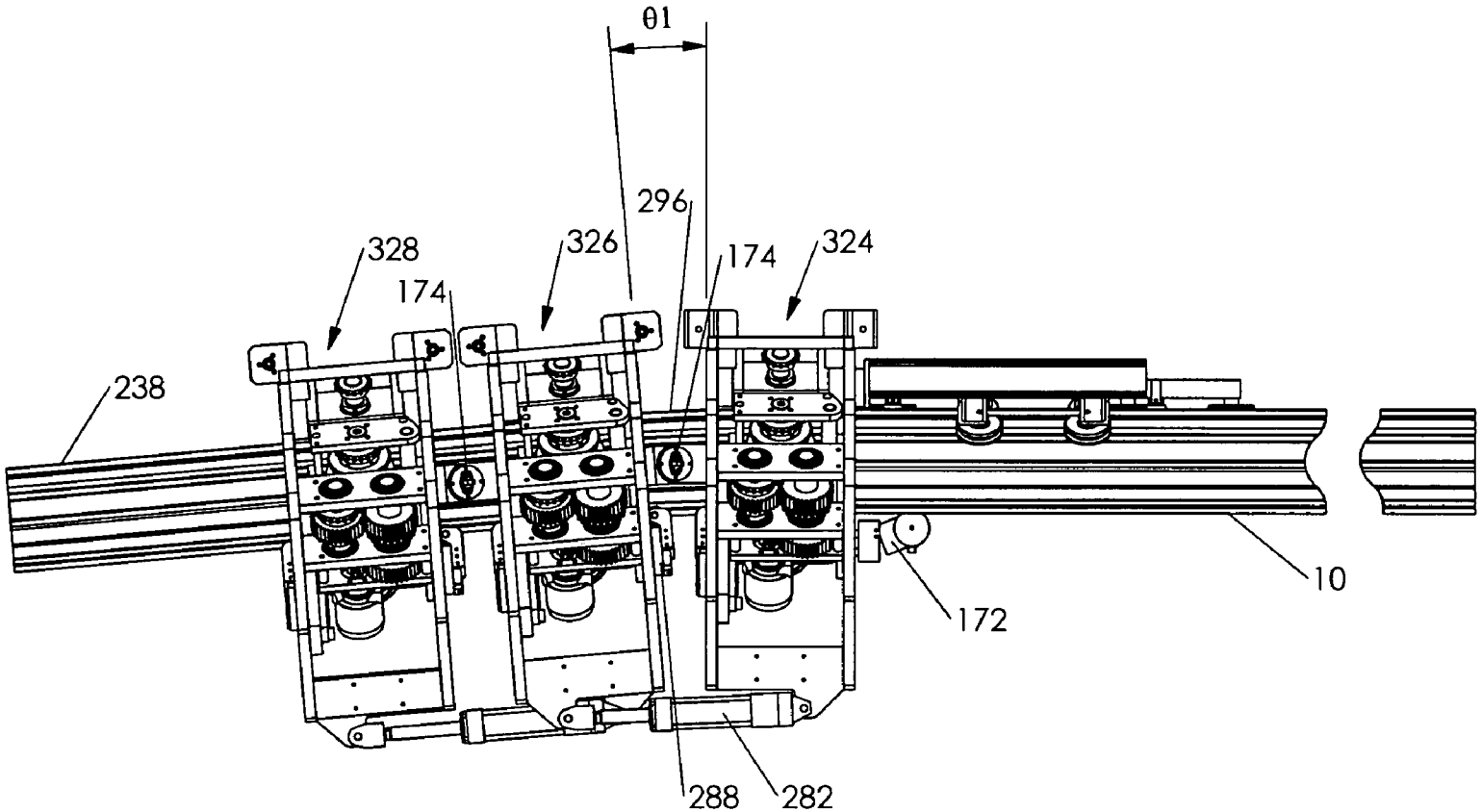
FIG. 28 illustrates another top view of the exemplary panel curving machine of FIG. 22 with the building panel inserted and with relative rotation between first and second panel curving assemblies to promote longitudinal curving of the building panel.
Figure 29:
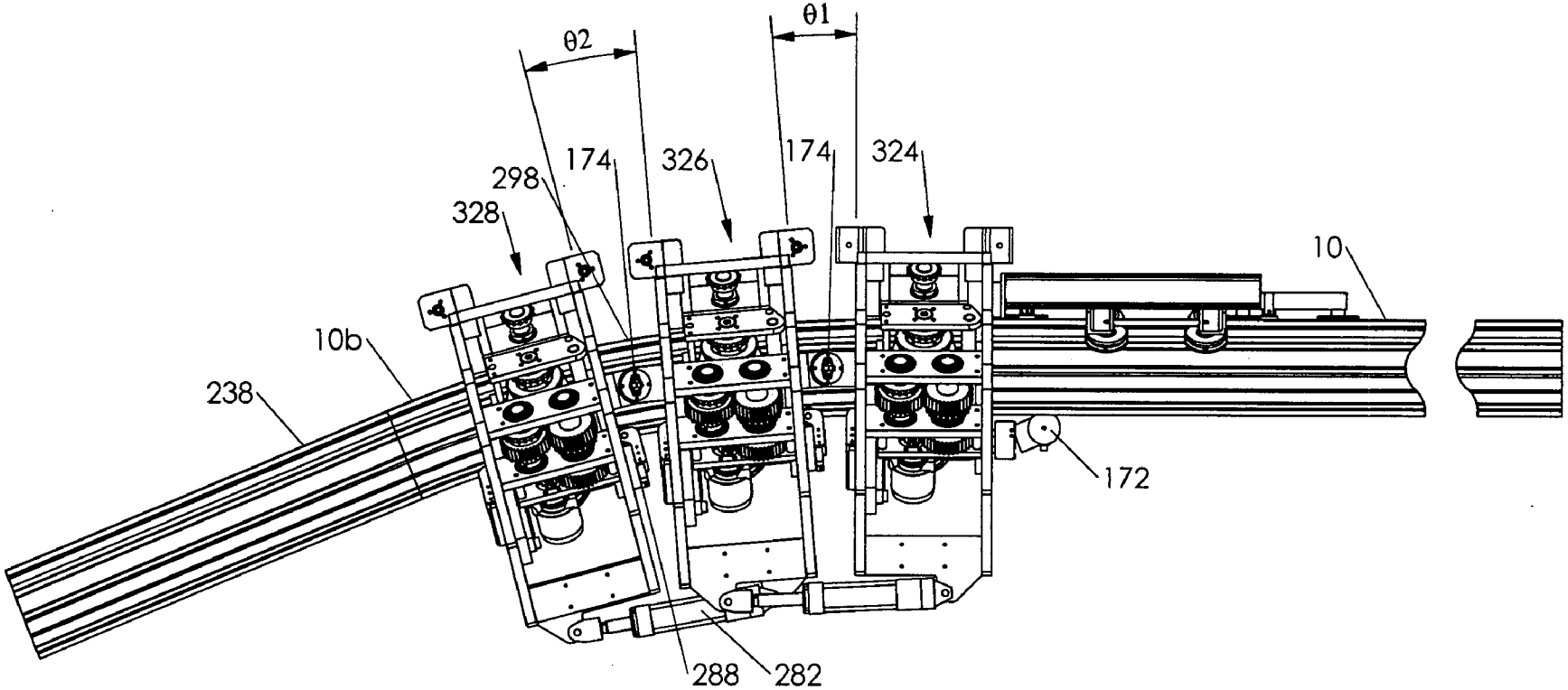
FIG. 29 illustrates another top view of the exemplary panel curving machine of FIG. 22 with the building panel inserted and relative rotation between second and third panel curving assemblies.

An overall operation of the panel curving machine 400 comprising multiple curving assemblies 324, 326, and 328 to longitudinally curve a building panel will now be described with reference to FIGS. 27-29. FIGS. 27-29 show a top view of an exemplary sequence for imparting a longitudinal curve to a building panel 10. FIG. 27 shows the panel curving machine 400 before any curving of the building panel occurs. A straight building panel 10 is inserted into the entry guide 290 of the panel curving machine 400. Motors 250 and associated drive mechanisms, and drive rollers 260, 261, 262, 263, 270 and 272 move the building panel 10 into place through all three curving assemblies 324, 326 and 328 without initially imparting any longitudinal curve to the building panel 10. Once the building panel 10 inserted into curving assemblies 324, 326 and 328, the control system 62 can automatically begin translating the building panel 10 longitudinally and begin the curving process.

As shown in FIG. 28, while the building panel 10 is translating longitudinally, the control system 62 causes actuator 282 to rotate curving assembly 326 relative to curving assembly 324 by an angle θ1. Curving assembly 324 is fixed in place. Curving assembly 328 rotates along with curving assembly 326. A sensor, e.g., any suitable optical or electronic position transducer for measuring rotation and/or translation, such as described previously herein, may be used to precisely measure the position of each curving assembly 324, 326 and 328. As shown in FIG. 28, portion 296 of the building panel 10 is now beginning to curve under the influence of the torque applied to the building panel 10 by the multiple rollers 260, 261, 262, 263, 264, 266, 267, 268, 272, 274, and 276 of curving assemblies 324 and 326. The longitudinal curve is imparted as the building panel 10 moves through the panel curving machine 400 without the need for transverse corrugations and without causing buckling. As the curving takes place, segments and segments of the building panel 10 will further deform as displaced sheet material tends to move into gaps 300, 302, 304, 306, and 308, as discussed previously.

Next, as shown in FIG. 29, while the building panel 10 is translating longitudinally and when the initially curved portion 296 arrives at curving assembly 328, the control system 62 causes another actuator 282 to rotate curving assembly 328 relative to curving assembly 326 by an angle θ2 that is greater than θ1. Region 298 of the building panel is curved by an additional amount under the influence of the torque applied to the building panel by the multiple rollers 260, 261, 262, 263, 264, 266, 267, 268, 272, 274, and 276 of curving assemblies 328 and 326. The ranges for θ2 and θ1 are like those previously described.

The longitudinal curving process as described above will continue in this manner to produce curved building panels 10 as long as desired. A suitable shearing device (not shown) as known to those of skill in the art can be positioned near the curving assembly 328 to shear the building panel 10 at desired lengths for a given building project, and the shearing device can be controlled by the control system 62 as well. A sensor such as previously described can be used at one or more locations to make length measurements on the building panels 10*b* being formed, and these measurements can be fed to the control system 62 so that the control system 62 can control the shearing process to achieve building panels 10*b* of desired length and to achieve building panels having multiple radii, should that be desired.

As shown in FIG. 29, a portion 238 of the building panel emanating from curving assembly 328 is straight because there is a minimal length of the building panel 10 that must be initially inserted into the panel curving apparatus 400 to initiate the curving process as shown in FIG. 27. Such straight portions, which continuously connect with curved portions, are sometimes desirable to provide a straight wall section for a gable style building or a double-radius (two-radius) style building, such as shown in FIGS. 5 and 7. Entirely curved building panels can be used to fabricate the curved portions of arch style buildings such as shown in FIG. 6. Straight sections 238 can be discarded or utilized in the building project as may be desired.

As described above, both the active deformation approach of panel curving apparatus 100 and the passive deformation approach of panel curving apparatus 400 can be used to impart a longitudinal curve into a building panel without buckling and without the need for transverse corrugations. Thus, in light of the above descriptions, according to an exemplary aspect, a method of curving a building panel using a panel curving apparatus may comprise various steps, including receiving the building panel at the first curving assembly and engaging the building panel with multiple first rollers of the first curving assembly, the building panel including along its length a plurality of longitudinal deformations extending in a longitudinal direction of the building panel, the building panel having a shape in cross section in a plane perpendicular to the longitudinal direction, the building panel including in cross section a curved center portion, a pair of side portions extending from the curved center portion, and a pair of connecting portions extending from the side portions. The method also includes translating the building panel toward the second curving assembly and engaging a first portion of the building panel with multiple second rollers of the second curving assembly while a second portion of the building panel is engaged with the first curving assembly, and controlling a positioning mechanism with a control system so as to cause the first curving assembly and the second curving assembly to be in a rotated orientation relative to each other while the building panel moves longitudinally along the first curving assembly and the second curving assembly to thereby form a longitudinal curve in the building panel without imparting transverse corrugations into the building panel. In the method, the multiple first rollers and multiple second rollers are arranged so as to cause an increase in a depth of a particular longitudinal deformation of the plurality of longitudinal deformations of the building panel to accommodate the formation of the longitudinal curve in the building panel.

Figure 30:
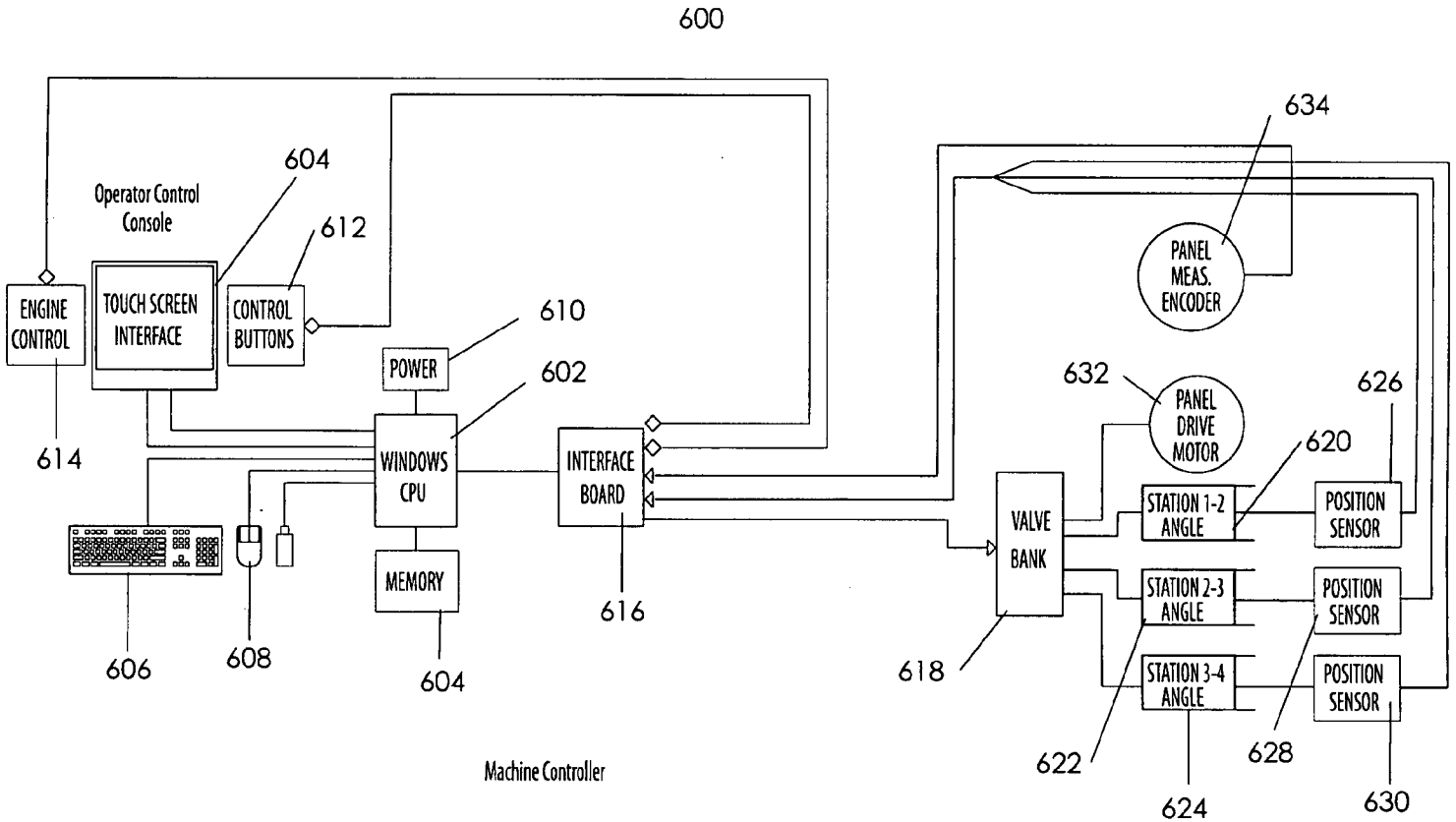
FIG. 30 illustrates an exemplary control system relative to other aspects of a panel curving system according to an exemplary aspect.

FIG. 30 illustrates an exemplary control system 600, such as control system 62 of FIG. 8A, which can be used relative to other aspects of a panel curving system according to an exemplary aspect. In exemplary embodiments, the control system is a closed-loop feedback system configured to continually monitor and adjust the relative rotational orientation between the curving assemblies as the building panel moves longitudinally along the multiple rollers of the curving assemblies such that a longitudinal curve is formed in the building panel as described above. The control system is typically managed by a microprocessor-based central processing unit (CPU) 602, for example a Windows OS computer, having interfaces to various components. A less sophisticated control system, such as user-manipulated manual controls could be used, but a microprocessor-based controller capable of receiving sensor feedback is believed to be preferable. The CPU executes program instructions stored in a memory 604, which may include a computer-readable medium, such as a magnetic disk or other magnetic memory, an optical disk (e.g., DVD) or other optical memory, RAM, ROM, or any other suitable memory such as Flash memory, memory cards, etc.

A user interacts with the CPU via input/output (I/O) devices that may be collectively referred to herein as a man-machine interface. These I/O devices can include, for example, a touch screen display interface 604, a keyboard 606, and a mouse 608. The CPU 602 is also connected to a CPU power supply 610.

The CPU 602 is attached via a bus, for example a Serial Peripheral Interface (SPI) bus, to an interface board 616. The interface board 616 includes peripheral interface components such as analog-to-digital and digital-to-analog converters for sending outputs to and receiving inputs from various other aspects of a panel curving system. The interface board 616 may be, for example, a simple I/O controller driven by the CPU 602 or a stand-alone microcontroller in communication with the CPU 602 that includes its own onboard CPU and memory. The interface board 616 communicates with a set of control buttons 612, for example as described below in connection with FIG. 31, to receive various inputs. In addition, the interface board 616 communicates with the engine control interface 614 that controls the power supply 58, e.g., a diesel engine, of FIG. 8A. The interface board 616 drives a valve bank 618, for example a set of solenoids. The valve bank 618 controls the actuators 282 of FIG. 22 (e.g., hydraulic actuators, rotary actuators or other actuating mechanisms) and the drive system for moving the building panel longitudinally along the multiple rollers of the curving assemblies (shown as panel drive motor 632). As previously discussed, the actuators 282 control the relative angles of the panel curving assemblies. For exemplary purposes, the actuators 282 are shown in FIG. 30 as station 1-2 angle 620, station 2-3 angle 622, and station 3-4 angle 624 referring to the relative angles between four panel curving assemblies in accordance with certain embodiments.

The relative angle between the panel curving assemblies is monitored by position sensors 626, 628, 630, for example by measuring the position of each of the actuators. The position sensors may be any suitable component capable of providing an electrical signal to the interface board that indicates the position of the actuator, such as, for example, any suitable analog position transducer or digital optical encoder. The output of the position sensors 626, 628, 630 is fed back to the interface board 616. The panel drive motor 632 provides torque to translate the building panel through the curving assemblies while panel measurement encoder 634, e.g., sends a signal to the interface board 616 indicating the length of the panel processed.

Figure 31:
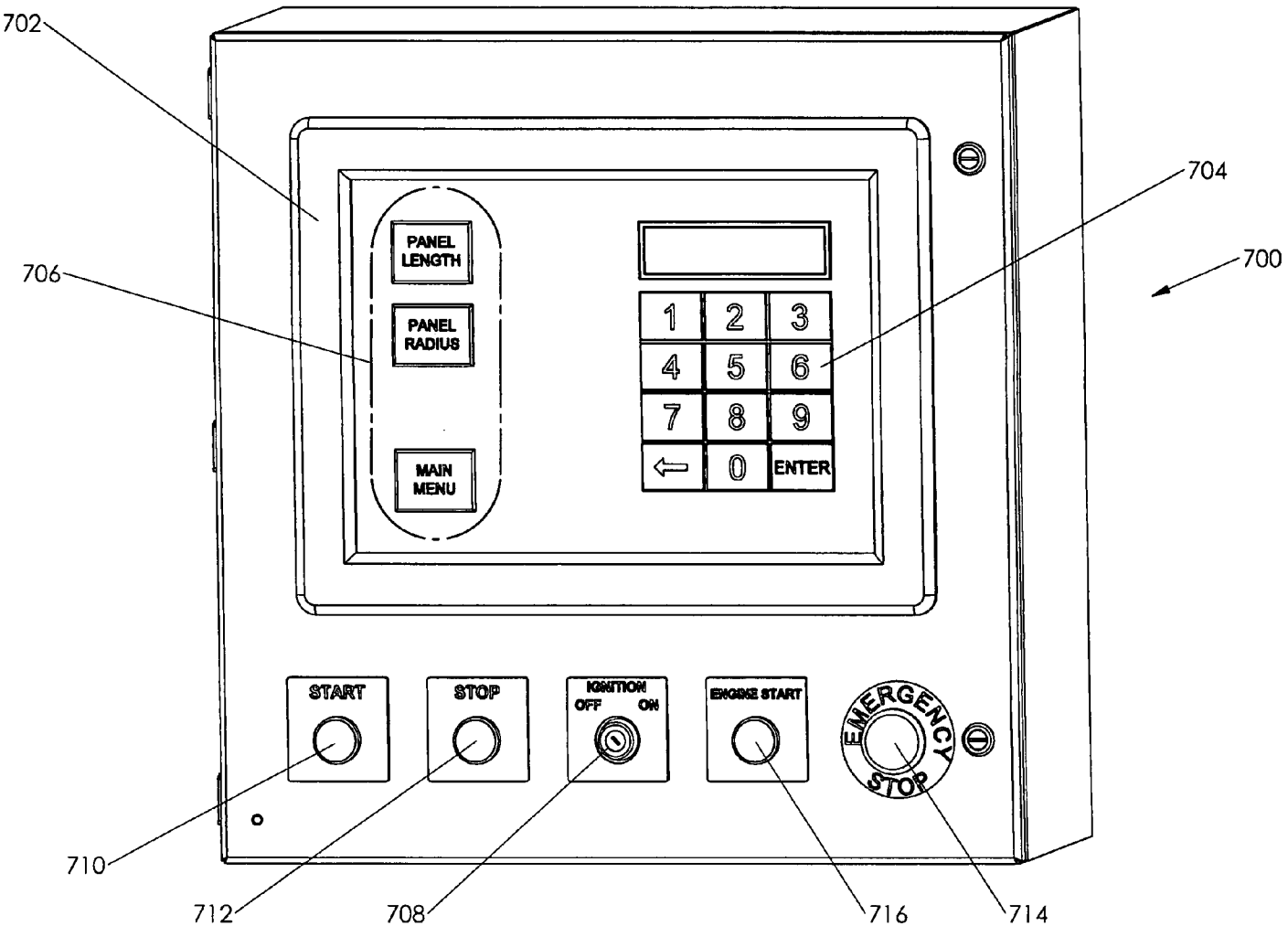
FIG. 31 illustrates an exemplary operator interface console of a control system according to an exemplary aspect.

FIG. 31 illustrates an exemplary operator interface console 700 of the control system according to an exemplary aspect.

The touch screen 702 includes a pop-up numeric keypad 704 for entering data and a selection portion 706, e.g., various soft push buttons, for specifying various functions such as, for example, PANEL LENGTH to input the desired building panel length and PANEL RADIUS to input the desired building panel radius of curvature. The exemplary operator interface console 700 also includes a keyed ignition switch 708 for enabling or stopping the power supply 58, a start button 710 for commencing the panel curving process, a stop button 712 for stopping the panel curving process, an engine start button 716 for starting the power supply 58, and an emergency stop button 714 for quickly stopping the panel curving process and the power supply 58 in case of emergencies.

While the present invention has been described in terms of exemplary embodiments, it will be understood by those skilled in the art that various modifications can be made thereto without departing from the scope of the invention as set forth in the claims.

What is claimed is:

1. A system for curving a building panel, the building panel being made from sheet material, the building panel extending in a longitudinal direction along its length and having a shape in cross section in a plane perpendicular to the longitudinal direction, the building panel including a curved center portion in cross section, a pair of side portions extending from the curved center portion in cross section, and a pair of connecting portions extending from the side portions in cross section, the curved center portion including a plurality segments comprising multiple outwardly extending segments and multiple inwardly extending segments in cross section, the plurality of segments extending in the longitudinal direction, the system comprising:

a first curving assembly and a second curving assembly, the second curving assembly positioned adjacent to the first curving assembly, the first curving assembly including a first frame and multiple first rollers supported by the first frame, the multiple first rollers arranged at first predetermined locations to contact the building panel as the building panel passes along the multiple first rollers in the longitudinal direction, the second curving assembly including a second frame and multiple second rollers supported by the second frame, the multiple second rollers arranged at second predetermined locations to contact the building panel as the building panel passes along the multiple second rollers in the longitudinal direction;

a positioning mechanism that permits changing a relative rotational orientation between the first curving assembly and the second curving assembly;

a drive system for moving the building panel longitudinally along the multiple first rollers and the multiple second rollers; and a control system for controlling the positioning mechanism so as to control the relative rotational orientation between the first curving assembly and the second curving assembly as the building panel moves longitudinally along the multiple first rollers and the multiple second rollers to thereby form a longitudinal curve in the building panel, the system being configured to form the longitudinal curve in the building panel without imparting transverse corrugations into the building panel, the multiple first rollers and multiple second rollers being arranged so as to cause an increase in a depth of a particular segment of the plurality of segments of the building panel to accommodate the formation of the longitudinal curve in the building panel.

2. The system of claim 1, wherein:

the multiple first rollers of the first curving assembly comprise inner first rollers supported by the first frame and outer first rollers supported by the first frame, the outer first rollers being positioned to contact an outer side of the building panel, and the inner first rollers being positioned to contact an inner side of the building panel; and the multiple second rollers of the second curving assembly comprise inner second rollers supported by the first frame and outer second rollers supported by the first frame, the outer second rollers being positioned to contact the outer side of the building panel and the inner second rollers being positioned to contact the inner side of the building panel.

3. The system of claim 1, comprising:

a third curving assembly positioned adjacent to the second curving assembly, the third curving assembly including a third frame and multiple third rollers supported by the third frame, the multiple third rollers arranged at third predetermined locations to contact the building panel as the building panel passes along the multiple third rollers in the longitudinal direction; and another positioning mechanism that permits changing a relative rotational orientation between the second curving assembly and the third curving assembly.

4. The system of claim 1, wherein a particular roller of the multiple second rollers is positioned to contact the particular segment of the building panel so as to increase the depth of the particular segment as the building panel moves along the multiple second rollers.

5. The system of claim 1, wherein a particular roller of the multiple second rollers is positioned adjacent to two opposing rollers of the multiple second rollers such that a contacting surface portion of the particular roller is disposed between contacting surface portions of the two opposing rollers under a deformation imparting condition, an outer-most point of the contacting surface portion of the particular roller being displaceable toward rotation axes of the two opposing rollers by a distance S.

6. The system of claim 1, wherein a particular roller of the multiple second rollers is positioned adjacent to one or more opposing rollers of the multiple second rollers and is configured to impact a side of the particular segment so as to permit the side of the particular segment to deform toward the center of the particular segment, thereby increasing the depth of the particular segment.

7. The system of claim 1, wherein a particular roller of the multiple second rollers is positioned adjacent to an opposing roller of the multiple second rollers such that a contacting surface portion of the particular roller and a contacting surface portion of the opposing roller contact opposing sides of the building panel at a contact region, and wherein a gap exists between opposing surfaces of the particular roller and the opposing roller adjacent to the contact region.

8. The system of claim 1, comprising multiple supplemental rollers supported by a support member, the support member supported by the second frame, the supplemental rollers positioned between the first frame and the second frame to support the building panel as it moves in the longitudinal direction along the first curving assembly and second curving assembly.

9. The system of claim 1, further comprising a panel forming apparatus positioned adjacent to the first curving assembly, the panel forming apparatus comprising multiple forming assemblies positioned adjacent to one another, the panel forming apparatus configured to form a flat sheet of the sheet material into said building panel having said cross-sectional shape but without said longitudinal curve, the panel forming apparatus being aligned with the first curving assembly so as feed the straight building panel to the first curving assembly and the second curving assembly so that the first curving assembly and the second curving assembly can impart said longitudinal curve.

10. The system of claim 9, wherein the panel forming apparatus, the first curving assembly and second curving assembly are oriented in a vertical direction perpendicular to the longitudinal direction, the vertical direction being parallel to a direction passing through the pair of connecting portions extending from the side portions of the building panel.

11. The system of claim 10, comprising a coil holder for feeding sheet material from a coil of sheet material to the panel forming apparatus, wherein a rotation axis of the coil holder is oriented in the vertical direction.

12. The system of claim 11, wherein the panel forming apparatus, the first curving assembly, the second curving assembly, and the coil holder are supported by a common support structure.

13. The system of claim 12, wherein the support structure is configured as a mobile platform.

14. The system of claim 1, wherein the sheet material comprises sheet metal having a thickness between about 0.040 inches and about 0.060 inches.

15. A method curving a building panel using a panel curving system, the building panel being made from sheet material, the building panel extending in a longitudinal direction along its length and having a shape in cross section in a plane perpendicular to the longitudinal direction, the building panel including a curved center portion in cross section, a pair of side portions extending from the curved center portion in cross section, and a pair of connecting portions extending from the side portions in cross section, the curved center portion including a plurality segments comprising multiple outwardly extending segments and multiple inwardly extending segments in cross section, the plurality of segments extending in the longitudinal direction, the panel curving system comprising a first curving assembly and a second curving assembly, the method comprising:

receiving the building panel at the first curving assembly and engaging the building panel with multiple first rollers of the first curving assembly;

translating the building panel toward the second curving assembly and engaging a first portion of the building panel with multiple second rollers of the second curving assembly while a second portion of the building panel is engaged with the first curving assembly; and controlling a positioning mechanism with a control system so as to cause the first curving assembly and the second curving assembly to be in a rotated orientation relative to each other while the building panel moves longitudinally along the first curving assembly and the second curving assembly to thereby form a longitudinal curve in the building panel without imparting transverse corrugations into the building panel, wherein the multiple first rollers and multiple second rollers are arranged so as to cause an increase in a depth of a particular segment of the plurality of segments of the building panel to accommodate the formation of the longitudinal curve in the building panel.

16. The method of claim 15, wherein the sheet material comprises sheet metal having a thickness between about 0.040 inches and about 0.060 inches.

17. A system for curving a building panel made of sheet material, the system comprising:

a support structure;

a coil holder supported by the support structure for holding a coil of sheet material;

a panel forming apparatus supported by the support structure and positioned proximate the coil holder, the panel forming apparatus configured to form a longitudinally straight building panel from the sheet material with a desired cross sectional shape;

a panel curving apparatus supported by the support structure and positioned proximate the panel forming apparatus to receive the straight building panel from the panel forming apparatus, the panel curving apparatus configured to impart a longitudinal curve to the building panel along the length of the building panel, the panel curving apparatus comprising a first curving assembly comprising multiple first rollers arranged to contact the building panel, and a second curving assembly comprising multiple second rollers arranged to contact the building panel, the second curving assembly positioned adjacent to the first curving assembly;

a positioning mechanism that permits changing a relative rotational orientation between the first curving assembly and the second curving assembly; and a control system for controlling the positioning mechanism so as to control the relative rotational orientation between the first curving assembly and the second curving assembly as the building panel moves longitudinally along the multiple first rollers and the multiple second rollers to thereby form a longitudinal curve in the building panel;

wherein the coil holder is oriented vertically such that a rotation axis of the coil holder is parallel to a vertical direction, wherein the panel forming apparatus is oriented vertically so as to receive sheet material oriented in a vertical plane directly from the coil of sheet material, and wherein the panel curving apparatus is oriented vertically so as to receive the straight building panel directly from the panel forming apparatus.

18. The system of claim 17, the system being configured to form the longitudinal curve in the building panel without imparting transverse corrugations into the building panel.

19. The system of claim 17, the multiple first rollers and multiple second rollers being arranged so as to cause an increase in a depth of a particular segment of the plurality of segments of the building panel to accommodate the formation of the longitudinal curve in the building panel.

20. The system of claim 17, wherein the support structure is configured as a mobile platform.

21. The system of claim 17, wherein the sheet material comprises sheet metal having a thickness between about 0.040 inches and about 0.060 inches.

22. A system for curving a building panel made of sheet material, the system comprising:

a coil holder for holding a coil of sheet material;

a panel forming apparatus for receiving sheet material from the coil holder, the panel forming apparatus configured to form a building panel from the sheet material with a desired cross sectional shape;

a panel curving apparatus configured to impart a longitudinal curve to the building panel along the length of the building panel, the panel curving apparatus comprising a first curving assembly and a second curving assembly;

a positioning mechanism that permits changing a relative rotational orientation between the first curving assembly and the second curving assembly; and a control system for controlling the positioning mechanism so as to control the relative rotational orientation between the first curving assembly and the second curving assembly to thereby form a longitudinal curve in the building panel as the building panel moves longitudinally along the first and second curving assemblies;

wherein the coil holder is oriented vertically such that a rotation axis of the coil holder is parallel to a vertical direction, wherein the panel forming apparatus is oriented vertically so as to receive sheet material oriented in a vertical plane from the coil of sheet material and to form the building panel in a vertical orientation, and wherein the panel curving apparatus is oriented vertically so as to form the longitudinal curve in the building panel while the panel curving apparatus is oriented in the vertical orientation.

23. The system of claim 22, the system being configured to form the longitudinal curve in the building panel without imparting transverse corrugations into the building panel.

24. The system of claim 22, wherein first curving assembly comprises multiple first rollers arranged to contact the building panel, and wherein the second curving assembly comprises multiple second rollers arranged to contact the building panel, the second curving assembly positioned adjacent to the first curving assembly.

25. The system of claim 24, the multiple first rollers and multiple second rollers being arranged so as to cause an increase in a depth of a segment of the plurality of segments of the building panel to accommodate the formation of the longitudinal curve in the building panel.

26. The system of claim 22, wherein the panel forming apparatus, the first curving assembly, the second curving assembly, and the coil holder are supported by a common support structure.

27. The system of claim 26, wherein the support structure is configured as a mobile platform.

28. The system of claim 22, wherein the sheet material comprises sheet metal having a thickness between about 0.040 inches and about 0.060 inches.

29. A system for curving a building panel made of sheet material, comprising:

a first curving assembly including a first frame and multiple first rollers supported by the first frame, the multiple first rollers arranged at first predetermined locations;

a second curving assembly including a second frame and multiple second rollers supported by the second frame, the multiple second rollers arranged at second predetermined locations;

a positioning mechanism that permits changing a relative rotational orientation between the first curving assembly and the second curving assembly;

a drive system for moving the building panel longitudinally along the multiple first rollers and the multiple second rollers; and a control system for controlling the positioning mechanism so as to control the relative rotational orientation between the first curving assembly and the second curving assembly to thereby form a longitudinal curve in the building panel as the building panel moves longitudinally along the first and second curving assemblies.

30. The system of claim 29, the system being configured to form the longitudinal curve in the building panel without imparting transverse corrugations into the building panel.

31. The system of claim 29, wherein the building panel comprises a plurality of segments extending along a length of the building panel in the longitudinal direction, the multiple first rollers and multiple second rollers being arranged so as to cause an increase in a depth of a segment of the plurality of segments of the building panel to accommodate the formation of the longitudinal curve in the building panel.

32. The system of claim 29, comprising:

a third curving assembly positioned adjacent to the second curving assembly, the third curving assembly including a third frame and multiple third rollers supported by the third frame, the multiple third rollers arranged at third predetermined locations; and another positioning mechanism that permits changing a relative rotational orientation between the second curving assembly and the third curving assembly.

33. The system of claim 32, wherein the control system is configured to control said another positioning mechanism so as to control the relative rotational orientation between the second curving assembly and the third curving assembly.

34. The system of claim 29, further comprising a panel forming apparatus positioned adjacent to the first curving assembly, the panel forming apparatus configured to provide a desired cross-sectional shape to said sheet material.

35. The system of claim 34, wherein the panel forming apparatus, the first curving assembly and second curving assembly are oriented in a vertical direction.

36. The system of claim 35, comprising a coil holder for feeding sheet material from a coil of sheet material to the panel forming apparatus, wherein a rotation axis of the coil holder is oriented in the vertical direction.

37. The system of claim 36, wherein the panel forming apparatus, the first curving assembly, the second curving assembly, and the coil holder are supported by a common support structure.

38. The system of claim 37, wherein the support structure is configured as a mobile platform.

39. The system of claim 29, wherein the sheet material comprises sheet metal having a thickness between about 0.040 inches and about 0.060 inches.

40. A method curving a building panel using a panel curving system, the method comprising:

receiving a building panel made of sheet material at a first curving assembly of a panel curving system and engaging the building panel with multiple first rollers of the first curving assembly;

translating the building panel longitudinally toward a second curving assembly and engaging a first portion of the building panel with multiple second rollers of the second curving assembly while a second portion of the building panel is engaged with the first curving assembly; and controlling a positioning mechanism with a control system so as to cause the first curving assembly and the second curving assembly to be in a rotated orientation relative to each other while the building panel moves longitudinally along the first curving assembly and the second curving assembly to thereby form a longitudinal curve in the building panel.

41. The method of claim 40, wherein forming the longitudinal curve in the building panel is done without imparting transverse corrugations into the building panel.

42. The method of claim 40, wherein the building panel comprises a plurality of segments extending along a length of the building panel in the longitudinal direction, wherein the multiple first rollers and multiple second rollers are arranged so as to cause an increase in a depth of a segment of the plurality of segments of the building panel to accommodate the formation of the longitudinal curve in the building panel.

43. The method of claim 40, wherein the sheet material comprises sheet metal having a thickness between about 0.040 inches and about 0.060 inches.

* * * * *